US010655441B2

(12) United States Patent
Kuhlman

(10) Patent No.: US 10,655,441 B2
(45) Date of Patent: May 19, 2020

(54) STIMULATION OF LIGHT TIGHT SHALE OIL FORMATIONS

(71) Applicant: World Energy Systems Incorporated, Fort Worth, TX (US)

(72) Inventor: Myron I. Kuhlman, Houston, TX (US)

(73) Assignee: World Energy Systems, Inc., Fort Worth, TX (US)

( * ) Notice: Subject to any disclaimer, the term of this patent is extended or adjusted under 35 U.S.C. 154(b) by 178 days.

(21) Appl. No.: 15/548,277

(22) PCT Filed: Feb. 5, 2016

(86) PCT No.: PCT/US2016/016857
§ 371 (c)(1),
(2) Date: Aug. 2, 2017

(87) PCT Pub. No.: WO2016/127108
PCT Pub. Date: Aug. 11, 2016

(65) Prior Publication Data

US 2018/0010434 A1 Jan. 11, 2018

Related U.S. Application Data

(60) Provisional application No. 62/248,527, filed on Oct. 30, 2015, provisional application No. 62/113,439, filed on Feb. 7, 2015.

(51) Int. Cl.
*E21B 43/24* (2006.01)
*E21B 43/247* (2006.01)
(Continued)

(52) U.S. Cl.
CPC ..... *E21B 43/2405* (2013.01); *E21B 43/164* (2013.01); *E21B 43/24* (2013.01);
(Continued)

(58) Field of Classification Search
CPC .... E21B 43/164; E21B 43/24; E21B 43/2405; E21B 43/243; E21B 43/247; E21B 43/26
See application file for complete search history.

(56) References Cited

U.S. PATENT DOCUMENTS 4,400,209 A 8/1983 Kudo et al.
4,558,743 A 12/1985 Ryan et al.
(Continued)

FOREIGN PATENT DOCUMENTS

SU 1673780 A1 8/1991
WO 2010081239 A1 7/2010

OTHER PUBLICATIONS

International Search Report and Written Opinion for Application No. PCT/US16/16857 dated Apr. 19, 2016.
(Continued)

*Primary Examiner* — Caroline N Butcher
(74) *Attorney, Agent, or Firm* — Patterson + Sheridan, L.L.P.

(57) ABSTRACT

Methods and systems for stimulating light tight shale oil formations to recover hydrocarbons from the formations. One embodiment includes positioning a downhole burner in a first well, supplying a fuel, oxidizer, and water to the burner to form steam, injecting the steam and surplus oxygen into the shale reservoir to form a heated zone within the shale reservoir, wherein the surplus oxygen reacts with hydrocarbons in the reservoir to generate heat; wherein the heat from the reactions with the hydrocarbons and the steam increases permeability in a kerogen-rich portion of the shale reservoir, and producing hydrocarbons from the shale reservoir.

18 Claims, 38 Drawing Sheets

(51) Int. Cl.
*E21B 43/243* (2006.01)
*E21B 43/16* (2006.01)
*E21B 43/26* (2006.01)

(52) U.S. Cl.
CPC ..... *E21B 43/243* (2013.01); *E21B 43/247* (2013.01); *E21B 43/26* (2013.01)

(56) References Cited

U.S. PATENT DOCUMENTS

| | | | |
|---|---|---|---|
| 4,574,886 | A | 3/1986 | Hopkins et al. |
| 4,597,441 | A | 7/1986 | Ware et al. |
| 4,706,751 | A | 11/1987 | Gondouin |
| 4,805,698 | A | 2/1989 | Baugh |
| 6,016,868 | A | 1/2000 | Gregoli et al. |
| 7,093,655 | B2 | 8/2006 | Atkinson |
| 7,770,646 | B2 | 8/2010 | Klassen et al. |
| 8,091,625 | B2 | 1/2012 | Ware et al. |
| 8,091,636 | B2 | 1/2012 | Kuhlman |
| 8,333,239 | B2 | 12/2012 | Schneider |
| 2003/0173078 | A1 | 9/2003 | Wellington et al. |
| 2007/0039736 | A1 | 2/2007 | Kalman et al. |
| 2007/0193748 | A1 | 8/2007 | Ware et al. |
| 2008/0083536 | A1 | 4/2008 | Cavender et al. |
| 2008/0283241 | A1* | 11/2008 | Kaminsky ..... E21B 41/0064 166/245 |
| 2008/0289821 | A1 | 11/2008 | Betzer Tsilevich |
| 2010/0126727 | A1 | 5/2010 | Vinegar et al. |
| 2010/0181069 | A1 | 7/2010 | Schneider et al. |
| 2011/0036575 | A1 | 2/2011 | Cavender et al. |
| 2011/0127036 | A1 | 6/2011 | Tilmont et al. |
| 2011/0214858 | A1 | 9/2011 | Castrogiovanni et al. |
| 2011/0297374 | A1 | 12/2011 | Kuhlman et al. |
| 2012/0067573 | A1 | 3/2012 | Ware et al. |
| 2013/0180708 | A1* | 7/2013 | Ware ..... E21B 43/2406 166/246 |
| 2013/0284438 | A1* | 10/2013 | Dusseault ..... E21B 43/26 166/280.1 |

OTHER PUBLICATIONS

Canadian Office Action for Application No. 2,975,611 dated Apr. 13, 2018.

International Search Report dated Oct. 16, 2012 for PCT/US/2012/048688.

Search Report for the State Intellectual Property Office of the People's Republic of China dated May 25, 2016 for Application No. 2012800372554.

* cited by examiner

STIMULATION OF LIGHT TIGHT SHALE OIL FORMATIONS

BACKGROUND

Field of the Disclosure

Embodiments of the disclosure relate to stimulating light tight shale oil formations to recover hydrocarbons from the formations.

Description of the Related Art

A well drilled in a shale oil formation tends to have a high initial oil and gas production rate that declines rapidly. Due to the investment in subsurface construction and surface facilities, as soon as the production rate declines, the well is abandoned and another well is drilled. To maintain profitability, shale oil formations tend to have numerous wells that are drilled, hydraulically fractured, produced, and quickly abandoned after the decline in production rate. Efforts to stimulate depleted shale oil formations have not been successful. Therefore there is a need for methods and systems that can effectively stimulate shale oil formations.

SUMMARY

Embodiments of the disclosure include methods and apparatus for stimulating light tight shale oil formations to recover hydrocarbons from the formations.

One embodiment includes a method for producing hydrocarbons from a shale reservoir that includes positioning a downhole burner in a first well, supplying a fuel, oxidizer, and water to the burner to form steam, injecting the steam and surplus oxygen into the shale reservoir to form a heated zone within the shale reservoir, wherein the surplus oxygen reacts with hydrocarbons in the reservoir to generate heat; wherein the heat from the reactions with the hydrocarbons and the steam increases permeability in a kerogen-rich portion of the shale reservoir, and producing hydrocarbons from the shale reservoir.

Another embodiment includes a method for producing hydrocarbons from a shale reservoir which includes positioning a downhole burner in a first well, supplying a fuel, oxidizer, water to the burner to form steam, wherein the oxidizer is in a quantity that introduces surplus oxygen into the shale reservoir, injecting gases, steam and surplus oxygen into the shale reservoir to form a heated zone within the shale reservoir, micro-fracturing and/or increasing a porosity of the shale reservoir using the steam, gases and surplus oxygen by heating kerogen deposits within the shale reservoir, and producing hydrocarbons from the shale reservoir.

Another embodiment includes a method for producing hydrocarbons from a shale reservoir which includes positioning a downhole burner in a first well, supplying a fuel, oxidizer and water to the burner at a pressure of about 2,000 pounds per square inch to form steam and a heated zone within the shale reservoir, wherein the oxidizer is in a quantity that produces surplus oxygen in the shale reservoir, micro-fracturing the shale reservoir using the steam and surplus oxygen by heating kerogen deposits within the shale reservoir, wherein the micro-fracturing accelerates when the temperature of the shale reservoir reaches or exceeds about 550° F., and producing hydrocarbons from the shale reservoir.

Another embodiment includes a method for producing hydrocarbons from a shale reservoir which includes positioning a downhole burner in a first well, supplying a fuel, oxidizer, and water to the burner to form steam, injecting the steam and surplus oxygen into the shale reservoir to form a heated zone within the shale reservoir, wherein the surplus oxygen reacts with hydrocarbons in the reservoir to generate heat; wherein the heat from the reactions with the hydrocarbons and the steam increases permeability in a kerogen-rich portion of the shale reservoir, and producing hydrocarbons from the shale reservoir.

DRAWINGS

DETAILED DESCRIPTION

Shale oil formations generally contain light oil (e.g. oil that flows freely and has a low viscosity) and gas trapped in relatively low porosity and permeability ("tight") rock, commonly shale or tight siltstone, limestone, or dolomite, which resides at about 2,000 feet to about 3,000 feet or more, sometimes as deep as 10,000 feet, below the earth's surface. Shale oil formations may contain kerogen, which is a solid organic compound that can be converted into oil and gas. Shale oil formations have very limited storage capacity, which primarily resides in fractures within the formation. Examples of such shale oil formations in the United States include the Bakken Shale, the Eagle Ford, and the Barnett Shale.

Horizontal drilling and hydraulic fracturing are two technologies used to recover oil and gas from shale oil formations. Shale oil formations are often over-pressured, however, once depleted the bottom-hole pressure is reduced to a few hundred pounds per square inch. Stimulation of a depleted shale oil formation is difficult due to the tightness of the rock formation. The embodiments described herein are directed to effectively stimulate oil and gas formations, including depleted shale oil formations. The depleted shale oil formations referred to herein may include shale oil formations that are first produced and depleted by primary oil and gas production mechanisms, including hydraulic fracturing.

Figure 1:
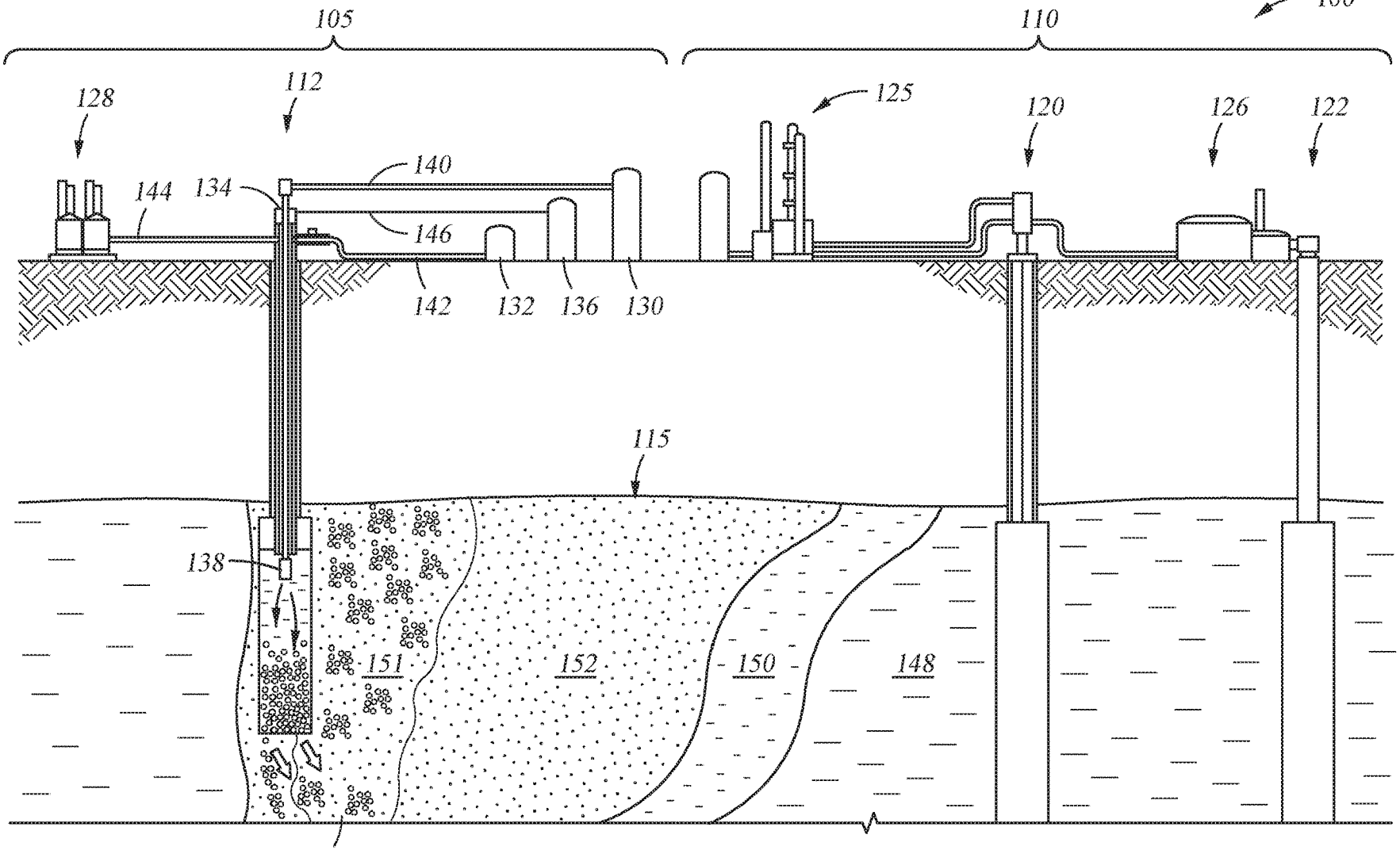
FIG. 1 is an elevation view of one embodiment of an enhanced oil recovery (EOR) system utilizing embodiments to recover light tight shale oil as described herein.

FIG. 1 is an elevation view of one embodiment of an enhanced oil recovery (EOR) system 100 utilizing embodiments to recover light tight shale oil as described herein. The EOR system 100 includes a first surface facility 105 and a second surface facility 110. The first surface facility 105 includes an injector well 112 that is in communication with a reservoir 115.

The reservoir 115 may be a shale oil formation that has recently been in production but production has declined such that the reservoir 115 is considered depleted. However, the reservoir 115 may still contain light oil and gas that may be produced using embodiments described herein.

The second surface facility 110 comprises a first producer well 120 and a second producer well 122 that is in fluid communication with the reservoir 115. The second surface facility 110 also includes associated production support systems, such as a treatment plant 125 and a storage facility 126. The first surface facility 105 may include a compressed gas source 128, a fuel source 130 and a steam precursor source 132 that are in selective fluid communication with a wellhead 134 of the injector well 112. The first surface facility 105 may also include a viscosity-reducing source 136 that is in selective communication with the wellhead 134. Additional wells (not shown), such as "infill" wells, may be drilled as needed to decrease average well spacing and/or increase the ultimate recovery from the reservoir 115. The additional wells may also be utilized to control pressure and/or temperature within the reservoir 115.

In use, the EOR system 100 may operate after the injector well 112 is drilled and a downhole burner or downhole steam generator 138 is positioned in the wellbore of the injector well 112 according to a completion process as is known in the art. Fuel is provided by the fuel source 130 to the downhole steam generator 138 by a conduit 140. Water is provided by the steam precursor source 132 to the downhole steam generator 138 by a conduit 142. An oxidant, such as air, enriched air (having about 35% oxygen), 95 percent pure oxygen, oxygen plus carbon dioxide, and/or oxygen plus other inert diluents may be provided from the compressed gas source 128 to the wellhead 134 by a conduit 144. The compressed gas source 128 may comprise an oxygen plant (e.g., one or more liquid $O_2$ tanks and a gasification apparatus) and one or more compressors.

The fuel source 130 and/or the steam precursor source 132 may be stand-alone storage tanks that are replenished on-demand during the EOR process. Gases or liquids that may be used as fuel include hydrogen, natural gas, syngas, or other suitable fuel gas. The viscosity-reducing source 136 may deliver injectants, such as viscosity reducing gases (e.g., $N_2$, $CO_2$, $O_2$, $H_2$), particles (e.g., nanoparticles, microbes) as well as other liquids or gases (e.g., corrosion inhibiting fluids) to the downhole steam generator 138 through the wellhead 134 through a conduit 146. The viscosity-reducing source 136 may be an import pipeline and/or a stand-alone storage tank(s) that are replenished on-demand during the EOR process.

FIG. 1 also shows one embodiment of an EOR process. Starting from the side of the reservoir 115 adjacent the producer wells 120 and 122, zone 148 includes a volume of mobilized, low viscosity hydrocarbons. The low viscosity hydrocarbons are a result of viscosity-reducing gases in zone 150 and a high-quality steam front within zone 152 that converts kerogen deposits 151 into oil and gas that may be recovered. Zone 150 comprises a volume of gas, such as $N_2$, $O_2$, $H_2$ and/or $CO_2$, in one embodiment, which mixes with the oil that is heated by steam from zone 152. The steam front within zone 152 consists of high quality steam (e.g., up to 80 percent quality, or greater) and includes temperatures of about 100 degrees Celsius (C) to about 300 degrees C., or greater. Adjacent the steam front is zone 154, which comprises a residual oil oxidation front. Zone 154 comprises heated kerogen and excess oxygen.

Figure 2:
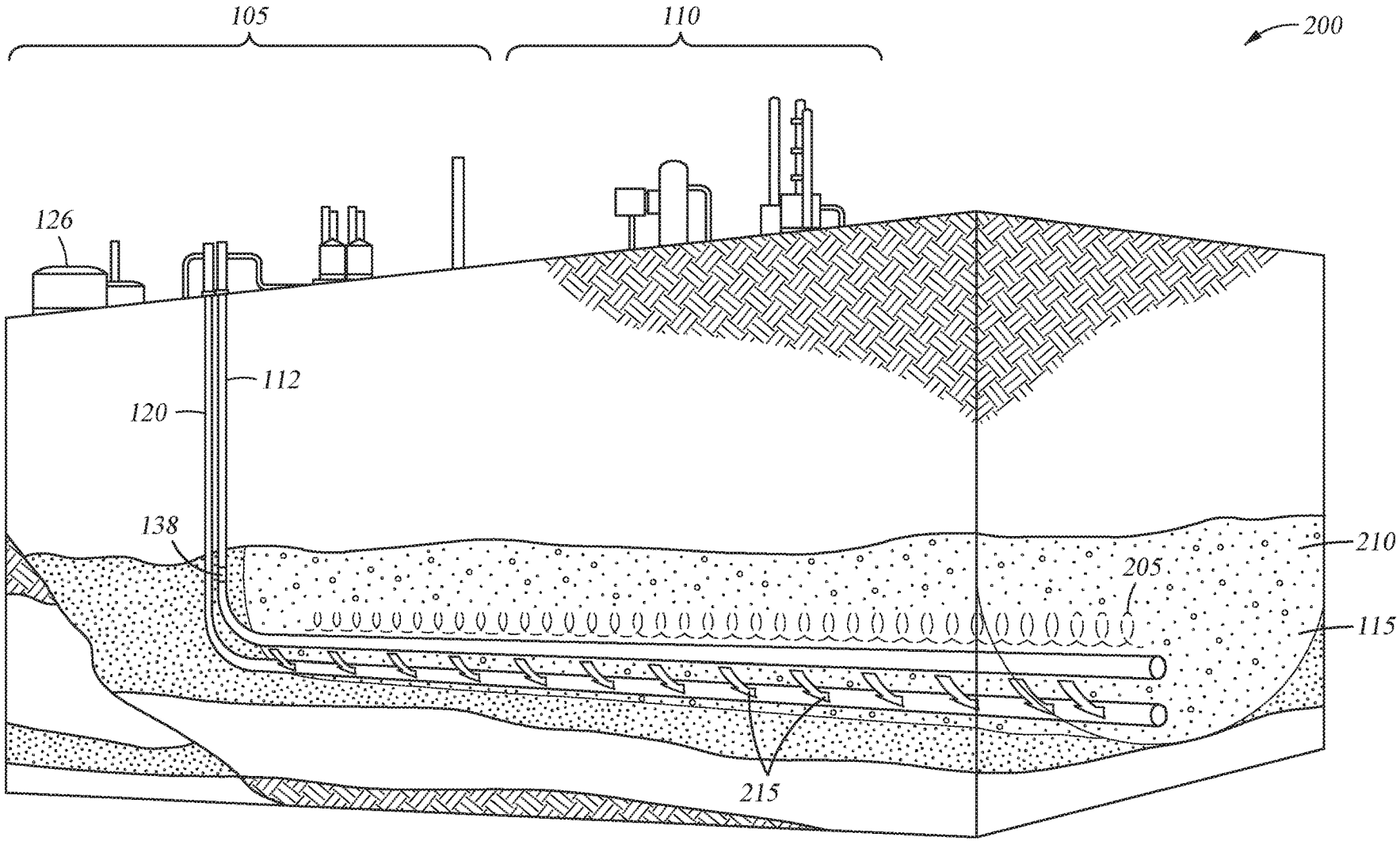
FIG. 2 is an isometric elevation view of another EOR system utilizing embodiments to recover light tight shale oil as described herein.

FIG. 2 is an isometric elevation view of another EOR system 200 utilizing embodiments as described herein. The EOR system 200 may comprise a steam assisted gravity drainage (SAGD) system and includes the first surface facility 105 as well as the second surface facility 110. The first surface facility 105 and the second surface facility 110 may be similar to the embodiment shown in FIG. 1 although in a different layout. The EOR system 200 also includes an injector well 112 that is in communication with a reservoir 115 and a first producer well 120 that is in communication with the reservoir 115. The injector well 112 and the producer well 120 each have a wellbore with a horizontal orientation and horizontal portion of the producer well 120 is disposed below the injector well 112. The systems and subsystems of the first surface facility 105 and the second surface facility 110 of FIG. 1 may operate similarly and will not be described for brevity.

In use, the EOR system 100 may operate after the injector well 112 is drilled and the downhole steam generator 138 is positioned in the wellbore of the injector well 112 according to known completion processes. Fuel, water and an oxidant are provided to the downhole steam generator 138 from sources/conduits as described in reference to the EOR system 100 of FIG. 1 in order to produce a steam front 205 in the reservoir 115. Likewise, viscosity-reducing gases and/or particles may be provided to the downhole steam generator 138. The viscosity-reducing gases and/or particles may be interspersed in the reservoir 115 (shown as shaded region 210) along with the steam front 205. The viscosity-reducing gases and/or particles reduce the viscosity in the hydrocarbons and the steam front 205 heats the reservoir 115 to enable mobilized oil 215 to be recovered by the producer well 120. Additional wells (not shown), such as "infill" wells, may be drilled as needed.

In one embodiment of an EOR process, a stimulation cycle is performed using a downhole steam generator that is lowered into a well having a substantially vertical section and substantially horizontal section drilled into a depleted shale oil formation. For the subsequent production cycle, a production string can then be hung in the vertical section before the well becomes completely horizontal. The downhole steam generator injects one or more of fuel, water, steam, air, carbon dioxide, and other inert gases into the depleted shale oil formation to re-pressurize the formation, including the fractures within the formation that communicate with the well.

Injectivity of the heated fluids may fall off gradually as the fractures fill up and then can be reduced drastically when injected gases start to communicate with the formation. The downhole steam generator is configured to accommodate falling injection rates and increased pressure, and can be operated intermittently as to let pressurized fractures diffuse the injected hot fluids into the formation. Subsequently, in some embodiments, the formation can be allowed to "soak" for some time until heat and gases dissipate from the fractures into the formation. After the soak, the well can then be brought to production to recover hydrocarbons from the formation, and will be produced until a new stimulation cycle can be repeated.

Some examples of the various mechanisms that will enhance oil and gas recovery from the depleted shale oil formation using the embodiments described herein are: a solution of carbon dioxide and gases injected into the oil in the formation, swelling and solution drive, re-pressurizing of the formation, heat expansion of fluids, reduction of capillary forces, decrease of residual oil saturation, fracture re-activation from thermal stresses and by distributing settled stresses caused by the fracture re-pressurization, and oil generation from organic material, such as kerogen, in the formation.

In one embodiment, steam flooding can be used to stimulate hydrocarbon recovery from formations in mature oil fields at the shallow periphery, or compartments that were not impacted by water flooding, and still exhibit pressure depletion from primary operations. The objective may be to extract oil from these formations while funneling excess carbon dioxide into other mature, less-depleted primary formations with commonly used carbon dioxide injection techniques. The same gas processing plant could possibly serve both project areas, the depleted and the primary formations.

In one embodiment, a downhole steam generator is configured to inject hot fluids in light oil fields with different lithologies for light oil extraction using the heat of the injected fluids to enhance oil recovery. Steaming of light oil reduces the surface tension and the oil saturation by the heat expansion of the light oil and associated gases. The downhole steam generator is an advantage over conventional surface steam generators because it can inject steam and other gases in deep reservoirs with higher pressures and low permeability.

In one embodiment, the downhole steam generator would be in a vertical or horizontal well configuration and would inject one or more of fuel, steam, oxygen, carbon dioxide, and water at a back pressure up to 2,000 psi. Carbon dioxide could be injected in the beginning, and can be recycled and/or produced en mass by a gas plant facility. Excess oxygen can be used to oxidize hydrocarbons within the formation.

In one embodiment, steam, carbon dioxide, and/or inert gases are injected into a depleted shale oil formation to re-pressurize and/or heat the formation. Simultaneously or subsequently, such as when the formation reaches a predetermined temperature (e.g. pyrolysis level temperatures), excess oxygen is injected into the formation, causing residual oil oxidation ("ROX") and thereby creating a steam and oxygen front. The steam, carbon dioxide, inert gases, and/or excess oxygen can be injected into the formation for a few years, followed by hydrocarbon production, and then followed by simultaneous or alternating injection of carbon dioxide and water for about ten years or more to produce even more oil. The purity of the water injected into the formation can be controlled at the surface and/or with the downhole steam generator, and can be changed depending on the formation characteristics.

Injection of the steam, carbon dioxide, inert gases, and/or excess oxygen by a downhole steam generator can use flow paths defined by the hydraulic fractures emanating from two adjacent primary production wells, as well as the natural fractures between the farthest extent of these induced hydraulic fractures. One primary production well is converted to and used as an injector well, while the other remains a production well. As ROX is initiated, the temperature of the formation is further increased, which can thermally induce microfracturing along the advancing steam and oxygen front.

A microfracture may require a magnification greater than 10× to detect. As these micro-fractures grow, they will connect with the already existing natural and hydraulic fractures. The result is a growing "enhanced permeability path" that will allow higher injection rates, accelerated production, and increased recovery efficiency.

In one embodiment, stimulating a depleted shale oil formation using the embodiments described herein can create (pressure and/or thermally induced) micro-fractures within the formation. The direction of the micro-fractures can be controlled and/or influenced by the injection of heated fluids via a downhole steam generator. The injection of heated fluids can be controlled by the downhole steam generator to control the temperature and/or pressure of the formation.

In one example, micro-fractures can be formed by oil and gas expulsion in shale formations, which provide enhanced permeability pathways for oil and gas flow into wells that have been hydraulically fractured.

In another example, oil generation created by heating of the formation, such as by thermal decomposition of solid kerogen into fluid hydrocarbons, causes the volume within the formation to increase and thus create locally high pressure. This localized high pressure creates pressure induced fractures and/or micro-fractures in the shale oil formation that can enhance permeability of the formation. Specifically, as temperatures and pressures increase, kerogen breaks down to release oil and gas, which results in an increase in volume due to the density difference between the solid kerogen and the fluid hydrocarbons. The volume increase is trapped within the tight rock formation, thereby creating a pressure build up within the formation. When the pressure build up exceeds the mechanical strength of the tight rock formation, micro-fractures are formed and create a migration pathway for the converted fluid hydrocarbons to flow.

In addition, as the temperature of the formation is increased, the oil within the formation can be subjected to thermal cracking to form gas, which further increases the volume within the formation and thus the pressure. Additional micro-fractures can be formed and may coalesce with other fractures within the formation to form a fracture network that functions as an enhanced permeability pathway for the migration of hydrocarbons for recovery.

In another example, thermally induced micro-fractures can be created by heating the formation, such as by initiating a FOX process and generating a steam and oxygen front across the formation.

In one embodiment, steam, carbon dioxide, excess oxygen, and/or other inert gases can be injected into a depleted shale oil formation at one pressure for a period of time through a first well, which could previously have been a production well during primary production of the formation. The formation can be re-pressurized back up to 2,000 psi. Then carbon dioxide and water, simultaneously or alternately, can be injected into the formation at a higher pressure for another period of time through the same or a different well. This can further increase the formation pressure up to 3,500 psi. Surplus carbon dioxide production can be recycled and used in a subsequent carbon dioxide injection phase. A huff and puff process using a single well, or a drive process using a pair of wells located side by side can be used to stimulate the formation. The spacing between the wells may be less than one quarter of a mile, such as about 1,000 feet or less, for example, about 660 feet.

In one embodiment, a drive process can be established in a depleted shale oil formation by drilling an open hole bilateral well parallel to the original hydro-fractured well at about a 134-300 feet offset. This open hole well can be the production well, while the original hydro-fractured well can be the injection well in which a downhole steam generator is positioned. A fireflood-like thermal front can be created across the formation from injection well to the production well.

In one embodiment, the depleted shale oil formation may exhibit a 0.5+ psi per foot frac gradient or a 0.6+ psi per foot frac gradient at the front edge of the injection front. Injection of steam and other components at this pressure may cause continued fracturing along the front edge of the injection front. In one embodiment, the depleted shale oil formation may be at depths between about 2,000 feet and about 3,300 feet, with a formation pressure of about 2,000 psi at 0.6 psi per foot gradient. In one embodiment, the depleted shale oil formation may be at depths between about 2,000 feet and about 5,300 feet, with a formation pressure of about 3,134 psi at 0.6 psi per foot gradient.

Figure 3:
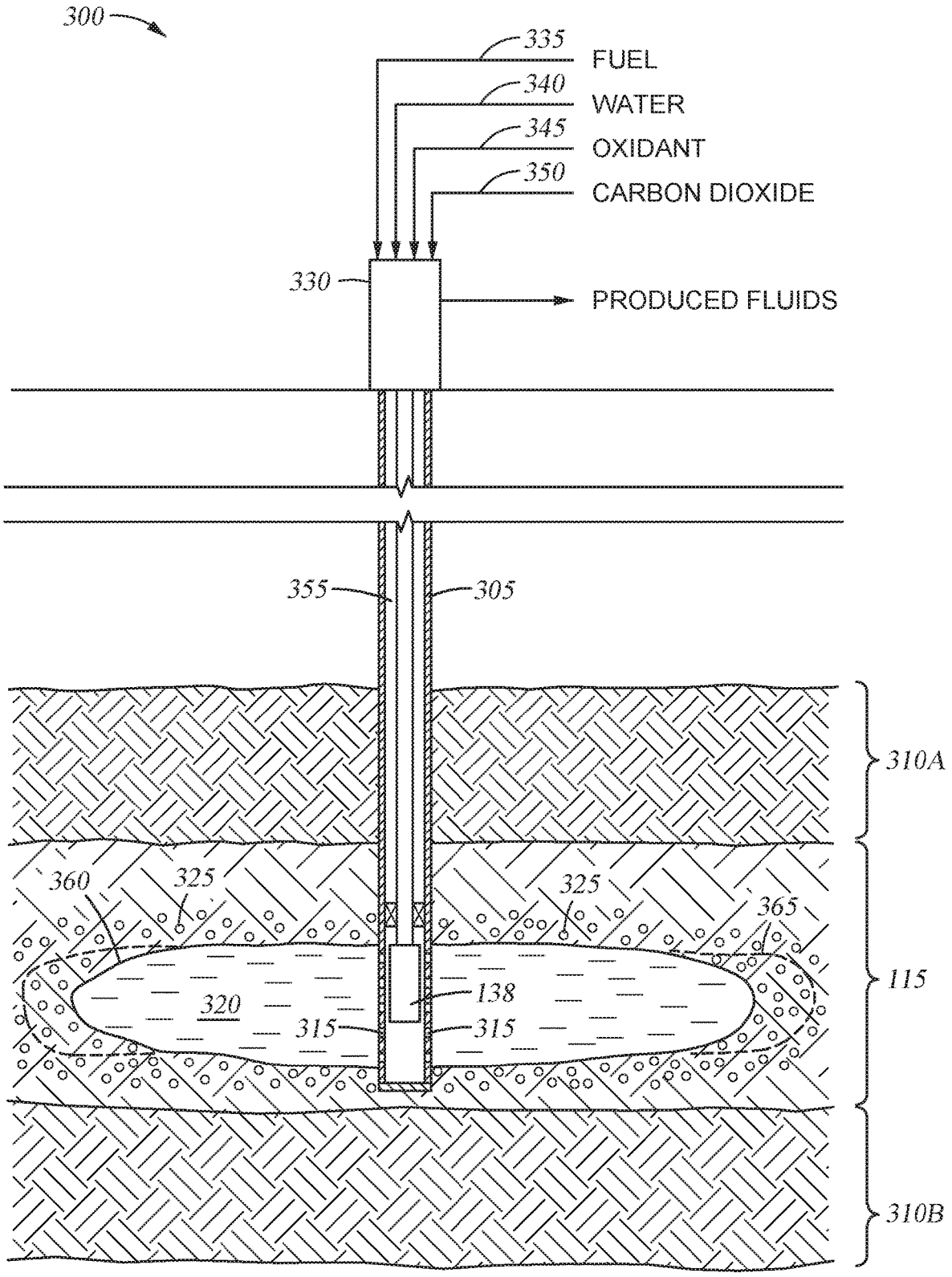
FIG. 3 is an elevation view of another embodiment of an EOR system utilizing embodiments to recover light tight shale oil as described herein.

FIG. 3 is an elevation view of another embodiment of an EOR system 300 utilizing embodiments to recover light tight shale oil as described herein. The EOR system 300 includes a well 305 that extends substantially vertically through a number of earth formations, at least one of which includes a reservoir 115 which may be a depleted shale oil formation. An overburden earth formation 310A is located above the reservoir 115. An under-burden formation 310B, which may be below the reservoir 115, may be a thick, dense limestone or some other type of earth formation.

As shown in FIG. 3, the well 305 is cased, and the casing has perforations or slots 315 in at least part of the reservoir 115. Also, the well 305 may be fractured according to embodiments described herein to create a fractured zone 320. During fracturing, an operator injects a fluid through perforations 315 and imparts a pressure against the reservoir 115 that is greater than the parting pressure of the formation. The pressure creates cracks or micro-fractures within the reservoir 115 that extend generally radially from well 305, allowing flow of the fluid into fractured zone 320. The injected fluid used to cause the fracturing may be steam, water and/or carbon dioxide, which may include, various additives and/or proppant materials such as sand or ceramic beads, or steam itself, can sometimes be used.

To initiate the fracturing, one or a combination of steam, carbon dioxide and excess oxygen may be used to pyrolize kerogen formations 325 within the reservoir 115. "Pyrolize" or "pyrolysis" may be defined as a thermochemical decomposition of organic material within the reservoir 115. "Kerogen" is a naturally occurring solid organic material that occurs in source rocks and can yield hydrocarbons upon heating.

A production tree or wellhead 330 is located at the surface of well 305 in FIG. 3. Wellhead 330 is connected to a conduit or conduits for directing fuel 335, steam 340, oxidant 345, and carbon dioxide 350 down well 305 to downhole steam generator 138. The downhole steam generator 138 is secured in well 305 for receiving the flow of fuel 335, water 340, oxidant 345, and carbon dioxide 350. The downhole steam generator 138 has a casing with a diameter selected so that it can be installed within conventional well casing, typically ranging from around seven to nine inches, but it could be larger. The fuel 335 may be hydrogen, methane, syngas, or some other hydrocarbon-based fuel. The fuel 335 may be a gas or liquid. The wellhead 330 is also connected to a conduit for delivering the oxidant down well 305. The fuel 335 and water 340 may be mixed and delivered down the same conduit, but fuel 335 should be delivered separately from the conduit that delivers oxidant 345.

Because carbon dioxide 350 is corrosive if mixed with steam, it flows down a conduit separate from the conduit for water 340. Carbon dioxide 350 could be mixed with fuel 335 if the fuel is delivered by a separate conduit from water 340. The percentage of carbon dioxide 350 mixed with fuel 335 should not be so high so as to significantly impede the burning of the fuel. If the fuel is syngas, methane or another hydrocarbon, the burning process in downhole steam generator 138 creates surplus carbon dioxide. In some instances, the amount of carbon dioxide created by the burning process may be sufficient to eliminate the need for pumping additional carbon dioxide down the well.

The conduits for fuel 335, water 340, oxidant 345, and carbon dioxide 350 may comprise coiled tubing or threaded joints of production tubing. The conduit for carbon dioxide 350 could comprise an annulus 355 in the casing of well 305. For example, the annulus 355 is typically defined as the volumetric space located between the inner wall of the casing or production tubing and the exteriors of the other conduits. The carbon dioxide may be delivered to the burner by pumping it directly through the annulus 355.

Figure 4:
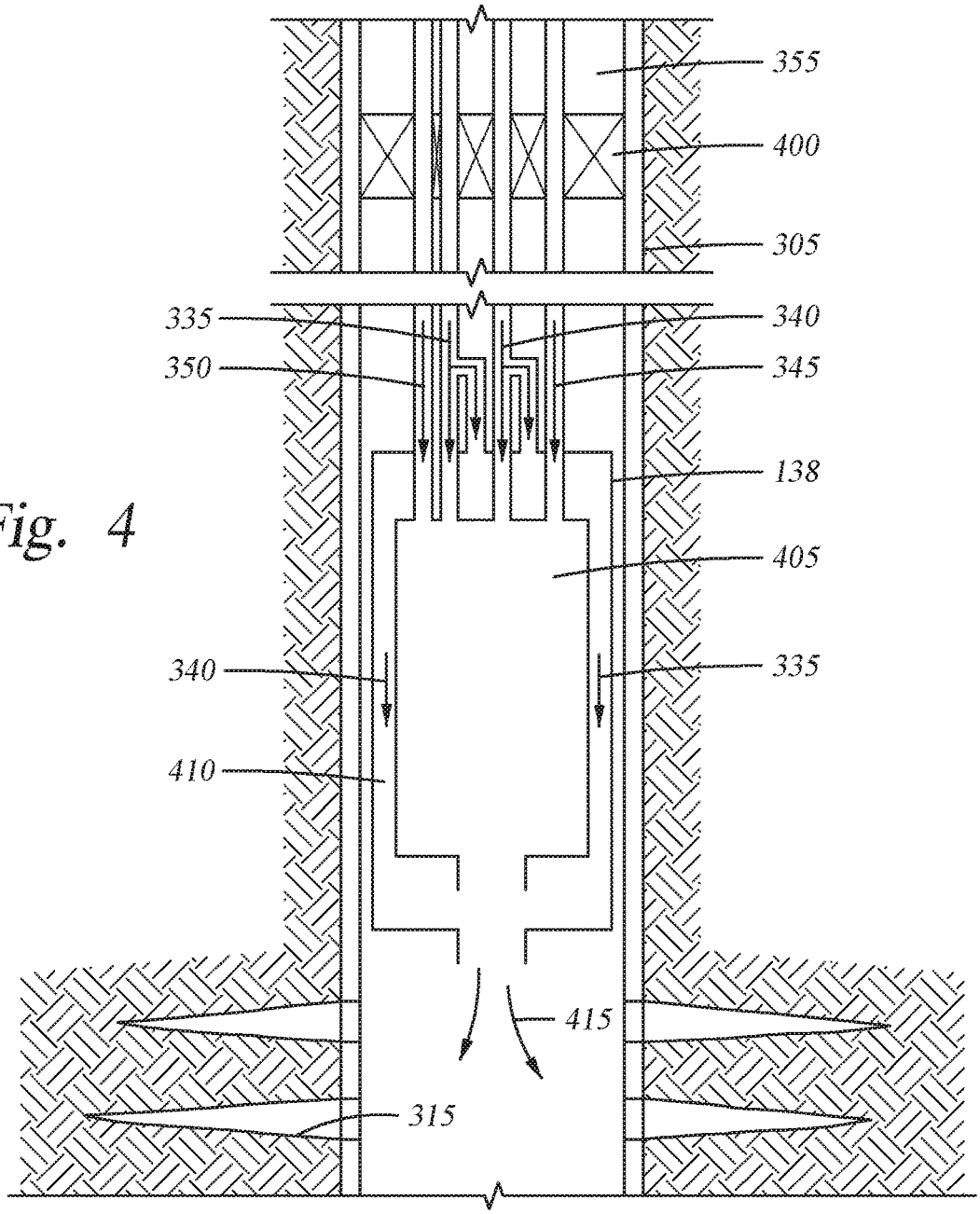
FIG. 4 is an enlarged cross-sectional view of the downhole steam generator in the well of FIG. 3.

As illustrated in FIG. 4, a packer and anchor device 400 is located above downhole steam generator 138 for sealing the casing of well 305 above packer 400 from the casing below packer 400. The conduits for fuel 335, water 340, oxidant 345, and carbon dioxide 350 extend sealingly through packer 400. Packer 400 thus isolates pressure surrounding downhole steam generator 138 from any pressure in well 305 above packer 400. The downhole steam generator 138 has a combustion chamber 405 surrounded by a jacket 410, which may be considered to be a part of downhole steam generator 138. Fuel 335 and oxidant 345 enter combustion chamber 405 for burning the fuel. Water 340 may also flow into combustion chamber 405 to cool downhole steam generator 138. Preferably, carbon dioxide 350 flows through jacket 410, which assists in cooling combustion chamber 405, but it could alternatively flow through combustion chamber 405, which also cools chamber 405 because carbon dioxide does not burn. If fuel 335 is hydrogen, some of the hydrogen can be diverted to flow through jacket 410. Water 340 could flow through jacket 410, but may not be mixed with carbon dioxide 350 because of the corrosive effect. The downhole steam generator 138 ignites and burns at least part of fuel 335, which creates a high temperature in downhole steam generator 138. Without a coolant, the temperature would likely be too high for downhole steam generator 138 to withstand steam generation over a long period. The water 340 flowing into combustion chamber 405 may reduce that temperature. Also, there may be a small excess of fuel 335 flowing into combustion chamber 405. The excess fuel does not burn, which lowers the temperature in combustion chamber 405 because fuel 335 does not release heat unless it burns. The excess fuel becomes hotter as it passes unburned through combustion chamber 405, which removes some of the heat from combustion chamber 405. Further, carbon dioxide 350 flowing through jacket 410 and any hydrogen that may be flowing through jacket 410 may cool combustion chamber 405.

Water 340, excess portions of fuel 335, and carbon dioxide 350 lower the temperature within combustion chamber 405, for example, to around 1,600 degrees F., which increases the temperature of the partially-saturated steam flowing through burner 29 to a superheated level. Superheated steam is at a temperature above its dew point, thus contains no water vapor. The gaseous product 415, which comprises superheated steam, excess fuel, carbon dioxide, and other products of combustion, exits burner 29 preferably at a temperature from about 550 to 700 degrees F.

If fuel 335 comprises hydrogen, the hydrogen being injected could come entirely from excess hydrogen supplied to combustion chamber 405, which does not burn, or it could be hydrogen diverted to flow through jacket 410. However, hydrogen does not dissolve as well in oil as carbon dioxide does. Carbon dioxide, on the other hand, is very soluble in oil and thus dissolves in the oil, reducing the viscosity of the hydrocarbon and increasing solution gas. Elevating the temperature of carbon dioxide 350 as it passes through downhole steam generator 138 delivers heat to the reservoir 115, which lowers the viscosity of the hydrocarbon it contacts. Also, the injected carbon dioxide 350 adds to the solution gas within the reservoir. Maintaining a high injection temperature for a hot gaseous product 415, at about 700 degrees Fahrenheit (F), or less, such as about 550 degrees F., enhances pyrolysis of kerogen. Additionally, the heat enables hydrovisbreaking if hydrogen is present, which causes an increase in API gravity of any heavy oil in situ.

The hot, gaseous product 415 is injected into fractured zone 320 due to the pressure being applied to the fuel 335, water 340, oxidant 345 and carbon dioxide 350 at the surface. The fractures within fractured zone 320 increase the surface contact area for these fluids to heat the formation and convert kerogen deposits into oil and/or lowers the viscosity of the oil and may also create solution gas to help drive the oil back to the well during the production cycle.

Figure 5:
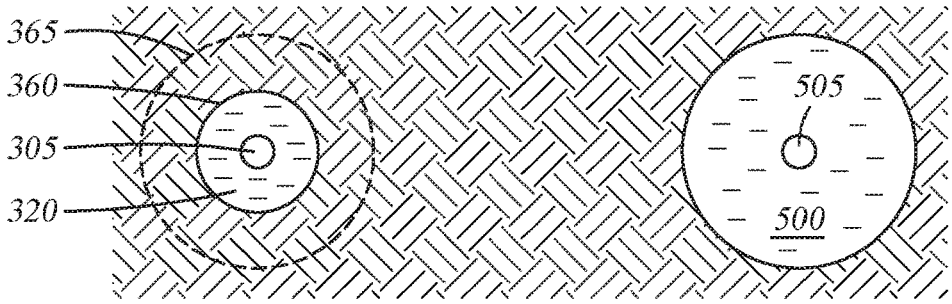
FIG. 5 is a schematic illustrating the well of FIG. 3 next to an adjacent well.

FIG. 5 is a schematic illustrating the well of FIG. 3 next to an adjacent well, which may also be produced in accordance with the embodiments as disclosed herein. As shown in FIGS. 3 and 5, in one embodiment of the invention, the operator controls the rate of injection of the fracturing fluids and the duration of the fracturing process to limit the extent or dimension of a fractured zone 320 surrounding well 305. The fractured zone 320 has a relatively small initial diameter or perimeter 360. The perimeter 360 of fractured zone 320 is limited such that it will not intersect any existing or planned fractured or drainage zones 500 (FIG. 5) of adjacent wells 505 that extend into the same reservoir 115. Further, in the preferred method, the operator will later enlarge fractured zone 320 well 305, thus the initial perimeter 360 should leave room for a later expansion of fractured zone 320 without intersecting drainage zone 500 of adjacent well 505. Adjacent well 505 optionally may previously have undergone one or more of the same fracturing processes as well 305, or the operator may plan to fracture adjacent well 505 in the same manner as well 305 in the future. Consequently, fractured zone perimeter 360 does not intersect fractured zone 500. Preferably, fractured zone perimeter 360 extends to less than half the distance between wells 305, 505. Fractured zone 320 is bound by unfractured portions of the reservoir 115 outside perimeter 360 and both above and below fractured zone 320. The fracturing process to create fractured zone 320 may be done either before or after installation of a downhole burner 138, discussed below. If after, the fracturing fluid will be pumped through burner 138.

The reference numeral 365 in FIGS. 3 and 5 indicates the perimeter of fractured zone 320 after a second or subsequent fracturing process. The operator could be performing similar fracturing, injection, soaking and production cycles on well 505 at the same time as on well 305, if desired. The cycles of injection and production, either without or without additional fracturing may be repeated as long as feasible.

Before or after reaching the maximum limit of fractured zone 320, which would be greater than perimeter 365, the operator may wish to convert well 305 to a continuously-driven system. This conversion might occur after well 305 has been fractured several different times, each increasing the dimension of the perimeter. In a continuously-driven system, well 305 would be either a continuous producer or a continuous injector. If well 305 is a continuous injector, downhole burner 138 would be continuously supplied with fuel 335, steam 340, oxidant 345, and carbon dioxide 350, which burns the fuel and injects hot gaseous product 415 into fractured zone 320. The hot gaseous product 415 would force the oil to surrounding production wells, such as in an inverted five or seven-spot well pattern. Each of the surrounding production wells would have fractured zones that intersected the fractured zone 320 of the injection well. If well 305 is a continuous producer, fuel 335, steam 340, oxidant 345, and carbon dioxide 350 would be pumped to downhole burners 138 in surrounding injection wells, as in a normal five- or seven-spot pattern. The downhole burners 138 in the surrounding injection wells would burn the fuel and inject hot gaseous product 415 into the fractured zones, each of which joined the fractured zone of the producing well so as to force the oil to the producing well.

In one embodiment, an EOR process to stimulate light oil in a shale reservoir is as follows. In a first portion of a first recovery period, a primary producer well P1 is drilled into the shale reservoir and hydrocarbons are produced conventionally. The first portion may be about 1-2 years (time periods are approximate and will vary with individual reservoir characteristics). On or about year 3, in a second portion of the first recovery period, an injector well I1 is drilled into the shale reservoir and hydrocarbons are produced at the primary producer well P1 using the injector well I1 with conventional production techniques. The injector well I1 may be drilled about 800 feet, or less, laterally from the primary producer well P1. The second portion of the first recovery period may be about 4-12 years.

During the second portion of the first recovery period, the pressure within the shale reservoir decreases, and the rate of pressure depletion of the primary producer well P1 may be accelerated due to the pressure depletion of the injector well I1. The pressure of the shale reservoir may decrease to about 2,000 psi, or less, such as between about 2,000 psi to about 500 psi, for example about 1,000 psi to about 1,800 psi. At some point during the second portion of the first recovery period, production of hydrocarbons from the shale reservoir declines to a point where it is not profitable to continue, and the shale reservoir is abandoned.

After the second portion of the first recovery period, an EOR process as described herein is initiated in a first portion of a second recovery period. The first portion may be about 1-3 years. The process includes steam injection from a downhole burner using the injector well I1. The fuel and oxidant can be at about stoichiometric proportions. However, excess oxygen at about 0.25% mole fraction to about 0.5% mole fraction may be provided to the downhole burner to ensure complete combustion. A mole fraction of 5% or more excess oxygen may sometimes be utilized. Surplus oxygen may react with bypassed hydrocarbons in the reservoir which will combust and result in more heat delivered to the reservoir. The shale reservoir may be at the depletion pressure when the EOR steam is injected therein. Pressure within the shale reservoir will gradually build due to the injection of steam. Depending on the injection rate of the steam, pressure after steam injection has begun will quickly reach about 2,000 psi to about 2,400 psi, or greater. The initial steam injection rate should be kept as high as possible (could be up to 2,400 barrels per day (bpd), or even greater depending on the well configuration, e.g., lateral length, etc.). The benefit of a high injection rate is due to the dilation of the pores and the induced and natural fractures in the reservoir, which enhances porosity and permeability of the shale reservoir. Additionally, ultimate recovery of hydrocarbons will be enhanced with a high initial injection rate of steam. In addition, the temperature of the shale reservoir increases due the hot steam and any combustion of hydrocarbons within the shale reservoir that is oxidized by the excess oxygen released from the downhole burner.

The process of oil and gas synthesis from organic matter (kerogen) was initiated due to burial depth (pressure+temperature) at some point in the geologic past but due to uplift, erosion of the overburden above it, etc., the process was stalled. Heat greatly increases the speed of the reaction, so when the steam heats the kerogen the process is effectively restarted (or at least, accelerated to a practical time-scale). Heating of the reservoir, as well as increased pressure from the steam, may fracture the shale reservoir. Fracturing occurs by one or more of the following mechanisms: phase transitions; thermal expansion; heterogeneous heating of the shale reservoir; and fluid expansion from thermal conduction of fluid in pores.

Phase transition of fluids (gas and oil) in the rock will increase pressure in the constant volume pores, which may crack adjacent formations (specific volume of the gas phase is about 800× that of the liquid phase); both the gas and oil will have a specific volume greater than solid kerogen. Thermal expansion of fluids in the rock will increase pressure in the constant volume pores, which may crack adjacent formations. Heat from the steam heats the cold rock, and heterogeneous heating results in thermal stresses on the rock which can also cause cracking. Fluid expansion in the closed pores of the rock may cause local cracking (whether from kerogen conversion or from simple thermal expansion of already converted oil), with the alternative of dilation of either an open pore, or a fracture system which is not closed. Thermal conduction of the fluids also causes pore dilation that may occur without pyrolysis because the fluids in the pores expand when heated. There are many other types of micro-fracturing which can resemble dilation, i.e., a pressure increase and expanded pore caused by an injected fluid.

After the first portion of the second recovery period, a second portion of the second recovery period may begin. The second portion may include a time period of about 1-6 years; or greater. The second portion may begin after the shale reservoir develops a resistance to fluid injection (steam) in the first portion of the second recovery period. Additionally, when steam is injected at pressures of about 3,000 psi, the steam has poor thermodynamics (less enthalpy than 2,000 psi steam due to less latent heat of vaporization).

The second portion includes ceasing steam injection and injecting high pressure fluids into the shale reservoir. The fluids may be $CO_2$ and water that is simultaneously or alternatively injected into the primary producer well P1 and/or the injector well I1. The $CO_2$ and water may be injected at pressures greater than the steam injection pressures. The $CO_2$ and water may be injected at 3,000 psi, or greater. The rate of injection of the $CO_2$ and water is not as critical as the initial rate of injection of steam. A lesser injection rate of $CO_2$ and water stretches production out further into the future but doesn't significantly impact ultimate recovery.

In one embodiment, a process sequence may be performed as follows. First, primary production during a first recovery period depletes the reservoir pressure so embodiments of the steam injection may be performed. For example, the reservoir must first be depressurized by primary production to a pressure point sufficiently low for the subsequent process to function. The reservoir needs to allow for sufficient voidage in order to initiate injection of extraneous fluids, and/or needs to have low enough pressure for steamflooding to work, etc.

When steam injection begins at a reservoir pressure of about 1,000 psi (depletion pressure), the steam may be injected at stoichiometric ratios (e.g., 0.25-0.5% excess $O_2$) at a pressure of about 2,000 psi, or greater. For example, steam injected with surplus oxygen provided to the reservoir may attain a reservoir pressure of about 2,000 psi, or greater.

After the steam injection during the second recovery period, a high pressure $CO_2$/water alternating gas (WAG) process is initiated with injection pressures of about 3,000 psi, or greater (higher pressure is better). $CO_2$/WAG provides an effective follow on stage because $CO_2$/WAG can control mobility, which can minimize $CO_2$ breakthrough. WAG can mean variously injecting all water, injecting all $CO_2$, or injecting some mixture of the two. All three options can be injected for varying time intervals with respect to one another.

In some embodiments, the drilling of infill wells may be utilized to achieve close lateral spacing that allows sufficient reservoir heating, and hence porosity and permeability development, to then allow the overall process to function.

Micro fracturing may be produced by the steam injection due to one or more of the following processes: expansion of already converted oil which is still trapped in closed pores (local pressure effect), significant expansion of trapped kerogen when it pyrolyzes from a solid to oil and gas (local pressure effect), and differential heating of the reservoir rock matrix itself, which causes local stresses in the formation (mechanical effect).

Development Scheme

In one embodiment, a development scheme utilizes original 160 acre primary production wells with one quarter mile lateral spacing as the LTSO EOR producers. A second set of 80 acre infill wells may be drilled and used first, a) as further primary producers to pressure deplete the remainder of the formation, and then b) to act as injectors for LTSO EOR.

Infill drilling may be provided in both directions from two back to back eight well count pads located at the boundary between two adjacent 6,350 acre sections. This allows sharing of injection and production facilities for eight 160 acre patterns having one injector and one producer each, operating in a drive mode. Two more original producers may be used as guard wells (18 wells total).

Some of the original primary producers may, by default, be located away from the new pads, so hot gathering lines will be required for say about ½ of the original producers; everything else can be located at the new pads.

In one embodiment, the process for the initial steam injection stage of LTSO EOR uses hydrogen and oxygen with steamflooding, i.e. a ROX operation using a drive well with oxygen rich (air separation unit) oxidizer product, and $CO_2$ recovery and recycle. Feedwater treating, gas handling and compression, oil treating, etc., may be provided, as needed. One embodiment includes two SAGD pairs with a drive well located between the pairs.

In one embodiment, two SAGD pairs may be utilized to start up in parallel, with a steam demand of 3000 barrels per day (b/d) and with 0.25% surplus oxygen. Then; a phased shut down may be performed while transitioning to operation of a single drive well with steam at 1500 b/d and 5.0% surplus oxygen. In some embodiments, the process includes steam may be provided at about 3,000 b/d and/or up to about 80 tons per day of oxygen rich $O_2$.

However, in some embodiments, the steam injection process uses only 1.5 to 2.5% surplus $O_2$, and up to three time-sequenced injector wells can be operated simultaneously from one location.

Figure 24:
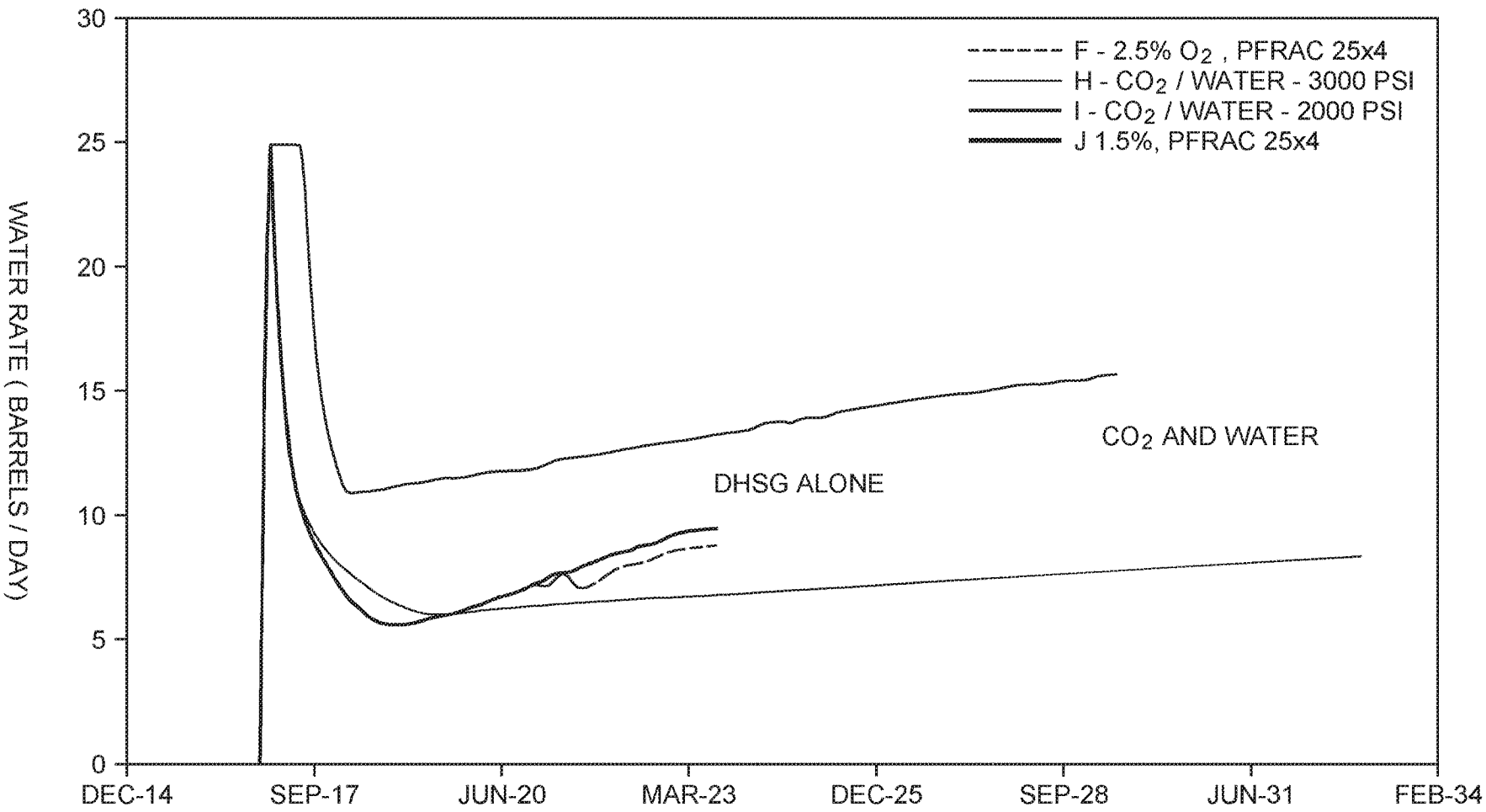
FIG. 24 is a graph showing water injection rates for several downhole steam generator and $CO_2$/water and simulations.

Referring to FIG. 24 below, the first three year steam demand of a typical injector is shown. The Figure shows a demand for Year 1 of an average of 1300 b/d, for Year 2 of 600 b/d and for Year 3 of another 600 b/d. For an eight injector location, with facilities sized roughly as shown in FIGS. 1 and 2, one can start up one LTSO EOR injector per year. With a three year life, there will never be more than three injectors in service at any given time, according to this embodiment.

The process described immediately above may be termed an ACIS/ROX (Advanced Combustion and Injection System)/(Residual Oxidation) process, which may be defined as a downhole system capable of controlling and injecting from the surface into a subsurface target some combination of fuel, oxidizer, and water, and optionally other non-reacting fluids and/or catalytic media, all of which flow to a subsurface tool capable of managing combustion, mixing and vaporization, and which tool effluent therefrom is then injected into a geologic layer for the purpose of enhancing recovery from a petroleum or other mineral deposit. By optional methods, the system may be controlled so that a surplus quantity of the oxidizer is contained in the effluent stream leaving the subsurface tool, which then enters the target deposit where, by prior temperature and pressure management of the deposit, in situ oxidization of hydrocarbon or other fuels in the deposit is enabled for the purpose of providing additional heat release and vaporization within the deposit, for the purpose of further enhancing recovery.

Table 1 shows the total steam injection for the back to back pads at the location (years are approximate).

TABLE 1

| Year | Total b/d |
|---|---|
| 1 | 1300 |
| 2 | 1900 |
| 3-7 | 2500 |
| 8 | 1900 |
| 9 | 1300 |
| 10 | 600 |

$CO_2$/WAG injection for the first injector would start in Year 4. The model used for the present LTSO EOR report assumes using imported $CO_2$ for a short time. By utilizing flexible enough air separation unit and $CO_2$ recovery design, startup can begin with rich air and operation can then transition to $O_2$ rich as $CO_2$ in the loop builds up. This can easily be accomplished during the three years of steaming the first well on the pad. Once three injection wells are operating, there will always be a surplus of CO2.

In summary, using the surface logistics as a direct analog for an eight injector well location and related facilities should provide a reasonable basis for a first cut at estimating LTSO EOR costs for the first three years of steaming for each injector. The advantages of the switch from ACIS with ROX to CO2 WAG after three years is that the surface logistics cost of ACIS with ROX can be shared among eight, ten or even more LTSO EOR injectors over the same life span for one pattern.

The switch to CO2/WAG will not be too expensive since the gas-to-oil ratios are expected to remain close to the same value for the two modes. Further, the production system will not be too different so costs for conversion will be modest. On the injection side, with prudent equipment selection, the 3,000 vs. 2,000 psi injection pressure for $CO_2$/WAG can be designed in initially. Then, most of the $CO_2$ recovery and recycle equipment will also serve for both the initial steaming and subsequent $CO_2$ flooding stages. One more stage of $CO_2$ compression may be required.

At the end of 10 years, the air separation unit will be available for moving to another injection well drill pad. But most of the other equipment must remain in service for the $CO_2$/WAG stage. There will be continued need for the entire production system. Water supply and treating will still be needed, and $CO_2$ recovery and recycle will need to continue, but in a somewhat different configuration.

In one embodiment, a method of increasing the matrix permeability around injectors in shale formations is provided by reinitiating pyrolysis of the kerogen in the matrix of the shale. The method to convert kerogen is provided with steam and $CO_2$, delivered with a down-hole steam generator, also referred to as a downhole burner or "downhole tool" or a "DHSG" in some of the Figures. As with initial (primary) pyrolysis, the gases and liquids that form in secondary kerogen pyrolysis increase the pressure locally and cause micro-fractures in the shale matrix which increase the permeability wherever the temperature exceeds 550° F. Moreover, decomposition of kerogen increases the porosity of the shale and can increase the shale matrix's permeability by an order of magnitude. The higher permeability makes injection of other fluids such as water and $CO_2$ practical and can increase incremental oil production by another 20% above the oil which is produced by primary production, i.e., from 5 or 10% of original oil in place (OOIP) to 25 to 30% of OOIP.

Since most shale formations are deep enough that surface steam cannot be used, the method uses the down-hole steam generator which produces a mixture of steam and $CO_2$ to heat the formation. Kerogen pyrolysis begins to occur at a significant rate at temperatures above about 288° C. (550° F.). This means that the reservoir pressure must be high, since the partial pressure of steam determines the temperature, and the partial pressure is reduced by diluents in the steam, such as $CO_2$ or hydrocarbon gases. Thus, about 2,000 psi is needed to heat the kerogen to about 600° F. In some formations it may be necessary to maintain backpressure at nearby producers in order to keep temperatures near the injectors high enough for pyrolysis to occur.

Modeling presented herein comprise simulations of a composite model, which combines characteristics of the upper, middle and lower Bakken into a single, uniform, model. The simulations were conducted in a 7,500 foot deep, shale model with an assumed one eighth of a mile between parallel producers that were initially used for primary production. After the initial oil production rate from the well pair had been reduced about 95% by primary production with a bottom hole pressure (BHP) of about 500 psi, the model was changed as follows. One producer is converted to an injector, and a mixture of steam and about 3,000 standard cubic feet (scf) gas/barrel of steam approximating the exhaust of the down-hole steam generator was injected at about 2,000 psi. The adjacent wells were changed to producers at around 1,000 psi backpressure.

These steam/$CO_2$/$O_2$ mixtures could be injected for up to about 20 years; however, enough $CO_2$ was produced after two to three years to start a $CO_2$/water injection project at 3,000 psi. Because CO2 can be injected at a higher pressure than steam, and is miscible with the oil in the shale, more fluid can be injected and more oil is produced than with steam injected at 2,000 psi.

Thus, that initial scenario can be improved by stimulating the reservoir with a downhole steam generator for several years with about 2,000 psi steam and CO2 injection pressure, then changing the injectants to about 3,000 psi CO2 and water (WAG). In some embodiments, even more CO2 and water can be injected because the porosity and permeability near the injector has been increased by pyrolysis of kerogen as shown in FIGS. 6A and 6B.

Figure 6A:
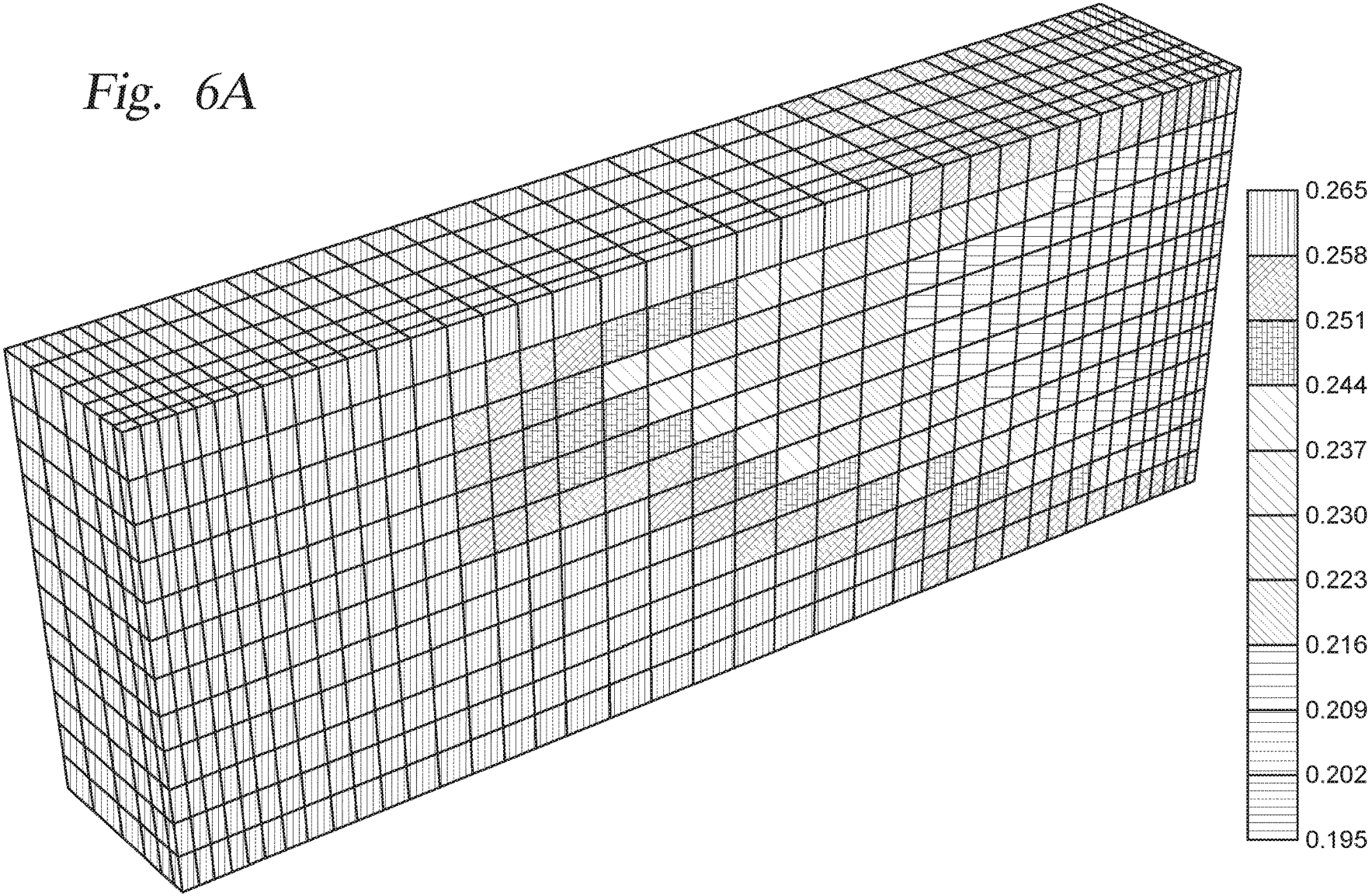
FIGS. 6A and 6B are graphs showing the kerogen concentration and porosity respectively, near the injector after about seven years of steam and $CO_2$ injection.
Figure 6B:
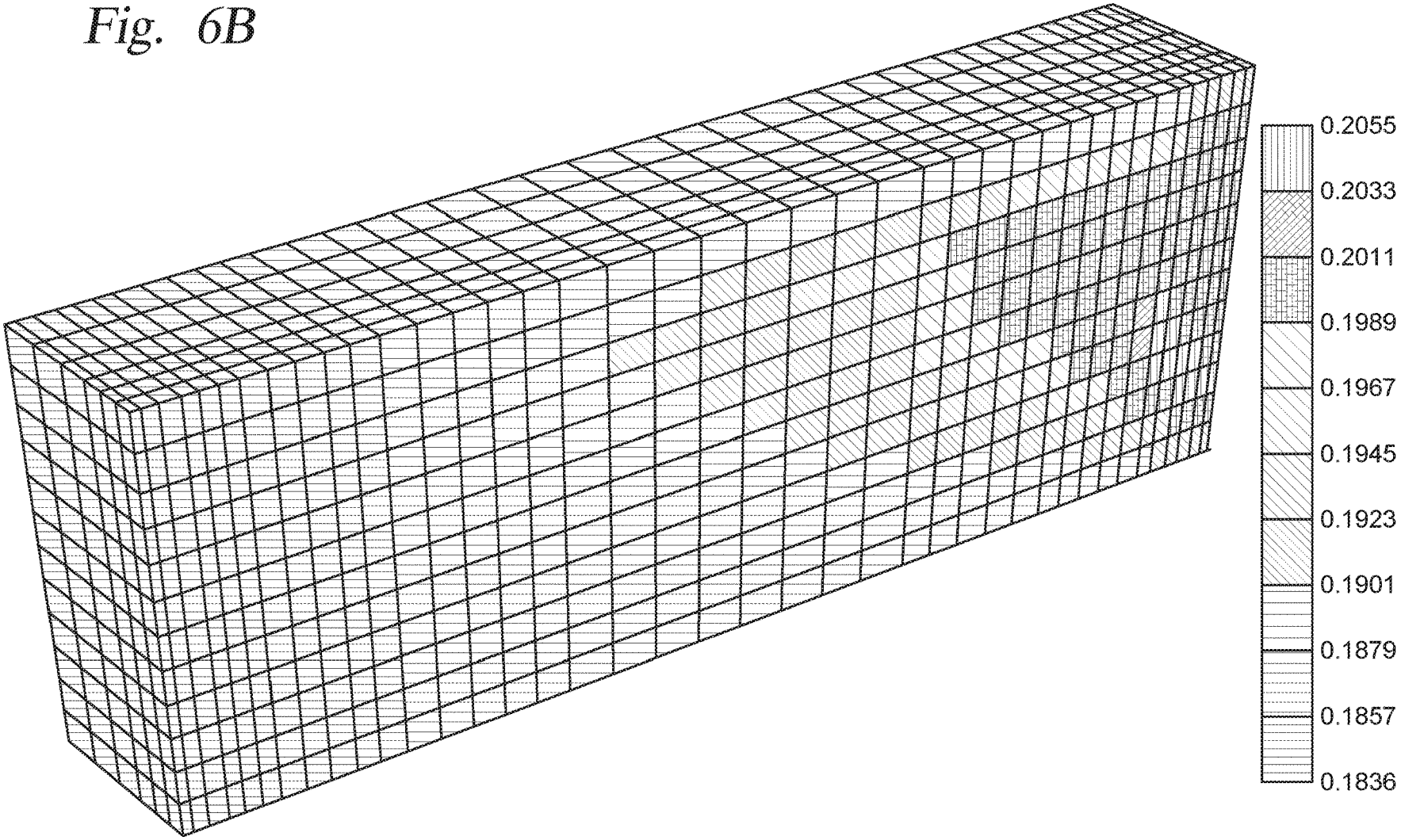

FIGS. 6A and 6B show the kerogen concentration and porosity near the injector after about seven years of steam and CO2 injection in one of the Bakken shale models. The model consisted of one quarter of a fracture stage (660' L, 110' W, 36' H). The figures show that almost one third of the kerogen has been pyrolyzed near the injector and that the porosity has increased several percent in that volume. While the pyrolysis of the kerogen does result in a small volume of additional oil, its effect on permeability, injectivity of $CO_2$ and water and subsequent oil production are dramatic.

Figure 7A:
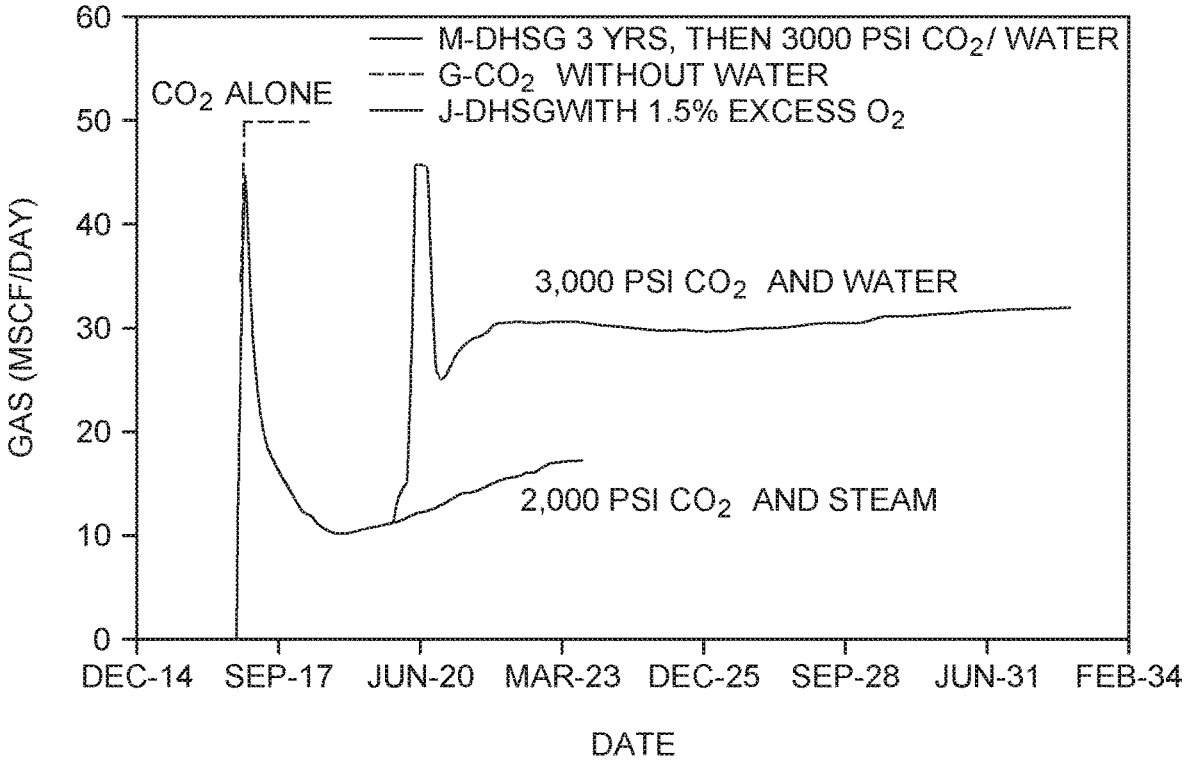
FIG. 7A is a graph showing $CO_2$ injection rates with and without steam and water.
Figure 7B:
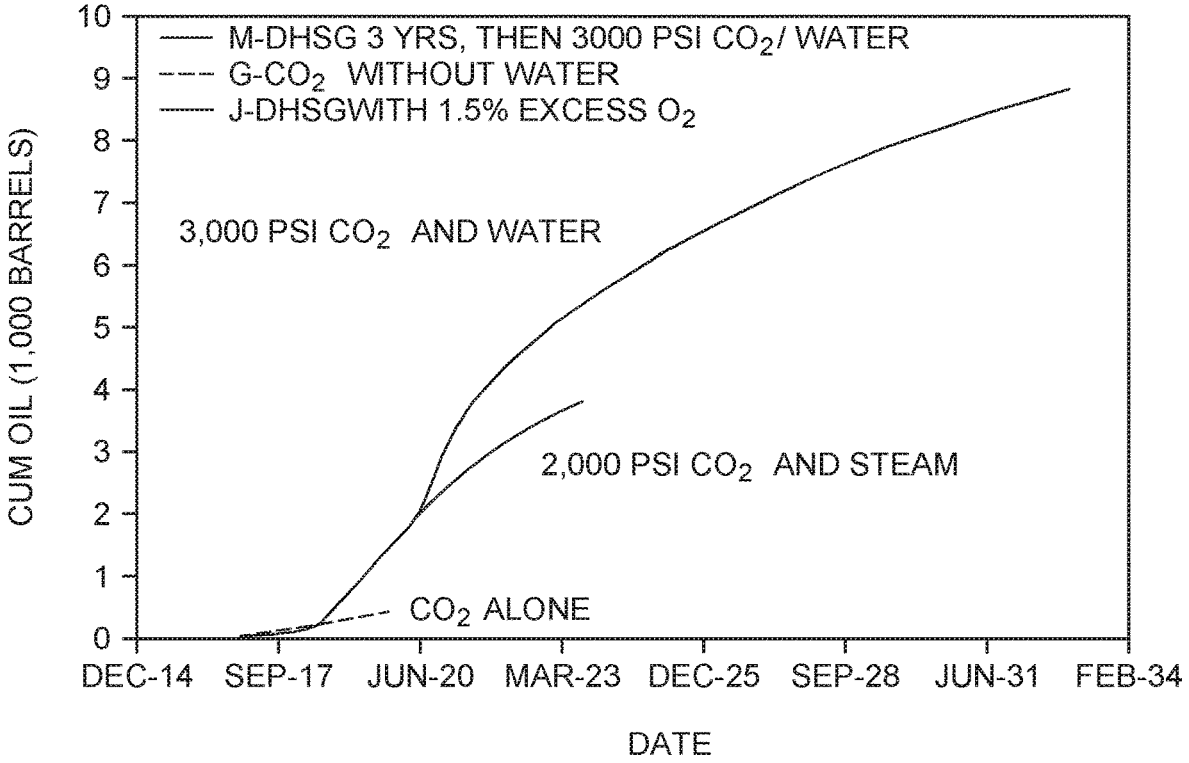
FIG. 7B is a graph showing the effect of a downhole steam generator and $CO_2$ on a reservoir.

The effect on injectivity and oil production are shown in FIGS. 7A and 7B for simulations in which $CO_2$ was injected without water, $CO_2$ and steam were injected with a down-hole steam generator at 2,000 psi and a simulation in which the down-hole steam generator was used for three years then produced $CO_2$ and water were co-injected.

The first point illustrated by FIGS. 7A and 7B is that while $CO_2$ can be easily injected at 2,000 psi, it produces little oil. This is because gas breaks through quickly and the gas-to-oil ratio rises above 100 million standard cubic foot per barrel (mscf/bbl) very quickly. Thus, $CO_2$ alone may not be a good option for improving production of oil from shale reservoirs.

The results of using the down-hole steam generator at 2,000 psi are more promising. While not as much gas can be injected with steam, a substantial volume of oil is produced and the model at a one quarter fracture stage eventually would produce nearly four thousand barrels of oil.

In the third simulation shown in FIGS. 7A and 7B, the downhole steam generator was used for three years before injection of CO2 generated by the down-hole steam generator with water at 3,000 psi began. Additional fluids can be injected because the injection pressure is higher and the permeability and porosity of the area near the injector have been increased by pyrolysis of kerogen which creates micro-fractures. Therefore, the oil production is much higher and reaches 8,800 barrels by the end of the simulation, i.e., 21% incremental production of the 43,000 bbls OOIP. Approximately 2,000 barrels is produced in 3 years when using the downhole steam generator to stimulate the reservoir. The volumes produced from the model correspond to 845,000 (total) barrels of oil and 192,000 barrels (from 3 years of steam), respectively, from a full pattern.

In one embodiment, using a down-hole steam generator to heat and pyrolyze kerogen is an ideal method for stimulating a shale formation by increasing the matrix permeability with micro-fractures. This increases the volume of fluids that can be injected and thus the volume of oil that can be produced. Moreover, the evidence from the simulation shows that switching from steam/$CO_2$ injection to water/$CO_2$ injection after several years of stimulation with a down-hole steam generator is an ideal scenario for increasing the production of oil from some shale formations. This is possible with a down-hole steam generator because there is always some excess oxygen in the flame. This creates $CO_2$ by reacting with kerogen and oil which have been left in the matrix, and that $CO_2$ is produced and compressed for use elsewhere.

There is excess $O_2$ for two reasons. First, more than the stoichiometric amount of oxygen must be in the flame to assure complete combustion, maximize the energy released by the flame, and to prevent coke formation. The second reason is that additional oxygen can be substituted for $CO_2$ in order to reduce the flame temperature. This excess $O_2$ is available to release energy in the matrix by consuming fuels, such as un-pyrolyzed kerogen, coke and non-volatile bitumen which are left in the matrix.

In one embodiment, the shale oil EOR process works best with about 1.5% to 2.5% O2 in the combined stream leaving the downhole steam generator effluent tailpipe. With proper design, a downhole steam generator can typically be operated with anywhere from 0.25% to 5% surplus $O_2$ in the tailpipe. Thus a downhole steam generator designed for heavy oil application also works quite well in light tight shale oil (LTSO) formations because, in a downhole steam generator, feedwater is introduced into the exhaust stream leaving the combustor, and the material balance in the combustor without feedwater results in combustion excess $O_2$ greater than 2% even when the effluent tailpipe is at a minimum of 0.25% surplus $O_2$. Operation in LTSO with tailpipe $O_2$ about 1-2% allows very comfortable excess $O_2$ in the combustor.

Calibration of Models

Figure 8:
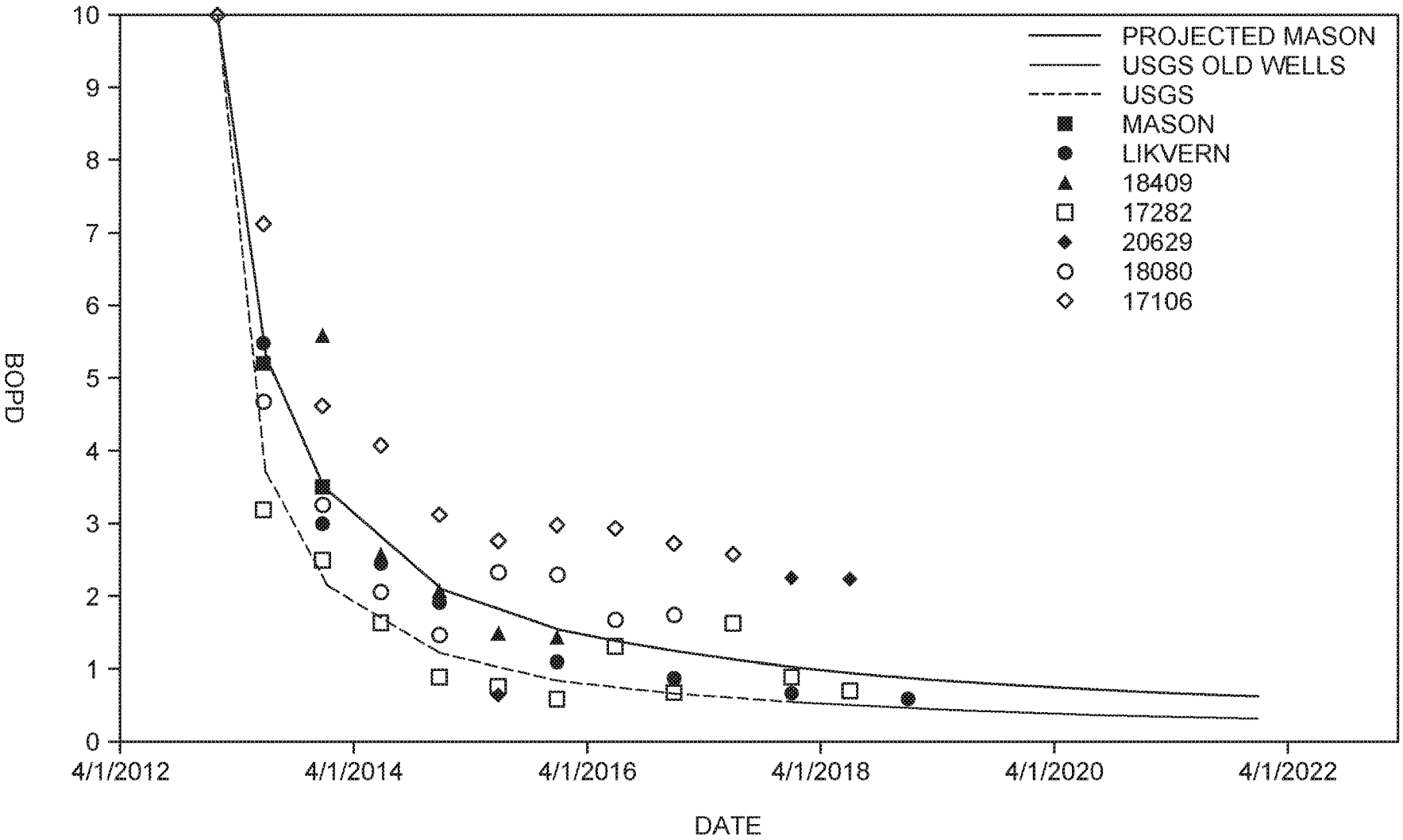
FIG. 8 is a graph showing normalized production decline rates of wells.

The model was calibrated by history matching the average of nine production decline curves for Bakken wells. Some of the best matches of primary decline rate data are shown in FIG. 8. The model used fracture permeability of 0.5 millidarcy (md) in order to reduce the initial oil production rate and to match the reported average production. A mile long well is assumed to have 24 fracture stages, an initial production rate in our model of 25 bpd means that the full well has an initial rate of 2,400 bpd (24×4×25 bpd). Cumulative primary production from the model is approximately 11% of OOIP.

Figure 9:
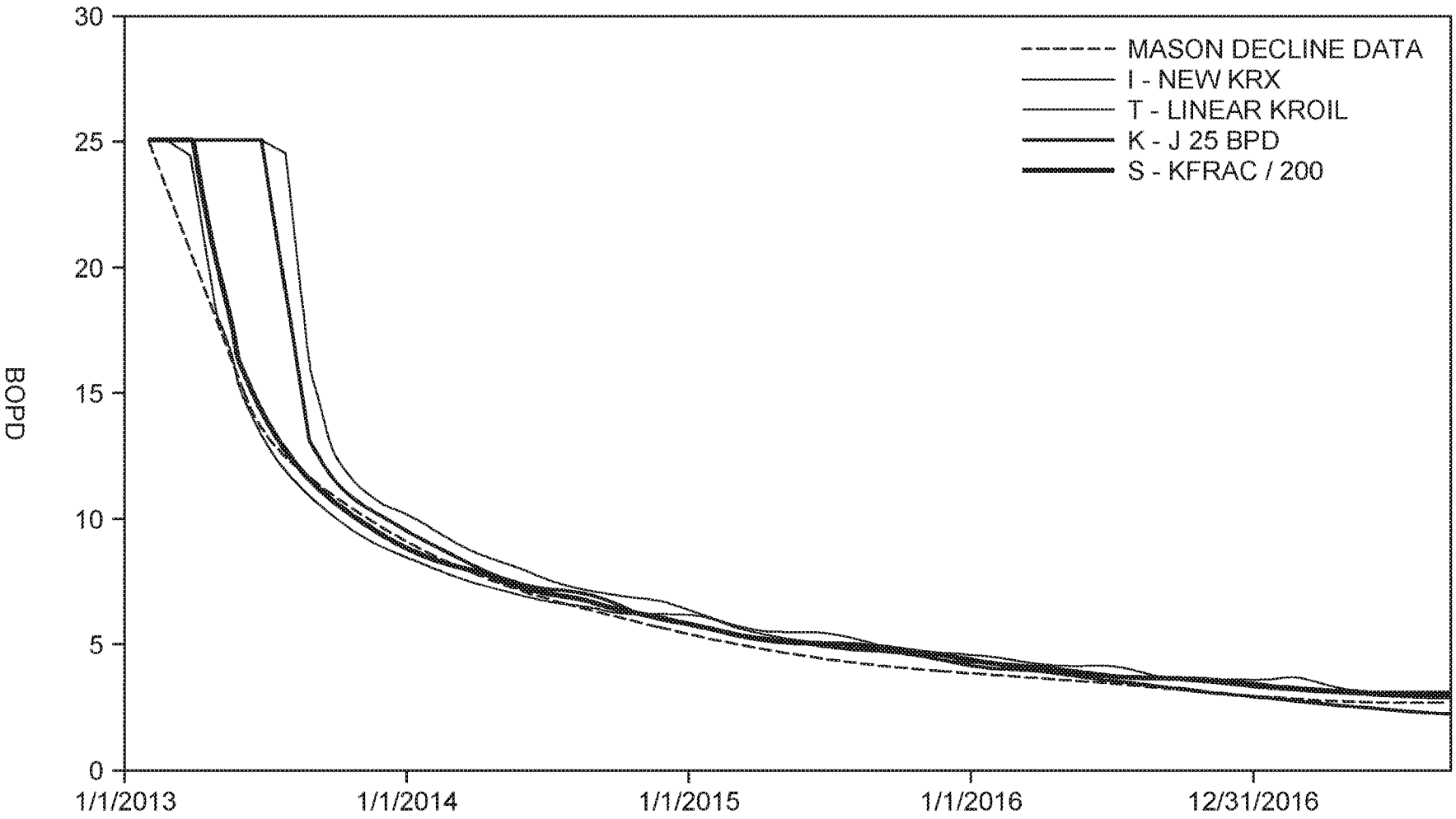
FIG. 9 is a graph showing primary decline rates of a ¼ Frac stage model.

The predicted oil productions from the first and second wells of the model are shown in FIG. 9. The second well is drilled three years after the first well. The production rate of the second well declines much faster than that of the first well since the reservoir pressure is now being depleted by both wells.

Figure 10:
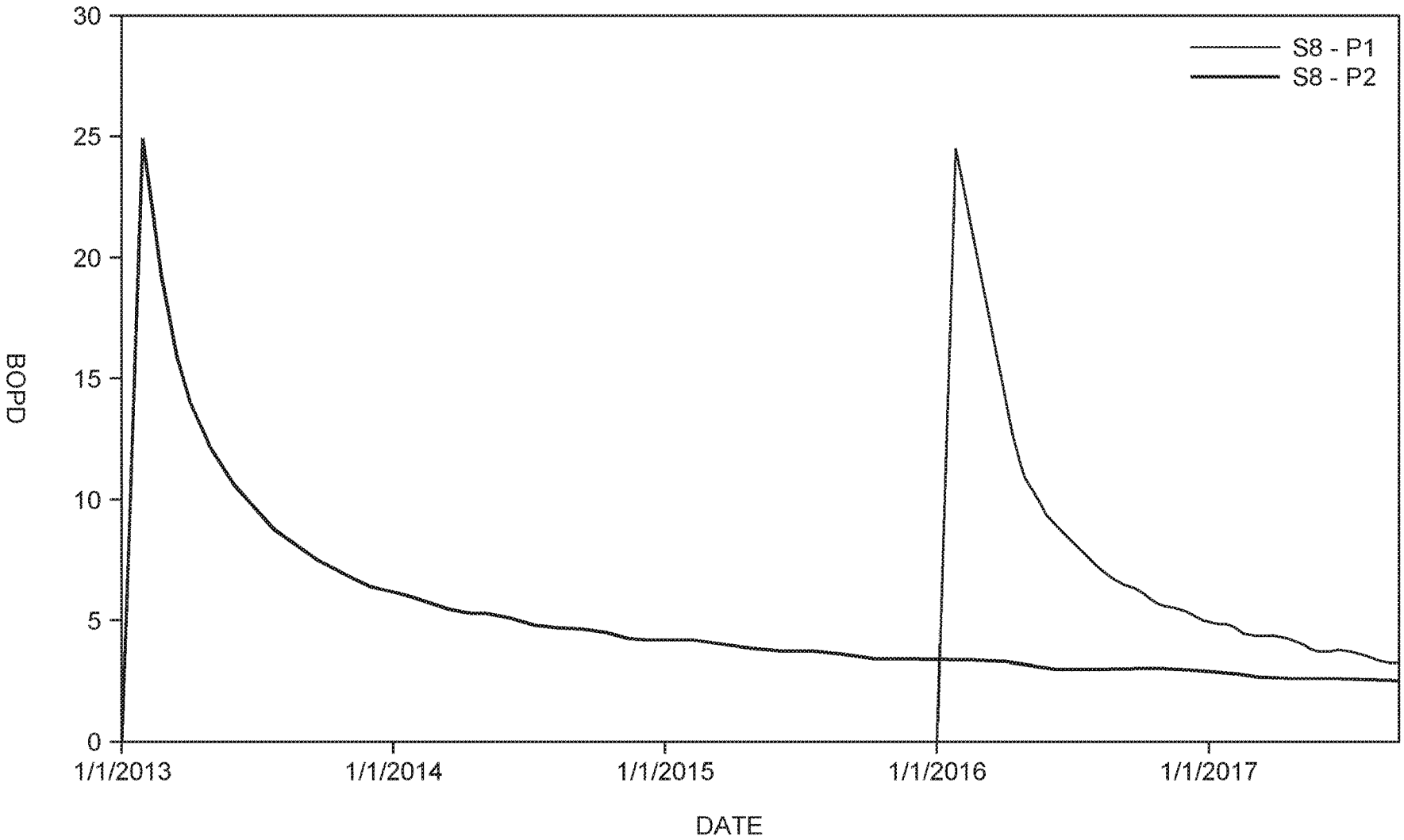
FIG. 10 is a graph showing predicted oil production for first and second wells.

FIG. 10 shows the remaining oil saturation after ten years of primary production. The oil saturation is lower at the top of the model because gas rises and is produced quickly as the model's pressure falls below the oil's bubble point of 1,900 psi.

Summary of Performance

In one embodiment, the best performance of a downhole steam generator was demonstrated in the 660 foot (X2) model simply because the response is faster and resistance to injection of fluids is lower than when there is a larger distance between wells. Also in this section we will present an example of what is believed to be the best use of a downhole steam generator in the Bakken shale, and then step back and illustrate what does not work well and why we have chosen to use a downhole steam generator for three years before injecting the $CO_2$ generated in the formation with water to increase incremental cumulative oil production above 20% of OOIP.

In this embodiment, the best Bakken EOR process includes use of a downhole steam generator with some excess 02 to generate heat and pyrolyze kerogen, increasing the porosity and permeability of the heated zone by increasing the pressure when oil and gas are generated, and then to drive oil from the shale with a combination of condensed water from the steam and $CO_2$. Then, after 3 years, inject $CO_2$ and water at a higher pressure to approach miscible conditions and continue to produce oil for up to 20 years. This process works because more gas is produced from the formation than is injected, so that a steady supply of $CO_2$ is produced. In addition, co-injection of water and $CO_2$ (WAG) limits $CO_2$ production in the natural fractures and spreads the gas out so that more oil is produced.

Figure 11:
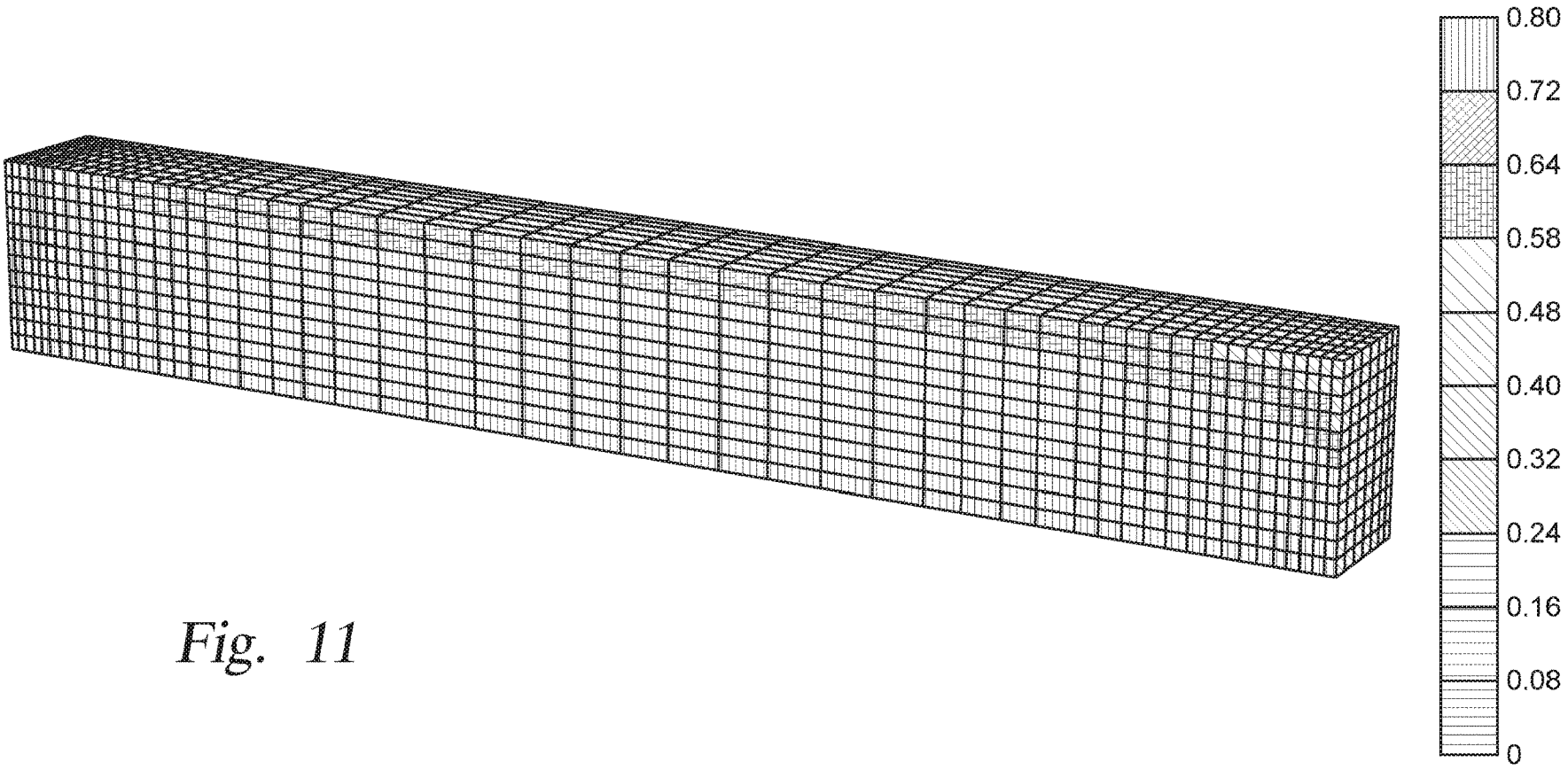
FIG. 11 is a graph showing oil saturations after ten years of primary production.

FIG. 11 shows the oil saturation in the X2 model after ten years of primary production. A zone with higher gas saturation has formed at the top of the model. This makes EOR with $CO_2$ alone impractical, since injected gas will flow through this zone quickly and not displace much oil.

Figure 12:
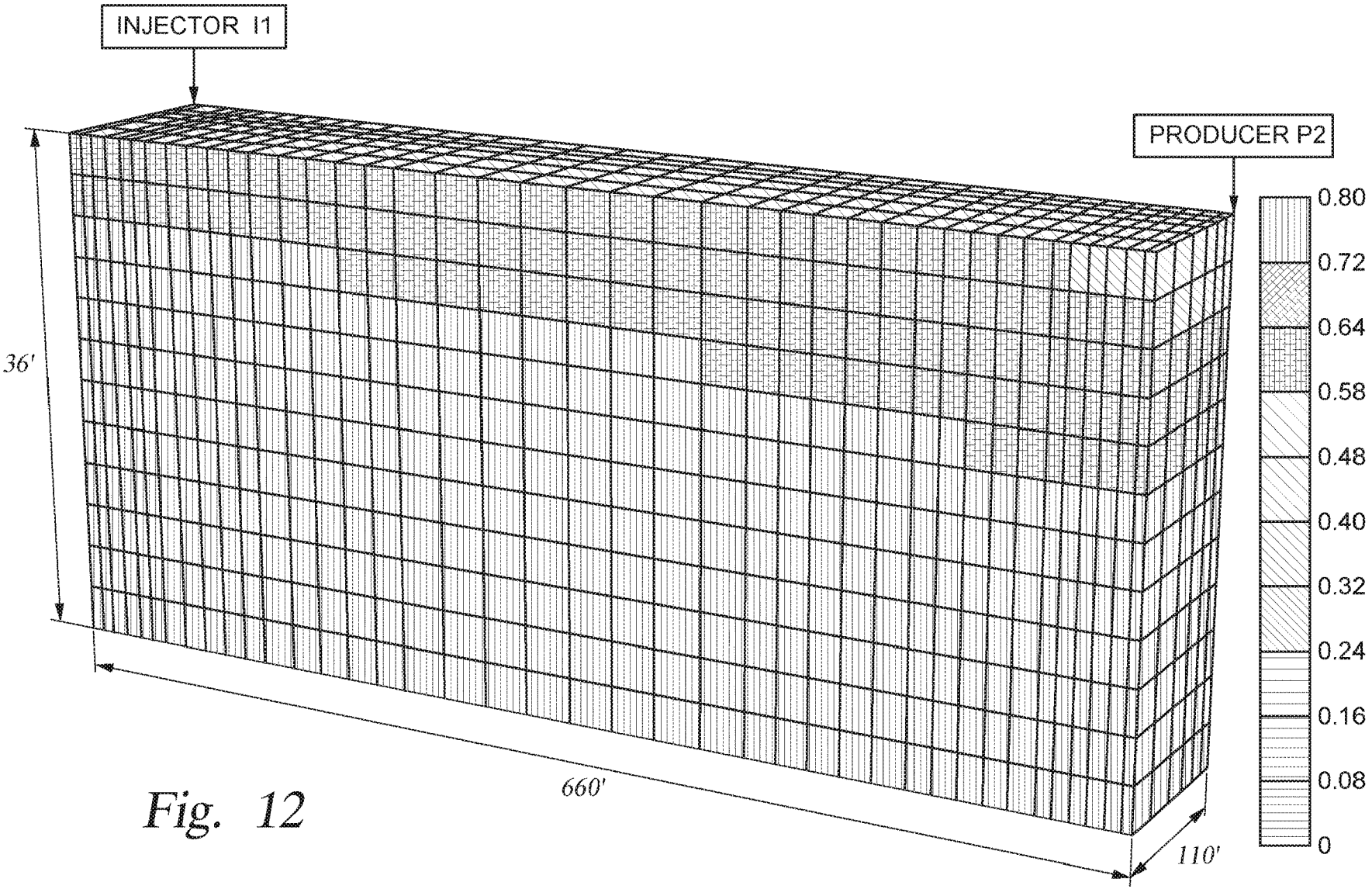
FIG. 12 is a graph showing oil saturations in a 660 foot model after ten years of primary production.

Now, if a downhole steam generator were used for seven years. FIG. 12 shows that a large portion of the hydraulic fractures would have been heated and both steam and $CO_2$ would be produced by that time. This limits the practical application of the downhole steam generator in the 660 foot model to three years (as shown and described below). However, kerogen decomposes at a high rate at temperatures above 550° F. (288° C.), although pyrolysis of kerogen into oil occurs slowly at lower temperatures.

Figure 13:
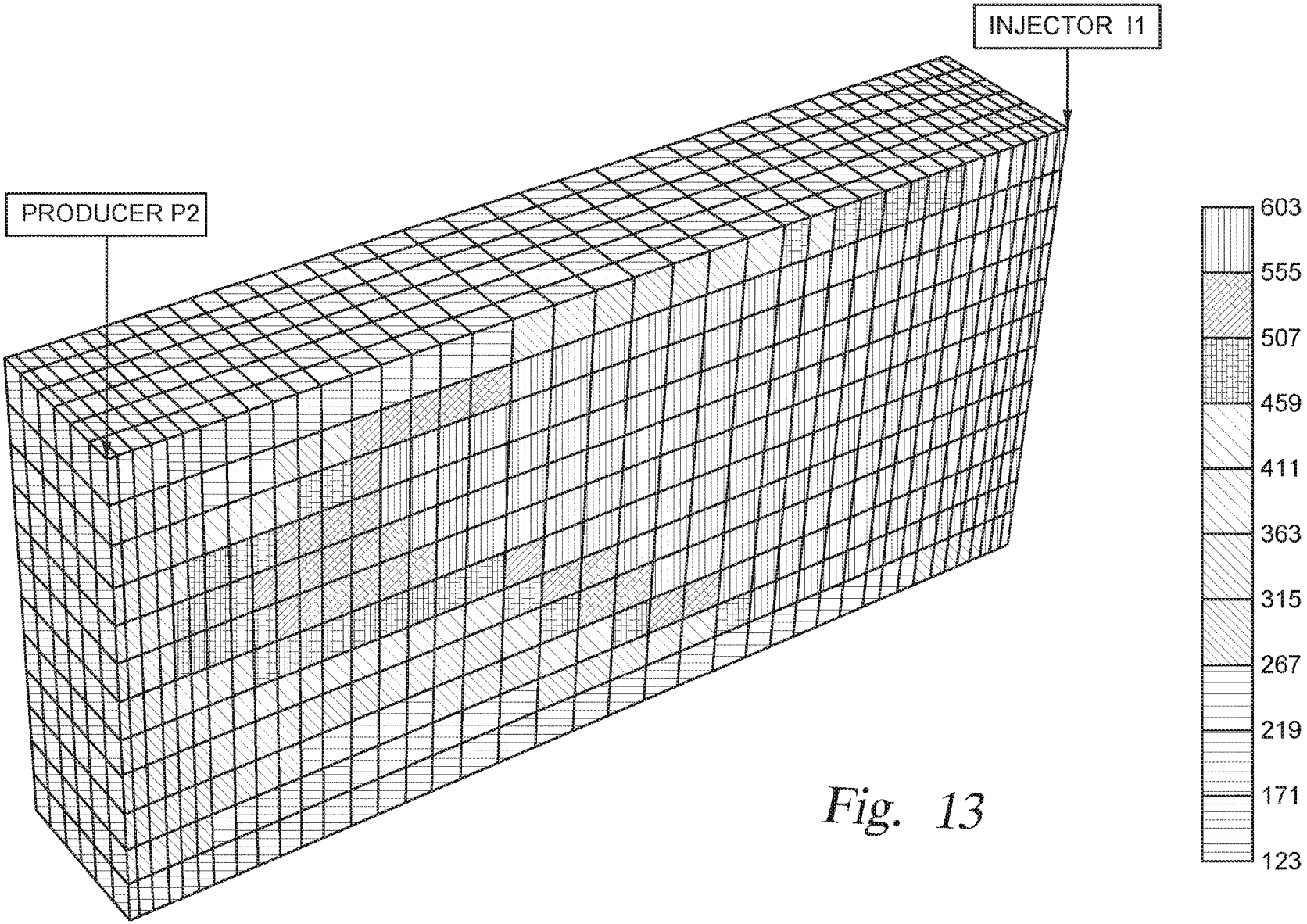
FIG. 13 is a graph showing temperature after seven years of steam and $CO_2$ injection.

FIG. 13 shows that up to 25% of the kerogen has decomposed near (within 30 feet) the injector. When kerogen decomposes, gases and liquids are created which increase pressure locally and cause micro-fractures to form in the bedding plane of the kerogen (kerogen rich deposits). This increases the porosity and permeability and makes injection of fluids easier. This is shown in FIGS. 14A and 14B.

Figure 14A:
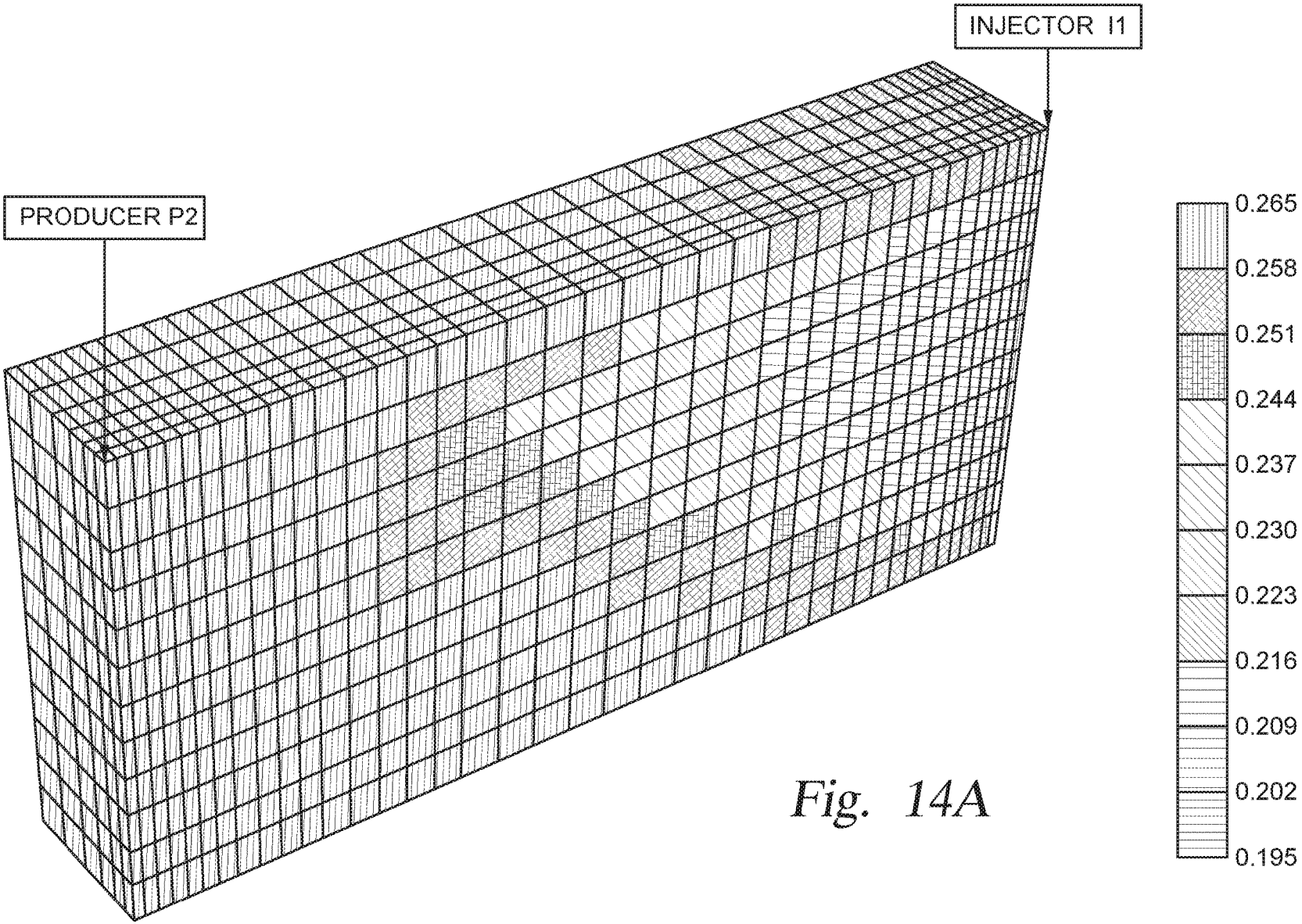
FIG. 14A is a graph showing kerogen concentration after seven years of steam and $CO_2$ injection.
Figure 14B:
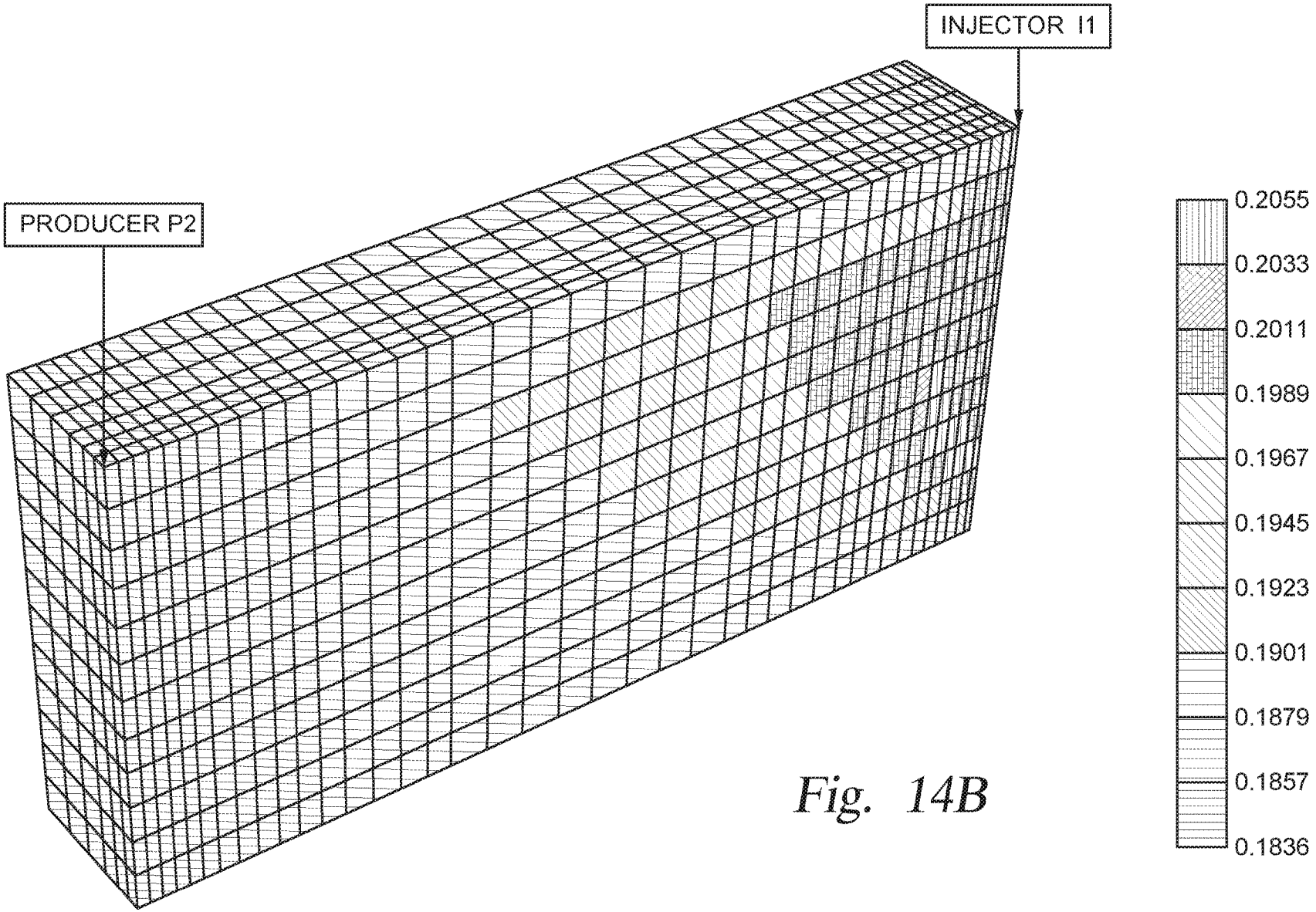
FIG. 14B is a graph showing porosity after seven years of steam and $CO_2$ injection.

FIGS. 14A and 14B are graphs showing the solid phase kerogen content and porosity respectively, after seven years of steam and $CO_2$ injection. FIG. 14B shows that the porosity has increased up to 2% (10% of the fluid porosity) in the region where kerogen has decomposed. This increases the permeability by up to a factor of ten (to 0.4 md) and makes injection of fluids easier. Moreover, the excess gases that are produced can be reinjected to produce more oil.

Figure 15:
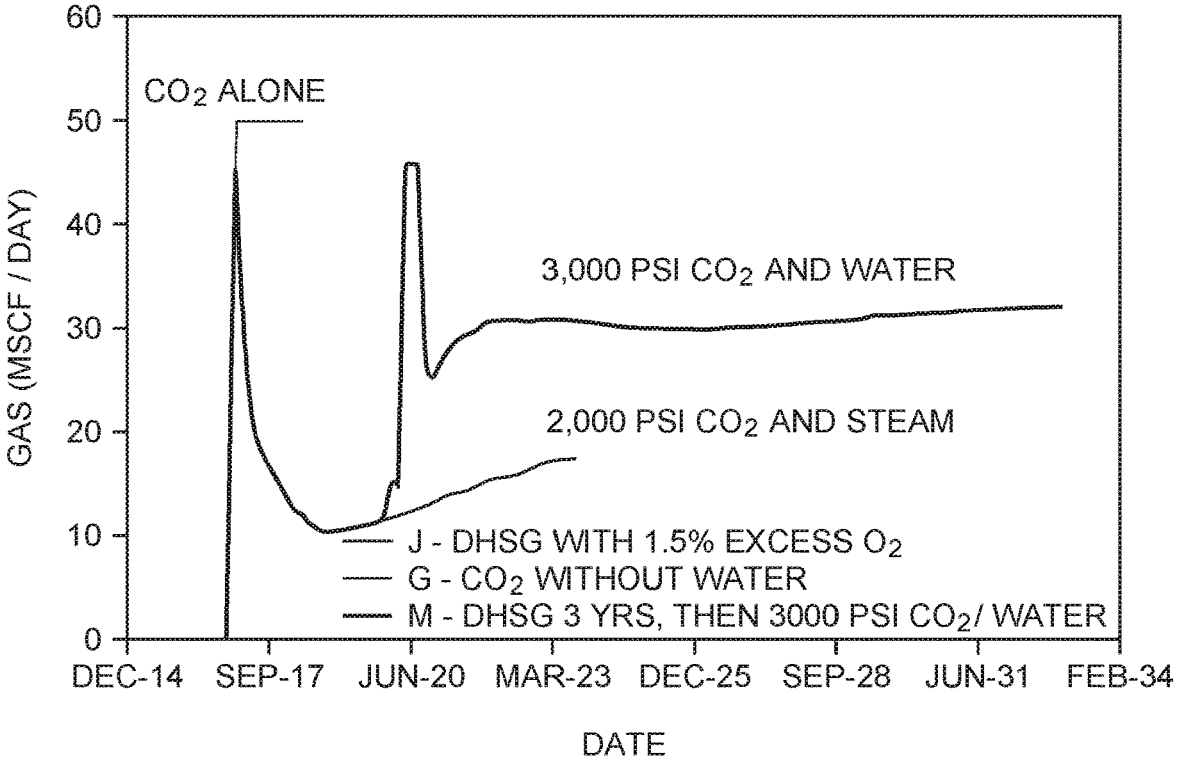
FIG. 15 is a graph showing injection rates for $CO_2$, steam and $CO_2$, and water and $CO_2$.
Figure 16:
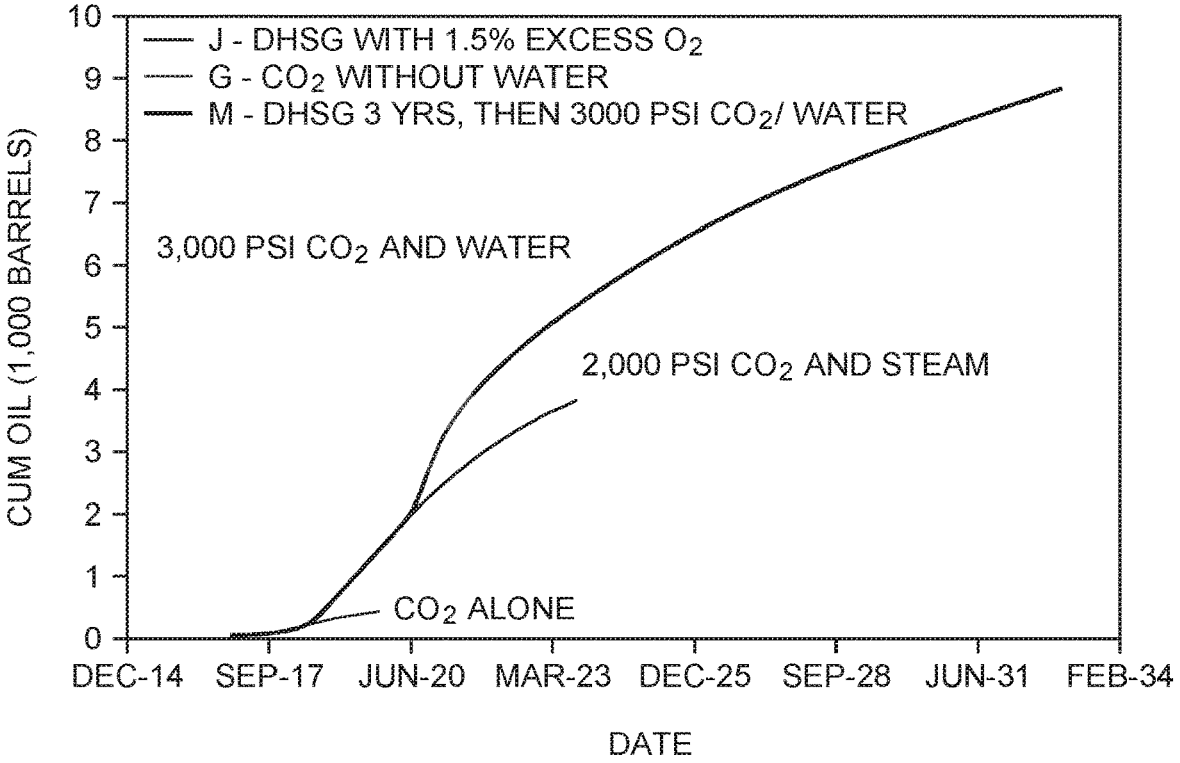
FIG. 16 is a graph comparing cum oil for $CO_2$, steam and $CO_2$, and water and $CO_2$.

FIGS. 15 and 16 compare the gas injection rate and cumulative oil production for three simulations in the X2 model. The first of these simulations is $CO_2$ without water co-injection (upper left curve). FIG. 15 shows that it is very easy to inject $CO_2$, but FIG. 16 shows that very little oil was produced. This may be because the gas that is injected flows quickly to the producer through the existing override zone shown above in FIG. 11. The two figures also show that less gas is injected with a downhole steam generator, but that much more oil is produced. Less gas is injected but the reservoir volume of the water co-injected with gas by the downhole steam generator is 2.35 times the reservoir volume of the gas. So, condensed steam and gas displace much more oil than gas alone in this simulation model.

While more oil is produced with a downhole steam generator, the volume that can be economically produced is limited since the steam-to-oil ratio (SOR) exceeds ten after seven years. This is happening because the hydraulic fractures are aligned in these models, so hot fluids have moved almost all of the distance to the producer in FIG. 12.

Therefore, one method of operation is to remove the downhole steam generator after three years and to start CO2 and water co-injection at a higher pressure (3,000 psi versus 2,000 psi). Much more fluid can now be injected than initially, not only because the injection pressure is higher but because the porosity and permeability are higher near the injector, since kerogen has pyrolyzed and micro-fractures have been created (see FIG. 14 and the explanation). Moreover, $CO_2$ can be profitably recycled to a gas-to-oil ratio (GOR) of 40 to 60. Thus oil production can continue much longer and almost 9,000 barrels of incremental oil (21% of OOIP) is produced by the hybrid process.

Figure 17:
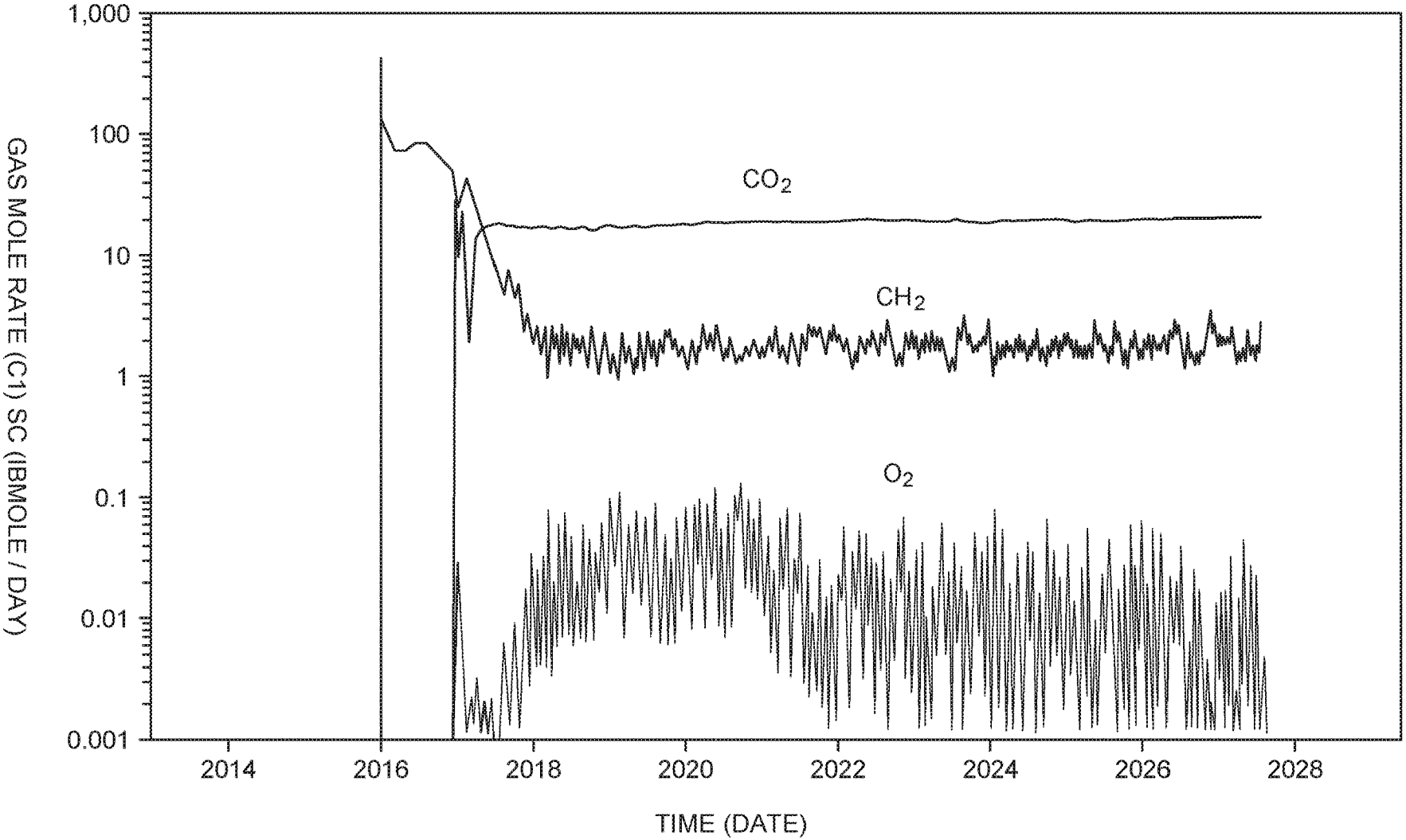
FIG. 17 is a graph showing production of $CO_2$, $CH_4$, and $O_2$.
Figure 18:
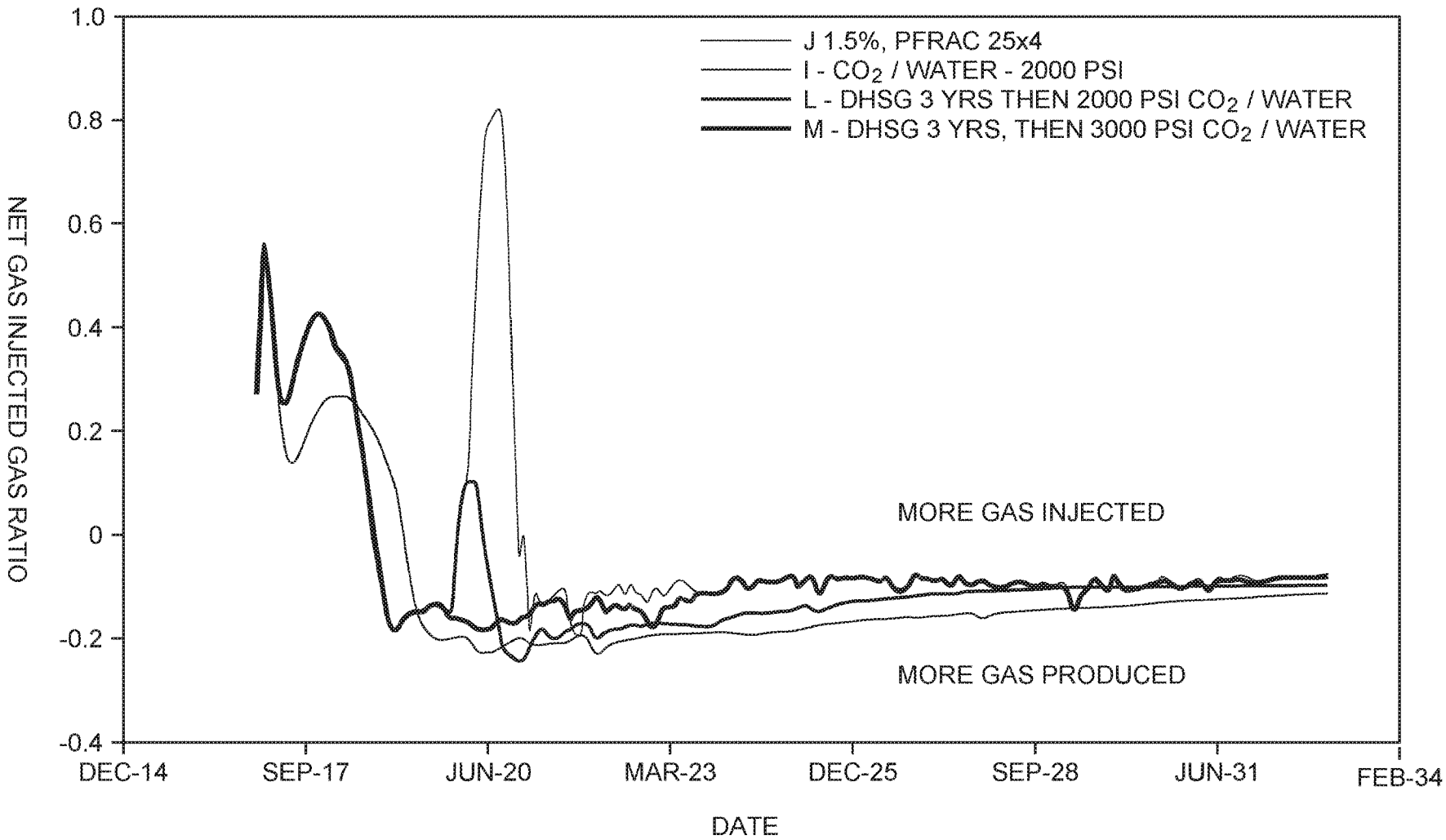
FIG. 18 is a graph showing net gas production with a downhole steam generator and $CO_2$.

Carbon dioxide supply is limited in certain regions and FIGS. 17 and 18 illustrate a viable solution. FIG. 17 shows that the $CO_2$ concentration in the gas produced from a shale reservoir being treated with a downhole steam generator is 90% after one year and that the O2 concentration is less than 0.5%. This happens because gas is produced very quickly in fractured rock. The high concentration of $CO_2$ means that it can be recovered by conventional methods; the $CH_4$ could be converted to $CO_2$ in a thermal oxidizer (essentially an industrial scale catalytic oxidizer), or that the produced gas could be injected directly into another injector, since injecting $CO_2$ with 10% methane will not reduce oil production much.

FIG. 18 shows gas produced that could be used in the EOR process. FIG. 18 is a plot of the net produced gas ratio for several simulations. This is the ratio of injected minus produced gas to injected gas. If the ratio is positive gas must be purchased. If the ratio is negative, excess gas is being produced.

FIG. 18 shows that excess gas is being produced within two years after beginning to use a downhole steam generator. When the downhole steam generator is removed and $CO_2$ water co-injection begins at a high rate (M—red curve) $CO_2$ must be imported for approximately one year. After a few wells are sequentially brought into operation, there will be enough older wells producing net CO2 such that the fourth year demand of the last well coming on-stream is adequately supplied (provided that initial $CO_2$ WAG injection into that well is properly curtailed). In other words FIG. 18 shows that an integrated project will be a net producer of $CO_2$ after a few wells are brought into operation.

Initial Performance

Figure 19:
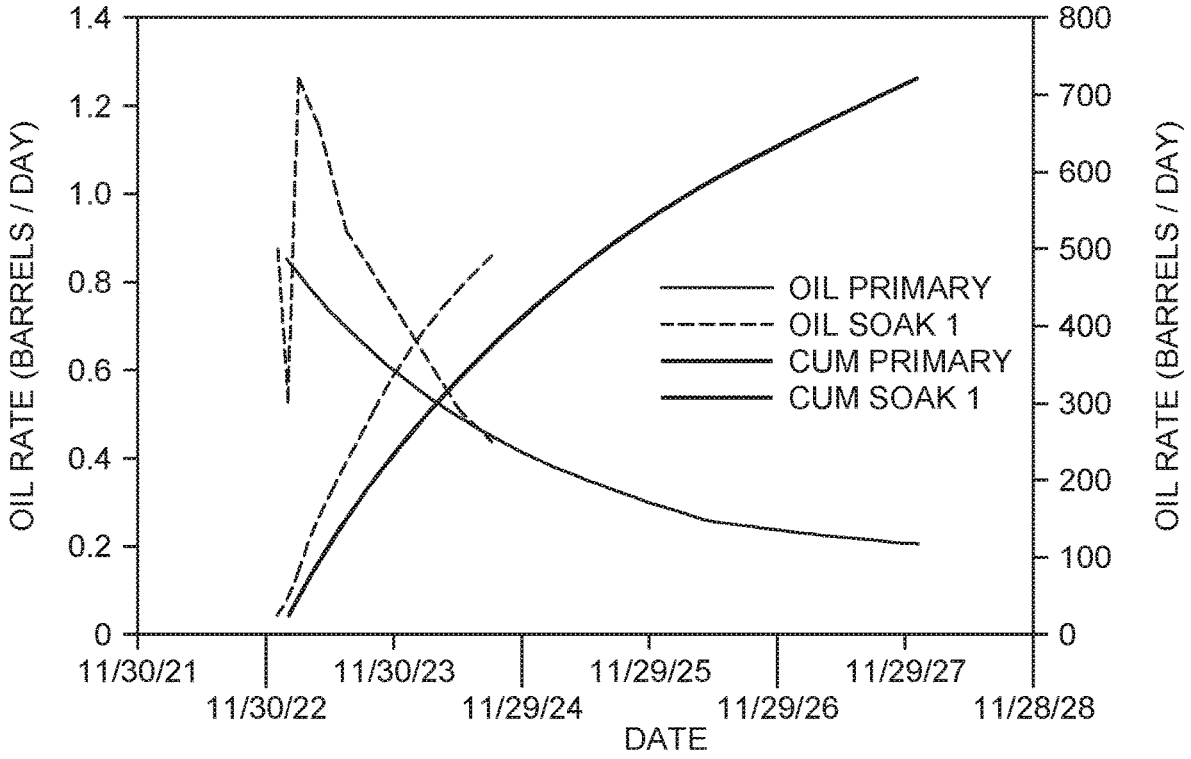
FIG. 19 is a graph showing oil production in a single soak cycle and primary for a 1,320 foot model.

This section illustrates an embodiment that may be less preferable than other embodiments. One of the original concepts of this modelling was that steam soaks with a downhole steam generator would pyrolyze kerogen, release additional oil and substantially increase oil production. However, FIG. 19 shows that while approximately 25% more oil is produced from a 1,320 foot model after a single soak cycle with a downhole steam generator, 750 barrels of steam had been injected to produce the extra oil, i.e., the incremental SOR was approximately 7.5. This may not be attractive economically.

Figure 20:
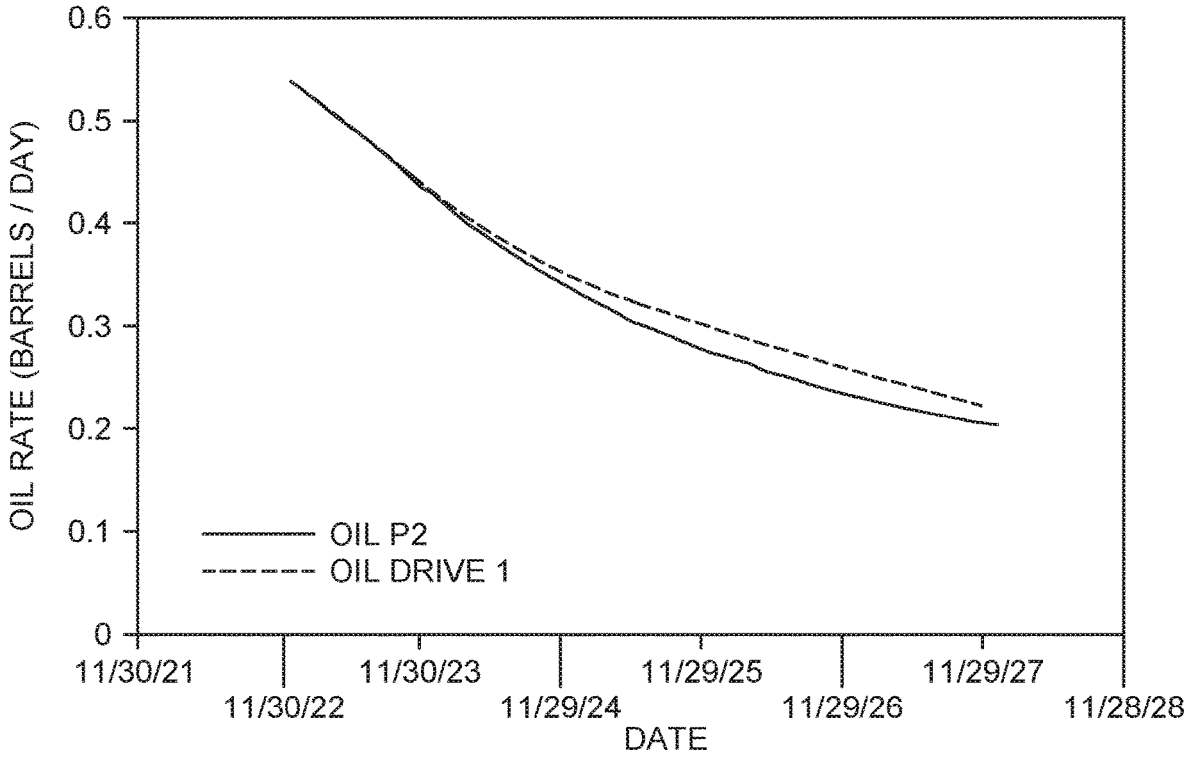
FIG. 20 is a graph showing oil production in steam drive and primary for a 1,320 foot model.

An even less impressive result was obtained when a steam drive was attempted in the 1,320 foot model. FIG. 20 shows that slightly more oil is produced at the second producer (P2) in the model when the downhole steam generator is used to drive oil to the well. However, oil production is lost from the producer (P1) that is converted to an injector. So, net oil production is negative as is the steam-to-oil ratio. Not only does oil production at the P2 producer shown in FIG. 20 steadily decrease, but steam and gas injection also decrease as does the produced gas-to-oil ratio. This means that the one quarter mile well spacing in the large model may be too large for shale with 0.04 md matrix permeability and 0.5 md fracture permeability. Thus, a smaller model (the 660 foot (X2) model) was used in all of the remaining simulations.

Effect of $CO_2$ and Steam or $CO_2$ and Water

This section compares the effect of $CO_2$ with steam (using the downhole steam generator) or water in the 660 foot (X2) model shown in FIG. 11.

$CO_2$ has a long history of use in EOR processes. However, $CO_2$ is a gas which can perform poorly in fractured reservoirs because it will bypass the oil and be produced with high gas-oil-ratio. Moreover, $CO_2$ is not available in large quantities in certain areas due to factors such as no large natural sources of $CO_2$ and few refineries or chemical plants that could produce nearly pure $CO_2$. This section compares the results of five simulations: These are 1) $CO_2$ without water; 2) $CO_2$ and water injected at 2,000 psi; 3) $CO_2$ and water injected at 3,000 psi; 4) $CO_2$ and steam from a downhole steam generator at 2,000 psi; and 5) $CO_2$ and steam with 1.5% excess $O_2$ from a downhole steam generator at 2,000 psi.

Figure 21:
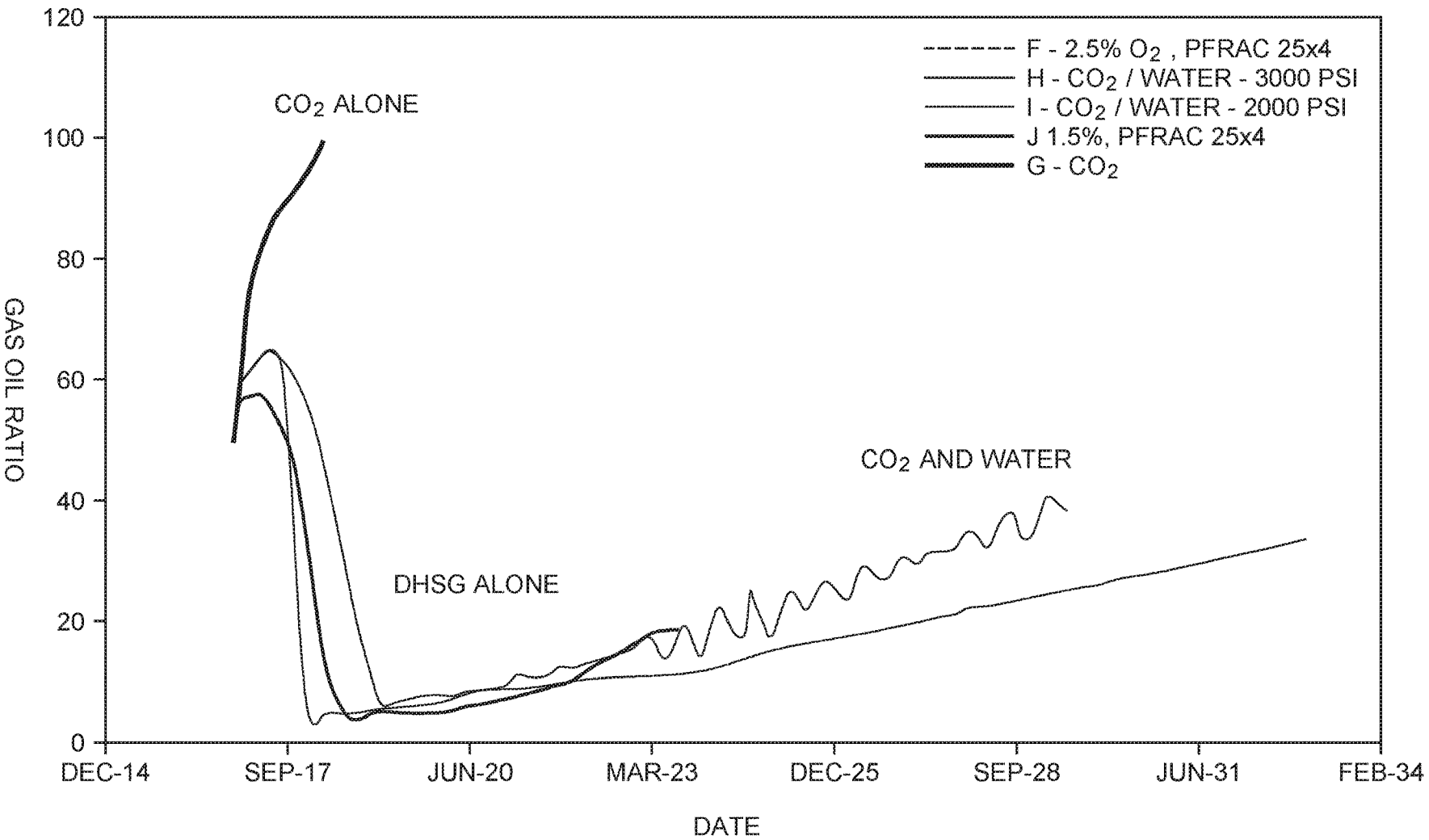
FIG. 21 is a graph showing gas-to-oil ratios for several $CO_2$, $CO_2$/water and downhole steam generator simulations.

Results are presented in FIGS. 21 through 25. FIG. 21 presents the gas-oil ratio for the simulations and shows first of all that injection of $CO_2$ without water results in production of $CO_2$ and little oil since the GOR reaches 100 mscf/bbl very quickly. This happens for two reasons. First, $CO_2$ can override and bypass oil in the matrix through gas saturated fractures in the top of the model. In addition, $CO_2$ has been known to move several miles through fractures in Bakken shale pilots in a few weeks in the absence of a free gas phase.

Figure 22:
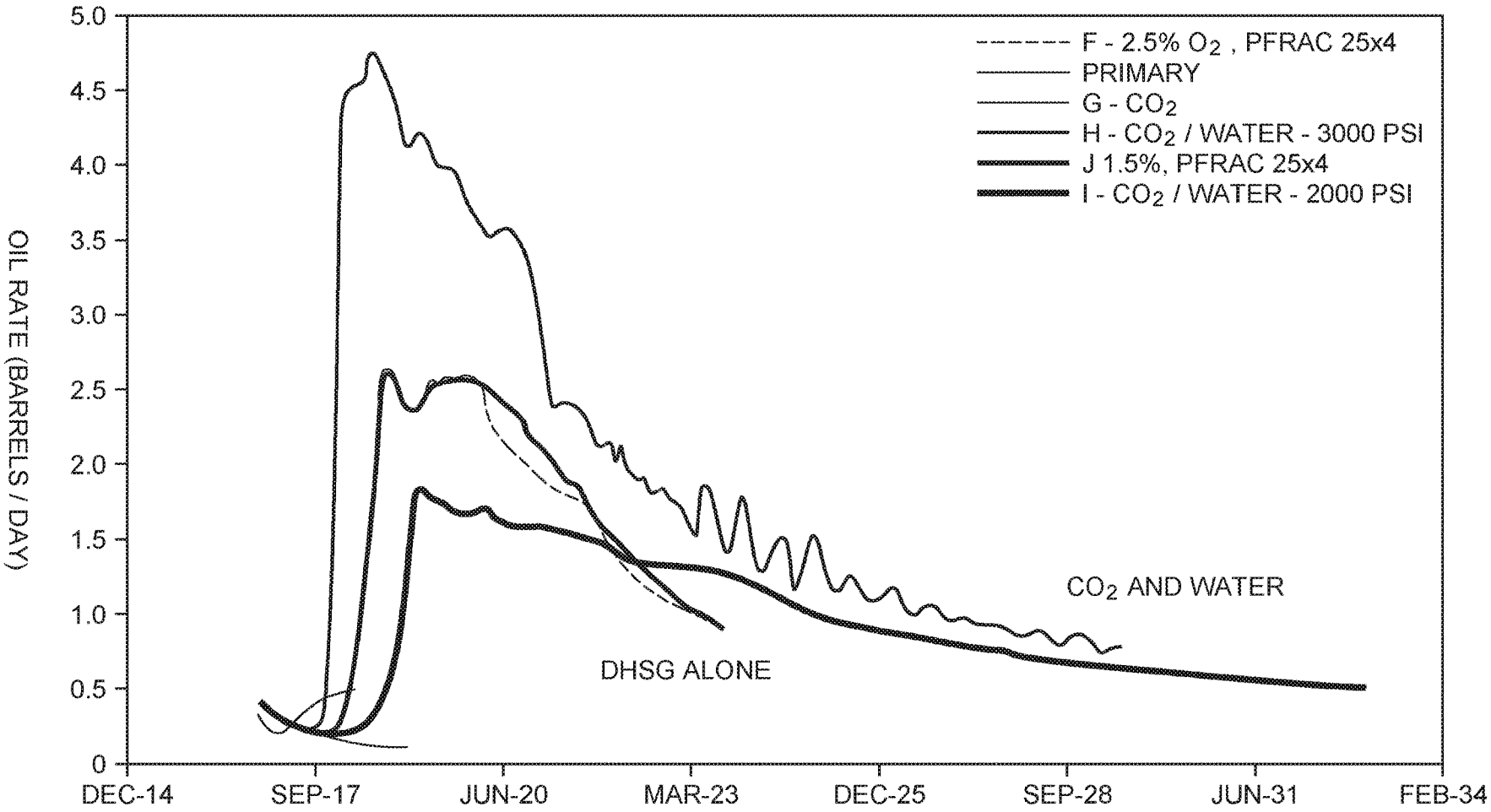
FIG. 22 is a graph showing oil production rates for several $CO_2$, $CO_2$/water and downhole steam generator simulations.

FIG. 22 also shows that the GOR is easily controlled by co-injection of water. So, the results presented earlier in FIGS. 15 and 16 are observed.

The oil production rates for the several simulations are compared in FIG. 22 with the production predicted for continuing primary oil production. $CO_2$ (G) and primary produce very little oil. The two downhole steam generator simulations (F and J) produce oil at a higher rate initially than CO2 and water do at the same injection pressure (2,000 psi-I). However, they were shut in after 7 years because the SOR reaches 10 (FIG. 23).

In contrast, the 2,000 psi CO2 and water simulation produces less oil initially than the 2,000 psi downhole steam generator models did. However, it does eventually produce more oil because it does not have to be stopped early due to rapidly declining production or high steam-oil ratio. Finally, when CO2 and water are injected at 3,000 psi oil production increases by 60% because the CO2 is either very soluble or even miscible with the oil and the pressure gradient for pushing $CO_2$ into the matrix is larger.

Figure 23:
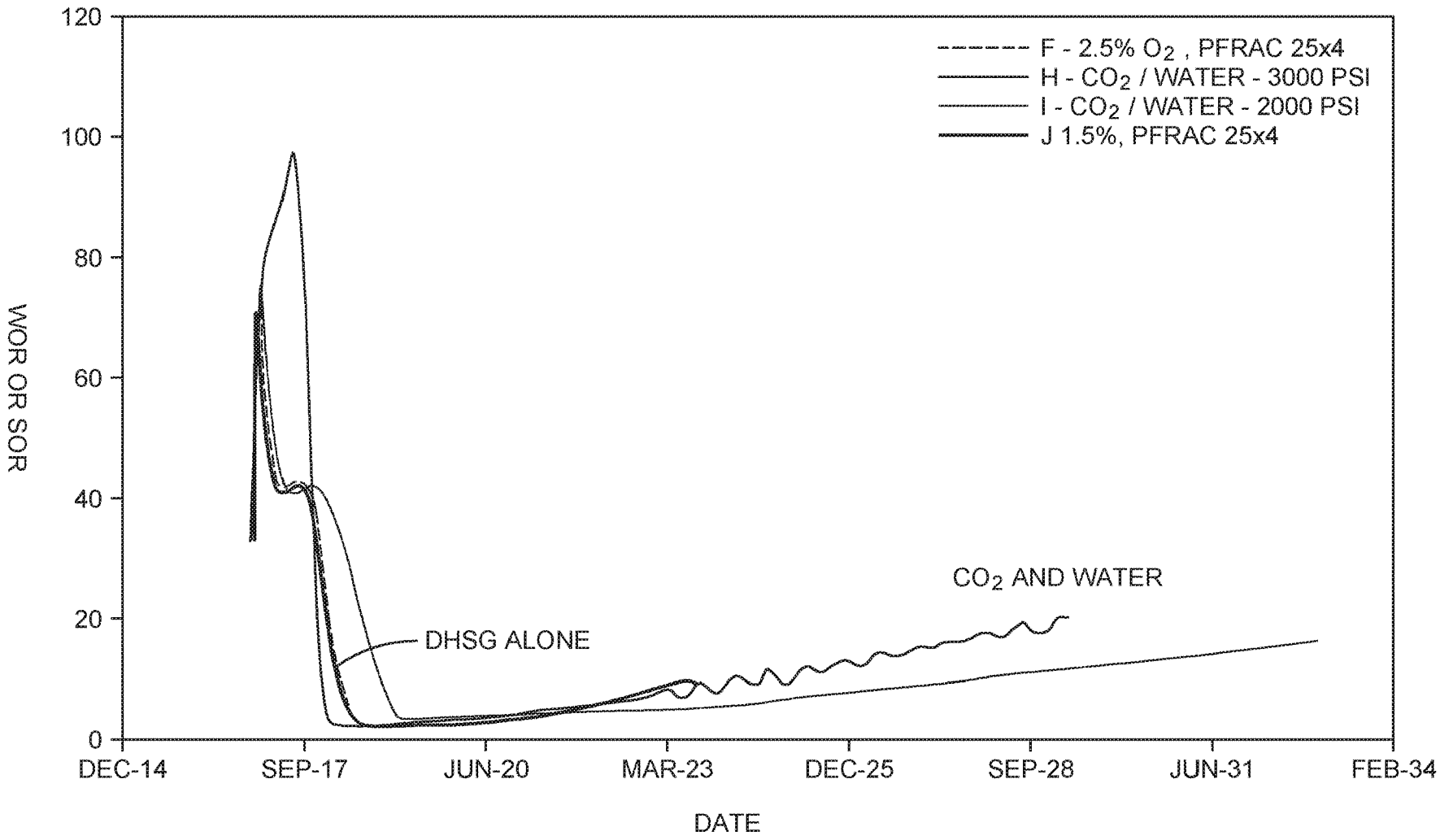
FIG. 23 is a graph showing water-to-oil ratios and steam-to-oil ratios for several $CO_2$, $CO_2$/water and downhole steam generator simulations.

FIG. 23 illustrates how the steam-to-oil ratio limit of 10 limits how long a downhole steam generator can be used while $CO_2$ and water can be used at much higher WOR. So, $CO_2$ and water can produce oil longer and therefore will produce more oil than a downhole steam generator will.

Finally, FIG. 24 illustrates that the steam injection rate is higher at 2,000 psi than the water injection rate. However, more fluid can be injected at 3,000 psi. This is a major reason for the 60% higher oil production rate with 3,000 psi $CO_2$/water then 2,000 psi downhole steam generator.

If steam and CO2 from a downhole steam generator were modeled at a higher injection pressure, more oil production would be predicted, because more fluid would be injected. However, this is not practical, because 3,000 psi steam is nearly supercritical, has about half the enthalpy of 2,000 psi steam and must be made from ultrapure water because the liquid phase disappears. Thus, supercritical steam is only used in closed loop systems such as high-pressure steam power plants.

Effect of Infection Rate

The steam and water injection rates in FIG. 24 are only high for a short period of time since the injection pressure is limited to 2,000 psi. Then the injection rate falls up to 80%. This decrease is within the turndown range of a downhole steam generator. However, hypothetically, maintaining a lower rate for a longer time might be an easier operation to sustain. So, FIGS. 25 to 26 assess how this change in operating method affects the process.

Figure 25:
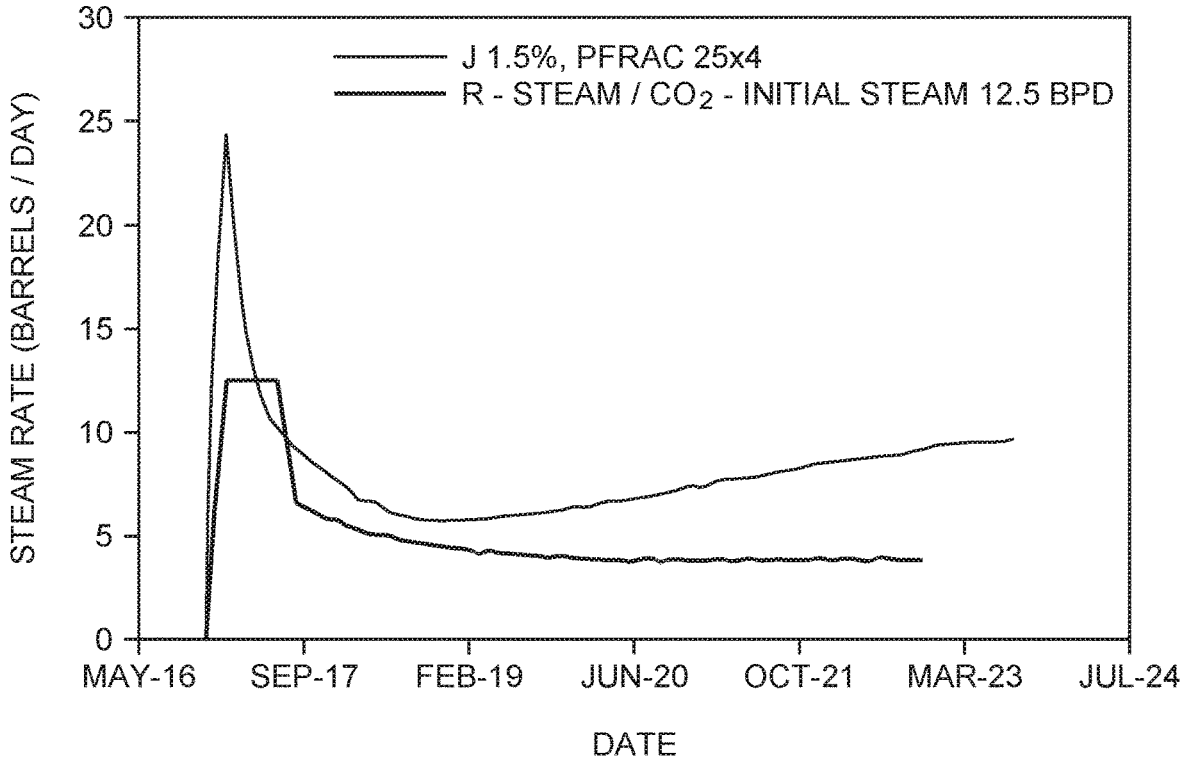
FIG. 25 is a graph showing steam injection at different initial rates.
Figure 26:
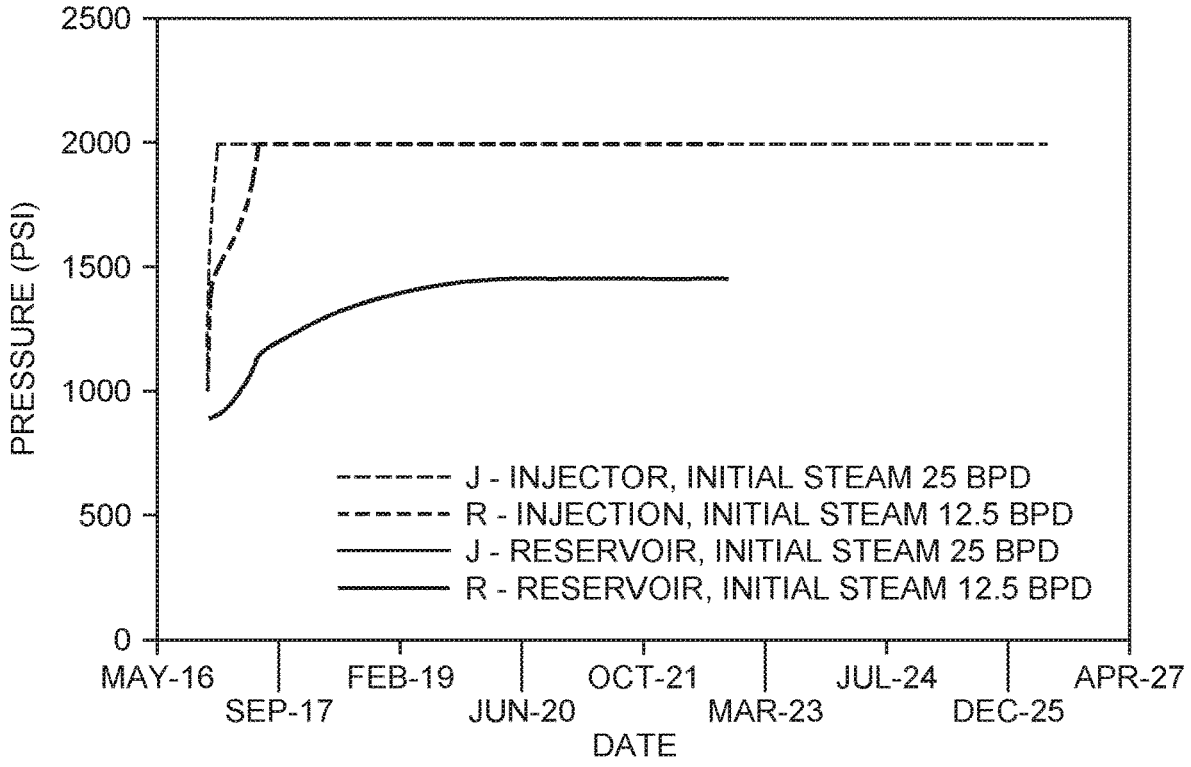
FIG. 26 is a graph showing bottom hole and reservoir pressure with varying initial injection rates.

FIGS. 25 and 26 show how a reduced initial steam injection rate affects the subsequent injection rate and the reservoir pressure. FIG. 25 shows that reducing the initial injection rate also decreases injection later in the project. FIG. 26 shows that the reduced initial injection rate and lower injection rate after a few years also results in at least 100 psi reduction in average pressure of the model. This lower pressure increases resistance to injection because the matrix transmissibility is lower (fractures not expanded) and feeds back to cause the lower injection rate in FIG. 25.

Figure 27:
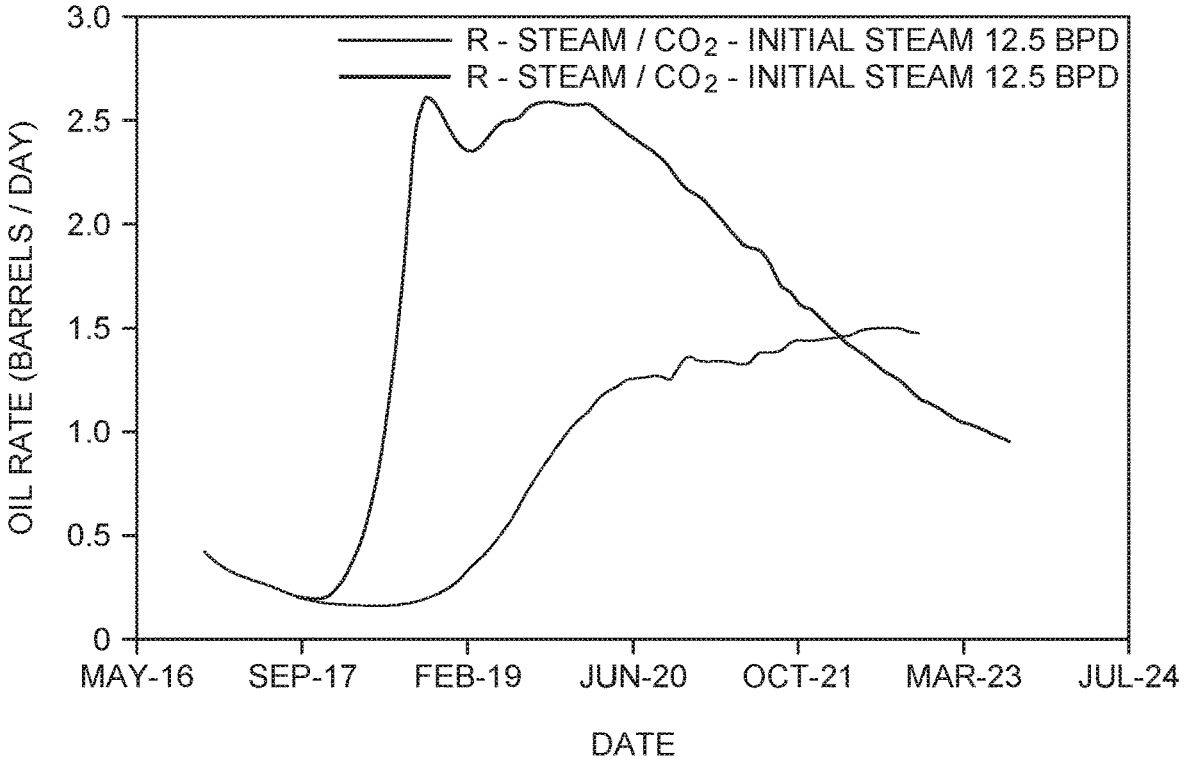
FIG. 27 is a graph showing oil production with varying initial injection rates.

FIG. 27 shows that not only is the maximum oil production rate reduced but it is delayed by several years. The result is that approximately only 50% as much oil is produced if the initial injection rate is reduced. This happens because much less fluid is injected as was shown in FIG. 25. Thus, keeping the initial steam injection rate as high as possible is important.

The drastic reduction in steam injection and oil production in the low pressure simulation is caused by having less dilation of the induced and natural fractures in the model. Dilation is expansion of pores or fractures that occurs when the pressure rises. This results in an increase in permeability and the fluid injection rate. A more complete description of dilation is presented below.

In the current model this is controlled by the formation fracture pressure (PFRAC) function. As noted at the end of section 2, PFRAC controls a linear increase of fracture transmissibility (resistance to flow between cells) with increasing pressure. The function is reversible so that a decreased pressure results in more resistance to flow.

Combining Downhole Steam Generator and $CO_2$/Water

The best and simplest method of EOR for the Bakken shale appears to be water and $CO_2$ injection. However, two factors may prevent this from happening. One factor is that the matrix permeability of the Bakken shale needs to be increased to accelerate oil production and the mobility of water. Another factor includes the availability of carbon dioxide. Having enough $CO_2$ to have a significant impact on Bakken oil production may not be available in North Dakota and Montana, because natural sources are far away, and the Bakken is so large.

Using a downhole steam generator solves both of these problems because of one or more of the following.

Matrix porosity and permeability in the treated zone near an injector are both increased by decomposition of kerogen as a result of the heat supplied by the downhole steam generator and this improves the injectability of all fluids.

Additional oil and CO2 are generated by pyrolysis of kerogen or combustion with excess O2 from the downhole steam generator.

CO2 is generated by a downhole steam generator that can be used in CO2 EOR

However, as shown earlier, the CO2 must be co-injected or water/gas injected (WAG) with very pure water and should be used after several years of stimulation with a downhole steam generator to be most effective.

Thus, using a downhole steam generator for several years to stimulate increased permeability of the Bakken shale matrix and generate CO2 is a viable solution. FIGS. 28 through 37 show how this is accomplished.

Figure 28:
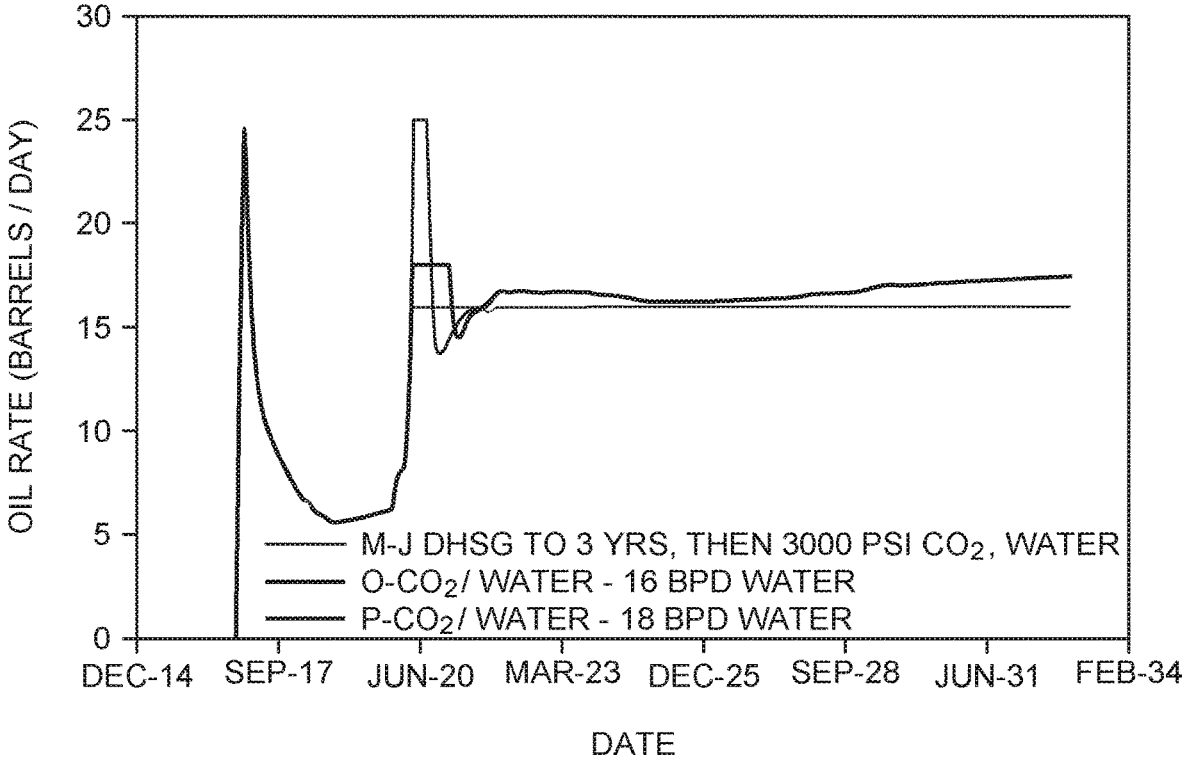
FIG. 28 is a graph showing water injection rates following steam injection at high rates.
Figure 29:
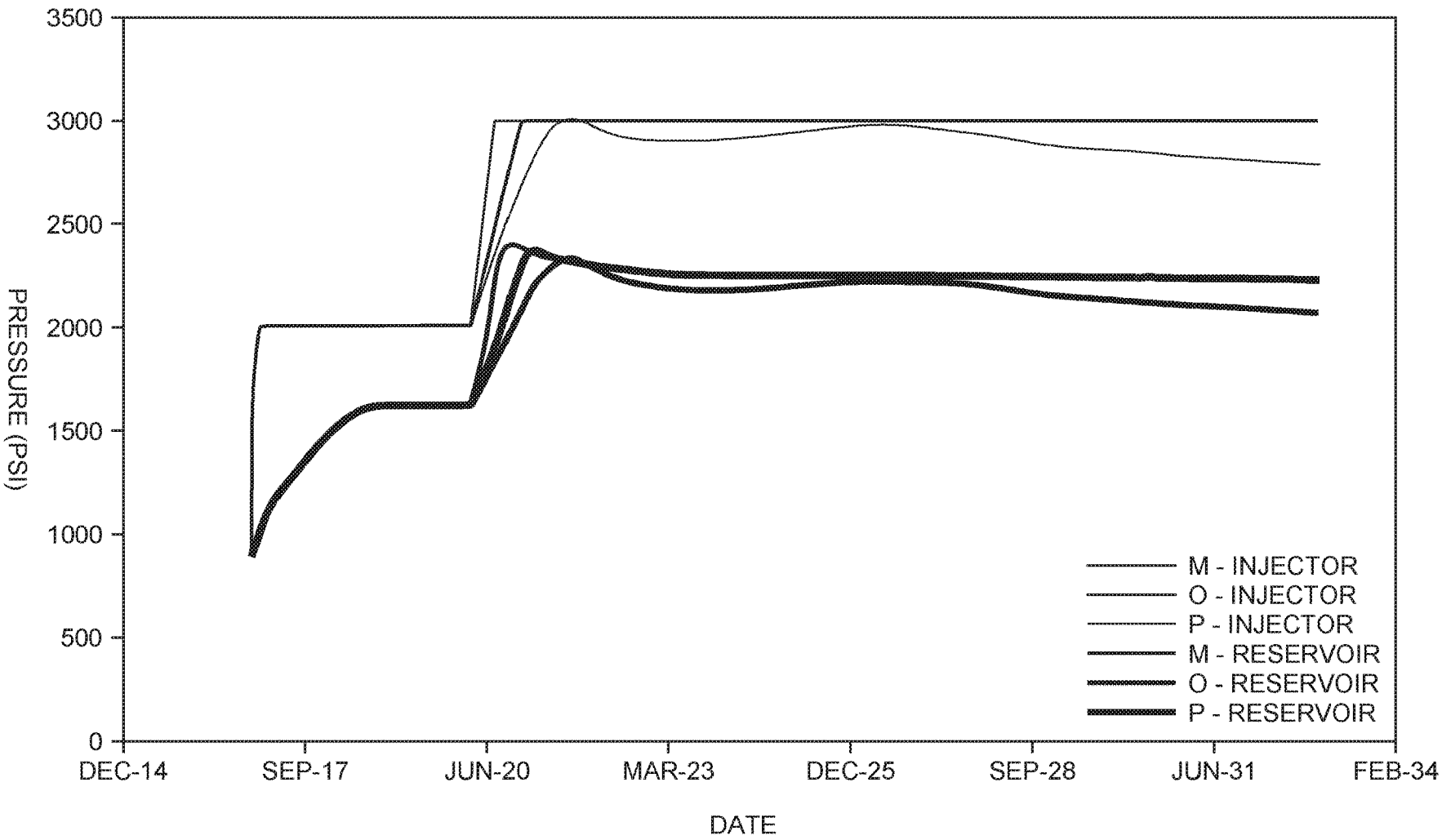
FIG. 29 is a graph showing bottom hole and reservoir pressure following high rate steam injection.

FIGS. 28 and 29 compare water injection rates and pressure at the injector and in the model, respectively, for CO2 and water injection following three years of steam and CO2 injection from a downhole steam generator. The maximum water injection rates during the CO2 phase of the project are 25, 18 and 16 barrels per day. The lower rates were chosen because they would have very little effect on the average fluid injection rate, injection pressure or average pressure of the model.

Figure 30:
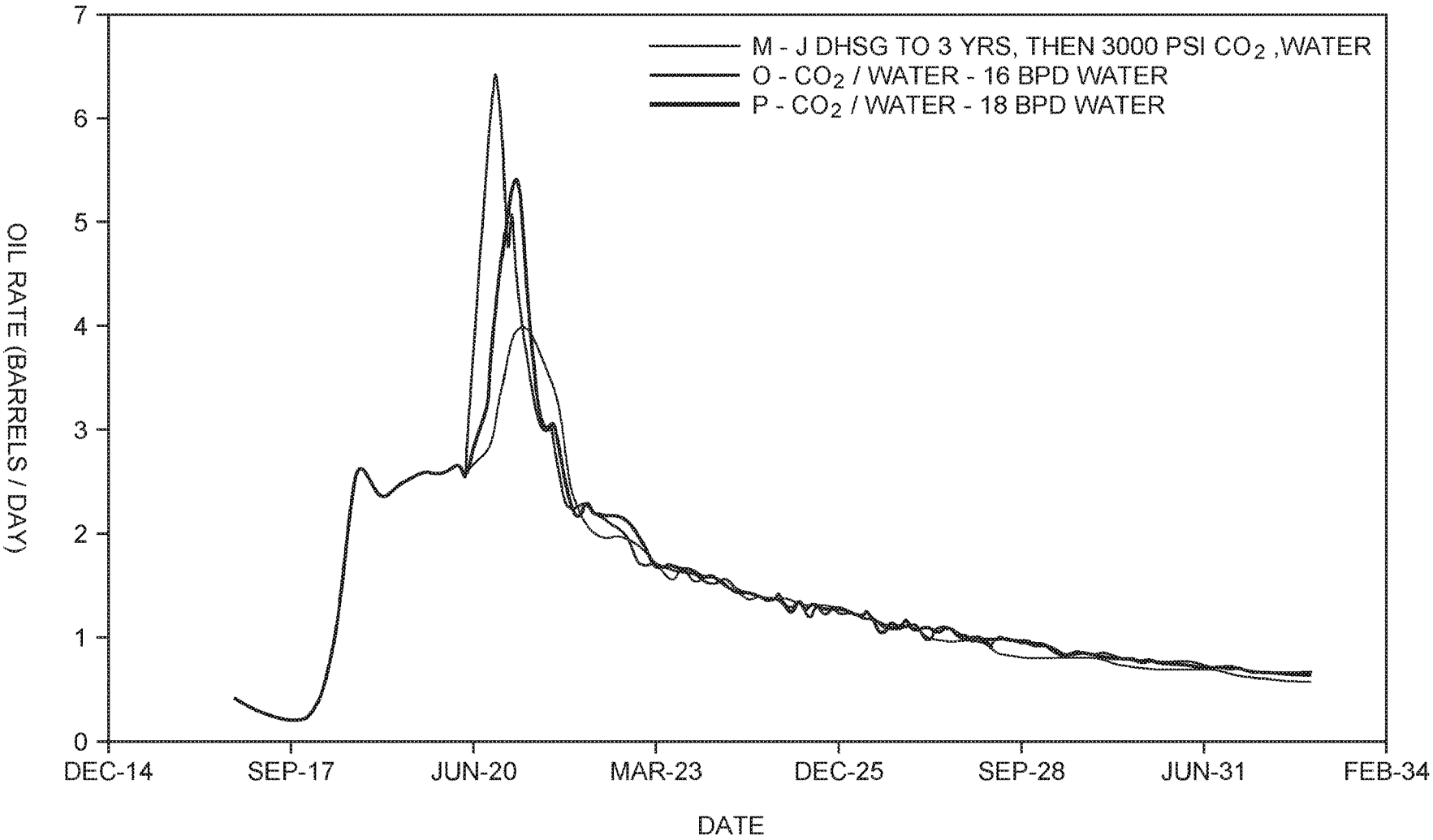
FIG. 30 is a graph showing oil production following steam injection.

FIG. 30 presents the oil production rate for the three simulations. The only significant difference in the three simulations is that the peak production rate in June-20 has decreased because the maximum injection rate is lower.

Figure 31:
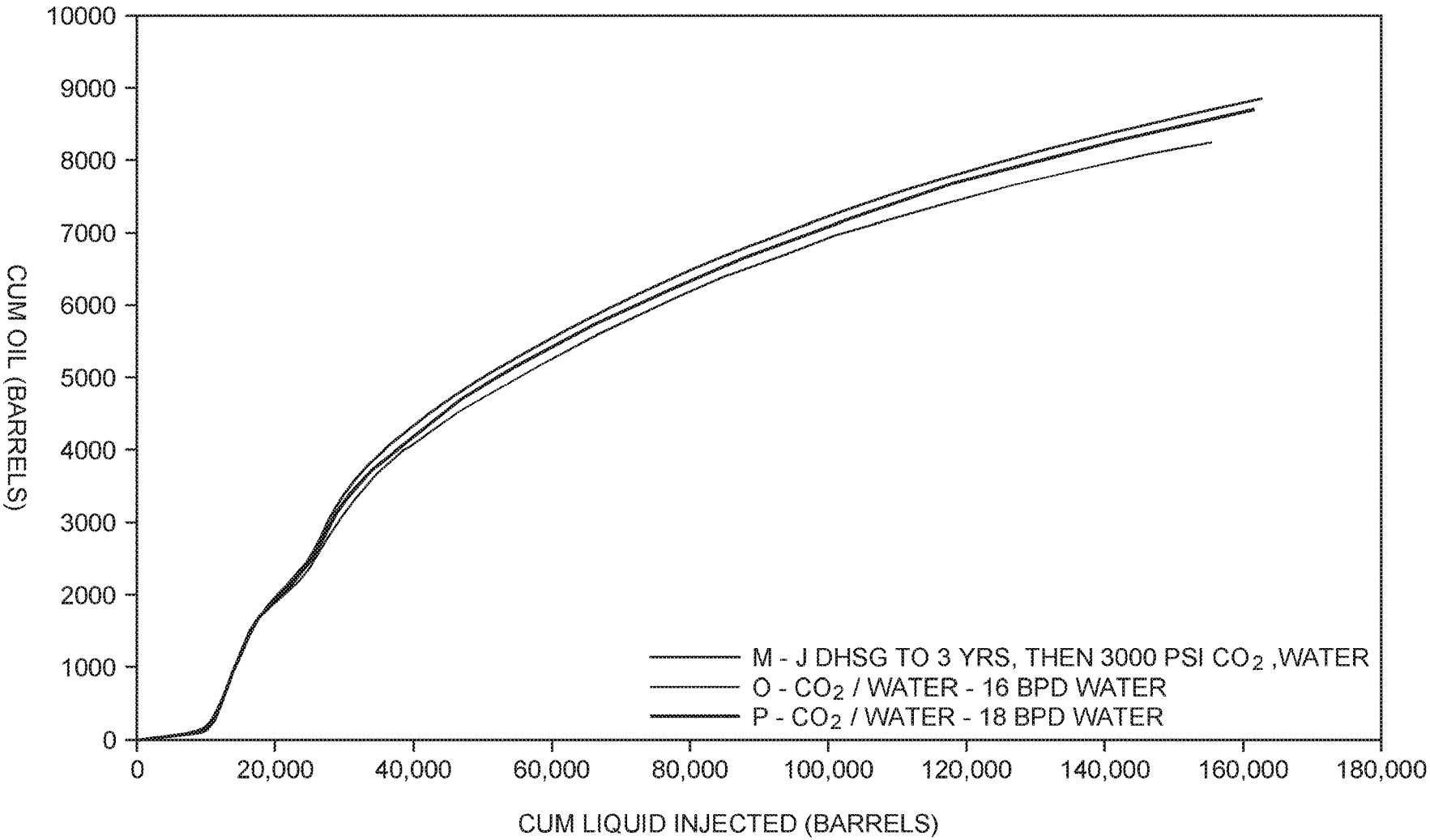
FIG. 31 is a graph showing oil production versus cum liquid injected following steam stimulation.
Figure 32:
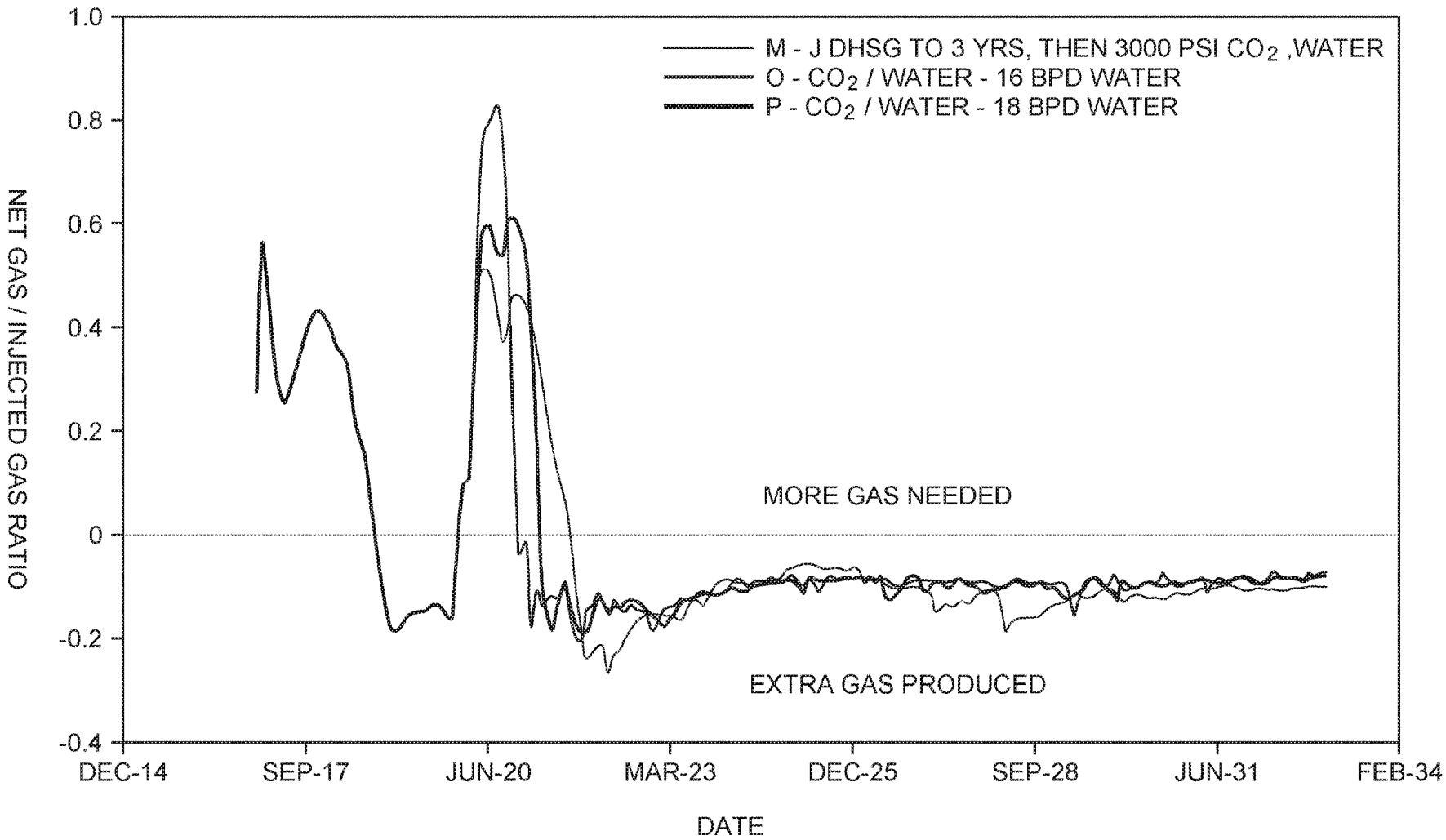
FIG. 32 is a graph showing gas injection ratios following high rate steam injection.

FIGS. 31 and 32 are plots of cum oil versus cum fluid injected and the net gas injection ratio, respectively. FIG. 31 shows that slightly less oil is produced when water is injected at 16 barrels per day than at the higher rates. This is expected performance since injecting CO2 and water at a lower rate just means the production is delayed but not lost.

The delay might be both acceptable and necessary since purchase of large amounts of $CO_2$ might be difficult. Then injecting CO2 and water at a lower rate could be the correct strategy if production is only delayed and not lost.

FIG. 32 shows that the purchased CO2 needed when switching to the higher pressure CO2/water injection mode decreases from 80% of the injected gas to 45% when the initial rate is decreased from 25 bpd per sector to 16 bpd. When the initial rate is decreased to 12.5 bpd only 25 percent of the gas needs to be purchased when switching to the high pressure $CO_2$ injection mode. Thus, it is likely that a $CO_2$ and water injection rate gradient can be selected that will not require additional $CO_2$ at the start of the high pressure injection. Thus, while high steam injection rates are needed to stimulate more pyrolysis and new fractures initially, there appears to be more flexibility to adjust the injection rates later when water rather than steam is being injected.

In some embodiments, stimulating kerogen rich shales with steam and $CO_2$ provided by a down hole steam generator could be a viable and cost efficient means of greatly increasing ultimate oil recovery from major worldwide resources. Production from the shale increases because pyrolysis of kerogen with high temperature steam increases the porosity and permeability of the matrix around the existing and induced fractures. The higher permeability facilitates injection of even more fluid and the process accelerates. Oxidation of kerogen and pyrolysis oil by surplus $O_2$ in the exhaust of the downhole steam generator generates energy in situ and additional $CO_2$. Pressure in the shale's matrix is increased locally due to creation of gas and oil. This causes micro-fractures in the matrix that increase the permeability and allow migration of fluids to natural or induced fractures, so that oil and gas can be produced. Condensed steam helps disperse the $CO_2$ and other gases throughout the shale and prevent gas bypassing the shale. After a few years of stimulation with a downhole steam generator, wells in an integrated project are producing enough $CO_2$ to begin to switch to co-injection or WAG of $CO_2$ and water. This can be done at higher pressures than steam can be effectively used. Higher pressure co-injection of the miscible $CO_2$ and water should nearly double the incremental oil production expected for steam and $CO_2$ because the economic limit of GOR from a water gas displacement is much higher than the economic SOR for steam injection.

One component of the process is using a downhole steam generator to generate high temperatures with steam to generate more micro-fractures in the shale matrix due to the local high pressure created when kerogen decomposes into oil and gas. In addition, additional oxygen can be added to the exhaust gas to generate even more energy from unpyrolyzed kerogen and non-volatile bitumen.

Kerogen and heavy oil pyrolysis at high temperatures is well known since anaerobic pyrolysis of kerogen is the source of oil and natural gas. The method proposed in this study is to use the energy in steam to heat kerogen to temperatures high enough for kerogen to decompose in a few months. Experience with other pyrolysis processes such as Colorado oil shale suggest that the following four types of reactions happen. 1) Kerogen converts to heavy oil and gas and coke where the gas can include N2, CO, CO2, H2S and light hydrocarbon gases including olefins. 2) Heavy oil converts to coke and light oil and hydrocarbon gases and H2S. 3) Light oil converts to hydrocarbon gases. 4) Water and oils or gases converts to CO+H2.

Most of the industry's conventional experience with in-situ kerogen pyrolysis is for thermal conduction projects with temperatures approaching 700° F. Energy was supplied by electrical resistance heaters. Thermal conduction has the advantage of transferring energy without convection if necessary when there is no permeability. Others have completely modeled kerogen pyrolysis with a series of 10 to 30 chemical reactions operating in parallel, if several months were spent to generate a field-specific model.

In contrast, the method as described herein utilizes a downhole steam generator which may optionally add $O_2$ to promote combustion of hydrocarbons in the vapor phase and add extra energy to the process.

Figure 33:
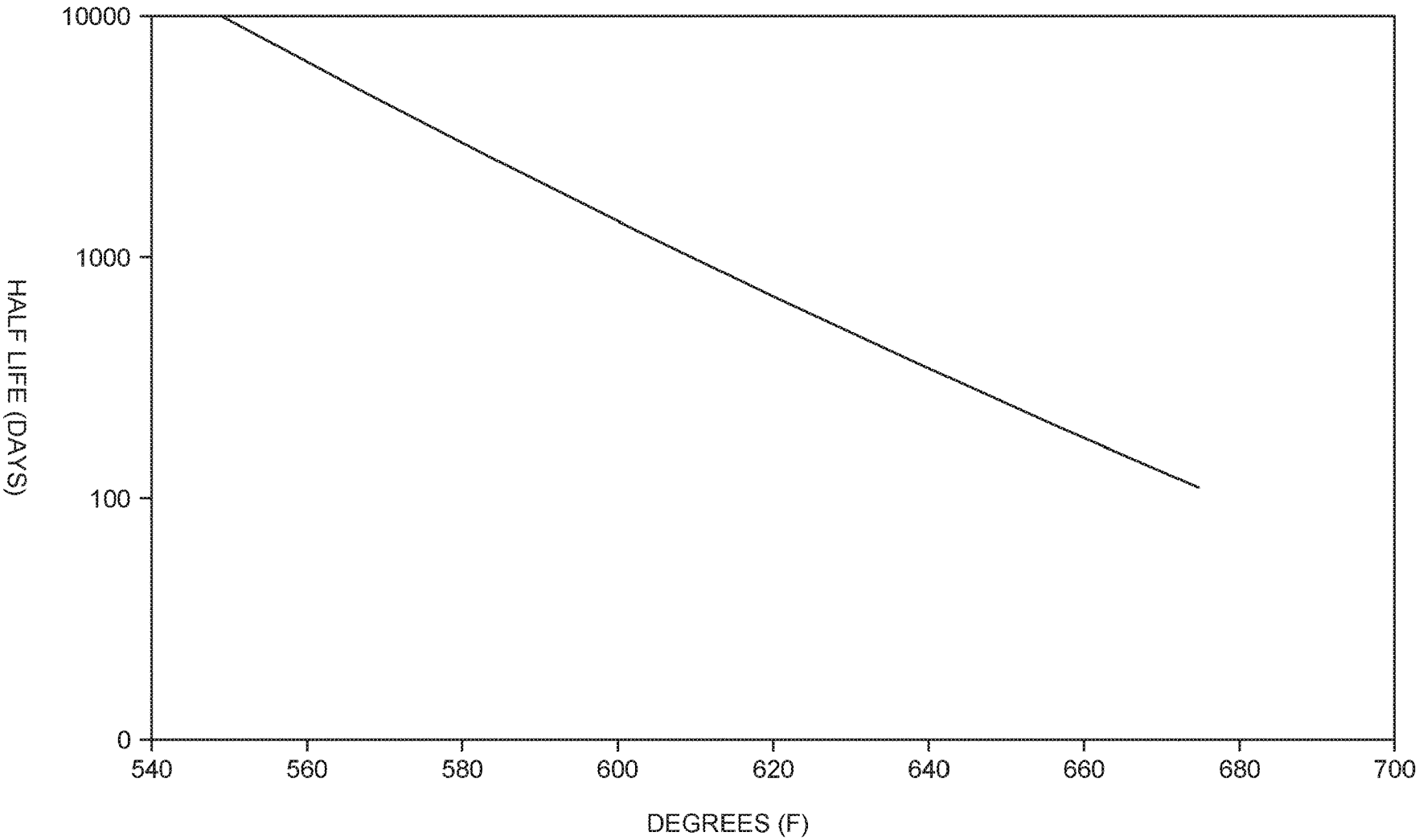
FIG. 33 is a graph showing kerogen half-life in pyrolysis reaction model.

Since the purpose of this modeling was to determine the potential of steam powered kerogen pyrolysis, the reactions in this model were limited to two pyrolysis reactions (kerogen and heavy oil) and three (kerogen, heavy oil and light oil) combustion reactions. FIG. 33 presents the time in days needed for 50% of the kerogen in a cell to decompose as a function of temperature. The figure shows that at 600° F. temperature for approximately 1500 days are needed for 50% of the kerogen to decompose. At 550° F. about 1,000 days are needed. At 700° F., a typical commercial oil shale retort pyrolysis temperature for only 50 days are needed. While the steam based process is slower than the commercial process, the results previously presented show that enough kerogen is decomposed to dramatically change the porosity and permeability of the matrix rock in a practical time period. Because high temperatures accelerate pyrolysis reactions, this process will generally be applied while controlling pressure at nearby producers in order to keep the temperature (and pressure) of the steam high.

Micro Fracture Formation

Micro-fractures are known to be very important to the mass transfer in shale. In the absence of open micro-fractures, only free and associated gas can be produced from the matrix of a shale and that propped micro-fractures opened during hydro-fracturing will be the main source of oil and gas production from a shale matrix. The process described in the previous sections is essentially to open the micro-fractures by thermally generating gas from the kerogen. The energy needed to do this comes from steam injected from a downhole steam generator. The movement of the higher temperature front into the shale is accelerated by thermal conduction of the heat ahead of the steam front. When kerogen decomposes, micro fractures form from locally higher pressure that result from decomposition of the kerogen into oil and gas.

According to embodiments disclosed herein, a downhole steam generator is utilized to provide a controlled source of energy (steam and $O_2$ to reinitiate the suspended pyrolysis of the source rock) and drive fluids, initially condensed steam and $CO_2$, and later water and $CO_2$, to produce a higher fraction of the hydrocarbons generated from the original and reinitiated pyrolysis of kerogen.

Figure 34:
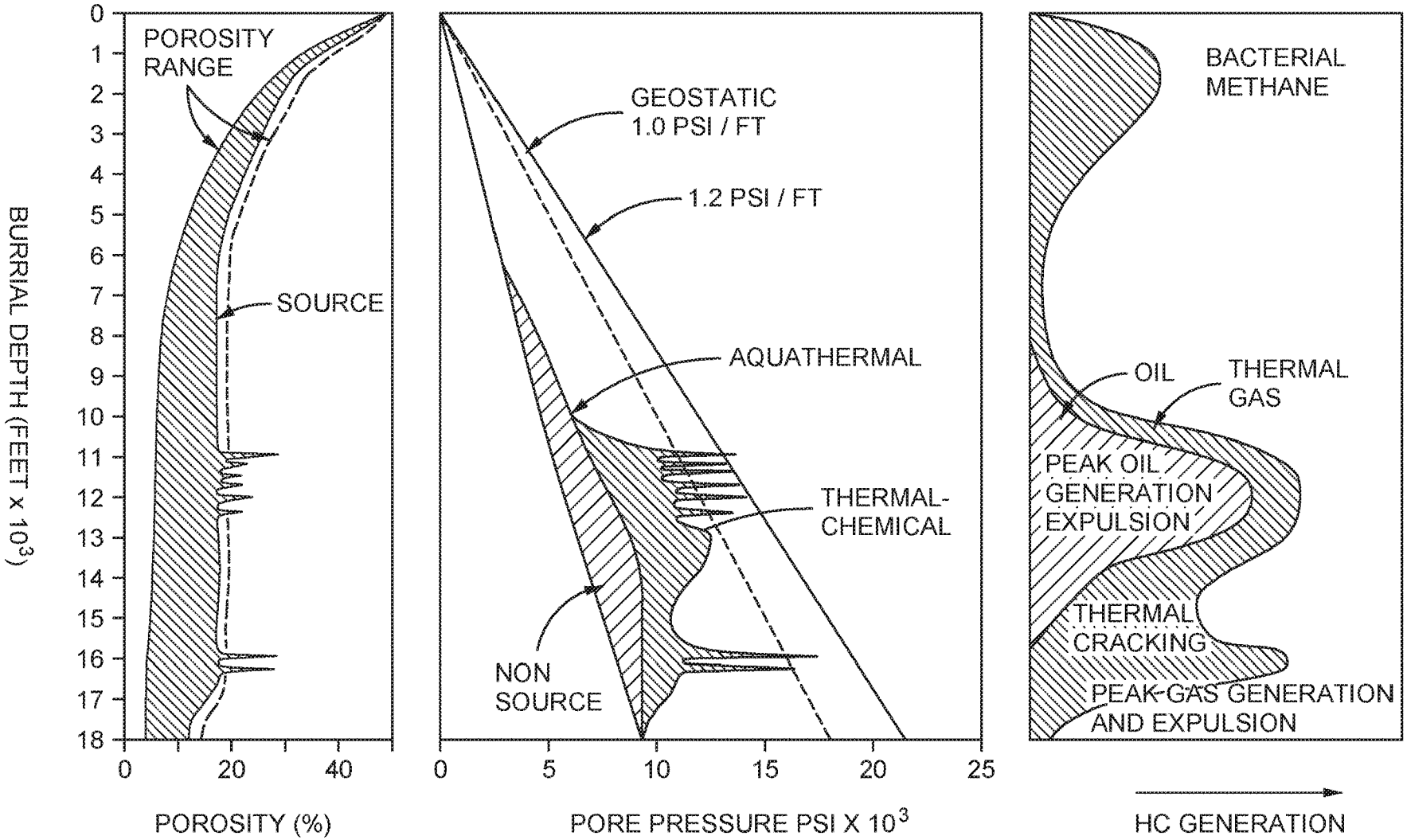
FIG. 34 is a graph showing porosity, pore pressure and hydrocarbon generation in source rocks.

FIGS. 34, 35A, 35B and 36 summarize several aspects of diagenesis and pyrolysis. FIG. 34 summarizes hydrocarbon generation, pore pressure and porosity versus depth for the Bakken shale. The important features in the figure are between 11 and 15 thousand feet burial depth (4,500 to 6,500 psi). Kerogen has slowly pyrolyzed here at a low temperature over geologic time. We will reinitiate and finish the pyrolysis at high temperature according to embodiments disclosed herein.

The middle (pore pressure) curve shows that thermal-chemical reactions cause the pore pressure to exceed the geostatic pressure gradient when enough oil and gas are generated. This creates zones of higher porosity that are shown in the left (porosity) plot. Some areas which may have had high generation of hydrocarbons (generation plot on the right) did not exceed the geostatic gradient, so the porosity did not increase. Perhaps the pressure did not exceed the geostatic gradient because natural fractures allowed the oil and gas to escape.

Figure 35A:
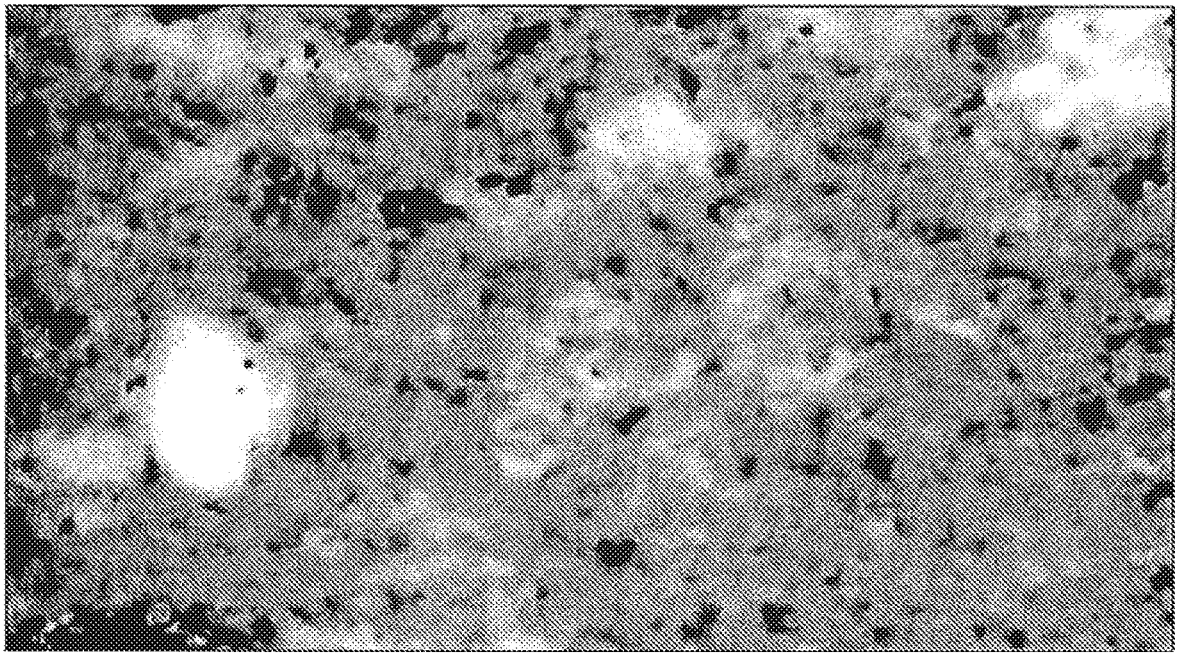
FIG. 35A is a magnified schematic depiction of portion of a formation prior to pyrolysis.
Figure 35B:
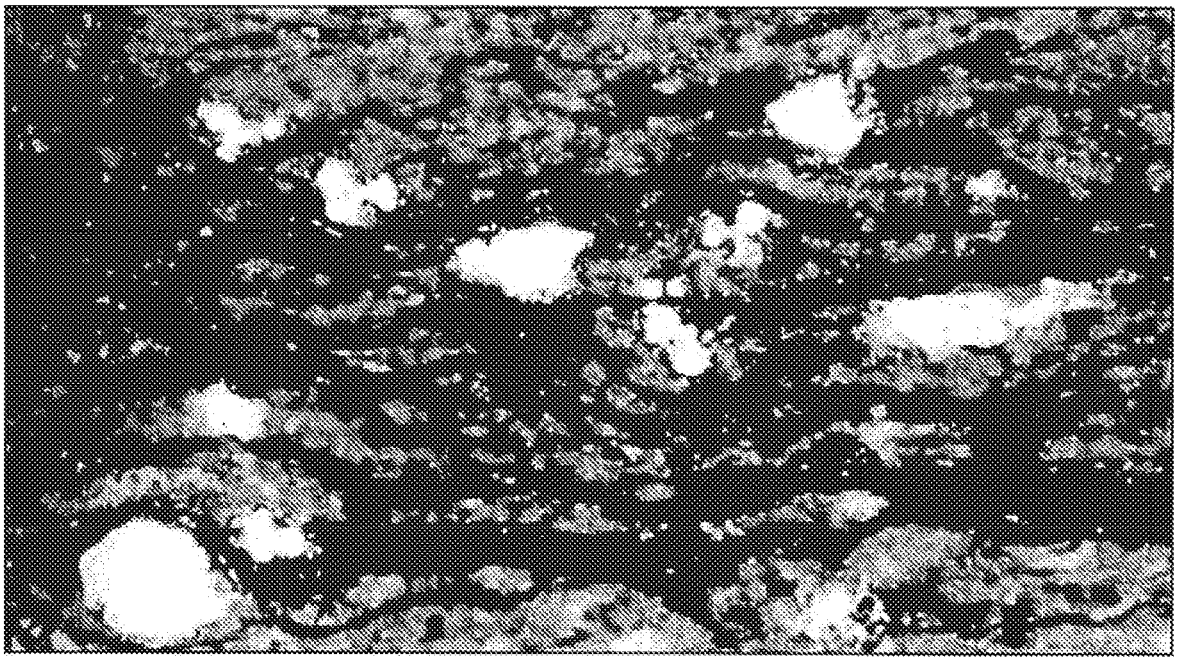
FIG. 35B is a magnified schematic depiction of portion of a formation after pyrolysis showing connections with adjacent fractures.

FIGS. 35A and 35B illustrates the formation of oil or bitumen filled fractures in the Woodward shale. In this example, fractures (dark areas) have formed and filled with bitumen from lower temperature pyrolysis of the shale. The fractures are aligned with the bedding planes of the shale, so there is good horizontal permeability but limited vertical permeability. This should work to the advantage with the process for shale pyrolysis as disclosed herein since the gas that is generated or injected does not rise immediately to the top of the formation and cause poor sweep.

Figure 36:
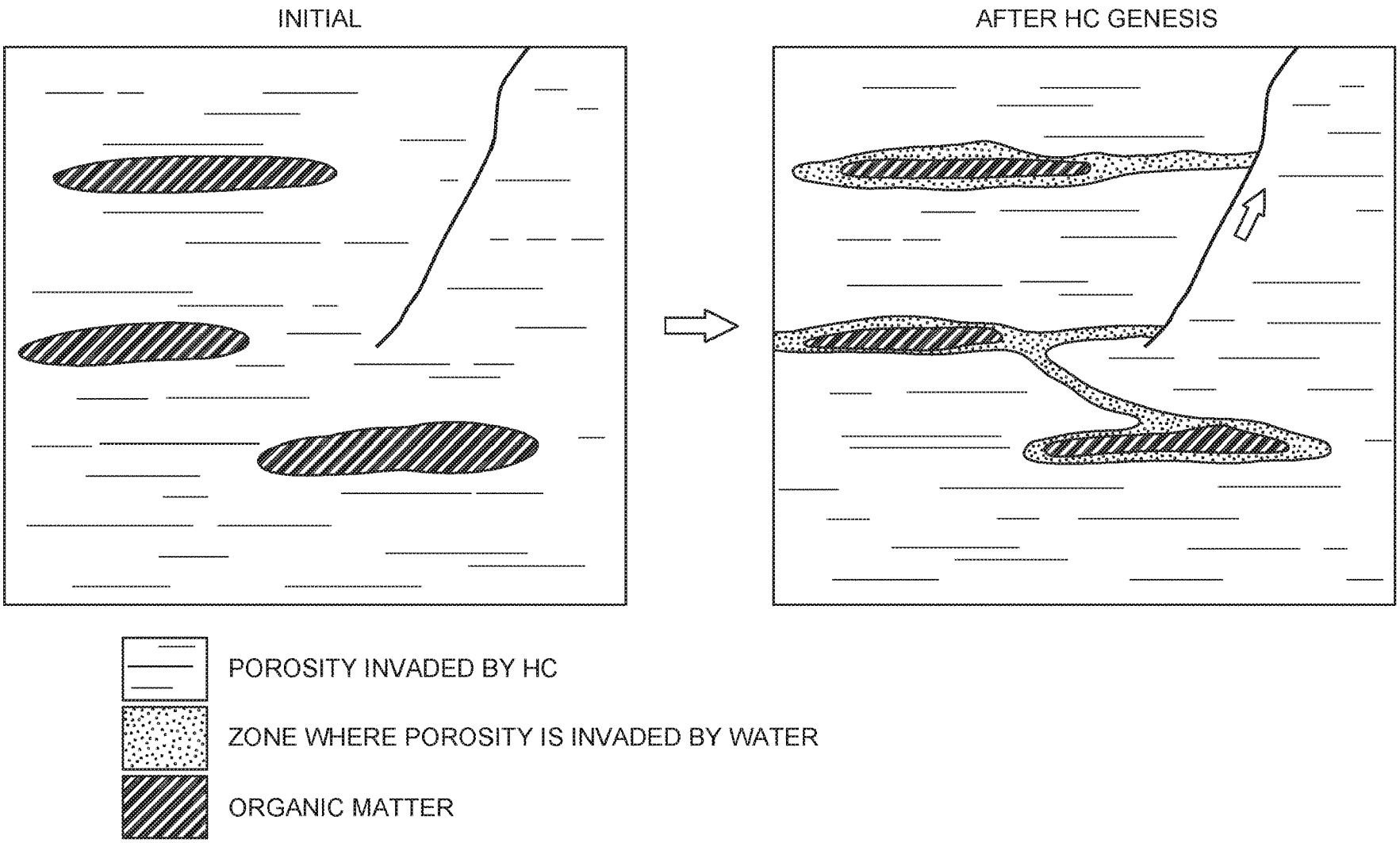
FIG. 36 is a schematic depiction of portion of a formation showing an isolated existing fracture surrounded by isolated locations filled with kerogen that is further fractured to increase the porosity of the formation after the kerogen has decomposed according to embodiments disclosed herein.

One mechanism for upward migration of hydrocarbons from post pyrolysis fractures is through existing fractures. FIG. 36 illustrates this point. The figure on the left in FIG. 36 shows an isolated existing fracture surrounded by isolated locations filled with kerogen. The figure on the right shows that the porosity has increased after the kerogen has decomposed. The post pyrolysis fractures now connect with the existing fracture and, in an unconventional reservoir, with the hydraulic-fractures.

The process may be summarized by one or a combination of factors. Kerogen pyrolysis which opens micro-fractures in bedding planes; much of the kerogen decomposes to gas which may cause pressure increases and expansion of the micro-fracture. When the gas escapes, pressure decreases and the micro-fracture shrinks, but it does not completely collapse since the kerogen decomposition has left a void. Then oil and gas can migrate and accumulate or be produced elsewhere.

The process outlined above is to enhance and increase the post pyrolysis fractures created by steam and $CO_2$ so that the permeability of the matrix increases. Then, there is enough connectivity in the reservoir through the three types of fractures to produce a large fraction of the oil and gas by co-injection or WAG of water and CO2.

Embodiments disclosed herein should demonstrate that steam and CO2 supplied by a downhole steam generator can reinitiate the pyrolysis that generated the original oil and gas found in the shales, such as the Bakken shale. The micro-fractures, higher porosity and permeability which are generated in the heated zone make injection of water and $CO_2$ into the shale easier and should allow operators to produce much more oil than are produced by current primary production.

Studies have shown that the Bakken shale really is three stacked formations which may not be isolated from each other. In order of increasing depth these are the Lodgepole, the Bakken and the Upper Three Forks formations. Each of these formations has several members. For example, the Bakken shale includes the Upper, Middle and Lower Bakken members. The upper and lower Bakken members are shales with high total organic content (TOC) and very low permeability, while the Middle Bakken contains several layers of modest permeability rock, free oil and low TOC. The many types of rock and shale in the stratigraphic column have permeabilities that differ by several orders of magnitude. Simulations suggest steam with $CO_2$ and surplus $O_2$ will perform well in actual shales as long as they are hydraulically fractured.

Steam from a downhole steam generator may increase the porosity of shale reservoirs and enhance the injectivity of fluids due to decomposition of kerogen. Moreover, geochemical literature shows that decomposition of kerogen creates micro-fractures in the shale which increase its permeability. In addition, the embodiments disclosed herein show that enough excess $CO_2$ is generated with a downhole steam generator to switch to an integrated water/$CO_2$ co-injection project at higher pressure after several years of steam/$CO_2$ injection.

In one embodiment, injection of steam and $CO_2$ with the downhole steam generator for up to three years in Bakken reservoirs. The time may be different in different shale oil reservoirs. The injection rate of the steam and CO2 should be as high as possible even if that volume can only be injected for a few months. The injection rate could continue at the maximum pressure at which the downhole steam generator can be operated until either: enough excess $CO_2$ is being created and produced at the well, or nearby wells, to switch to higher pressure water/$CO_2$ co-injection; or the oil production rate resulting from the downhole steam generator begins to decline.

Then, the production wells could be operated with a back pressure high enough to maintain high temperature at the injection wells. In the Bakken, if possible, inject in Bakken wells and produce from Three Forks wells. Finally, switch to water/$CO_2$ (WAG) co-injection at higher pressure. Gradually increase the WAG injection rate and injection pressure as more produced $CO_2$ becomes available from wells in the area.

Eventually inject $CO_2$ and water at the highest practical pressure which can be used without fracturing the formation. Continue co-injection of water and CO2 all produced gas with water until the gas-oil ratio is high. At this time, the down-hole steam-generator is the only practical tool for delivering enough energy to deep shale to reinitiate pyrolysis and stimulate additional oil production. Therefore, the results presented above could be very valuable.

While this modelling focused on the pseudo-middle Bakken, the results should be applicable to other lite oil reservoirs. The parameter limiting stimulating these shales may be the ability to inject fluids. This will mean that injection into high matrix permeability shales will be possible. However, application into nano-darcy matrix permeability shale could be impractical.

Alternative and/or Additional Embodiments

It may be preferable to not inject less fluid initially with the downhole steam generator. While this would improve utilization and mean that the downhole steam generator can operate with less turn down, less oil is ultimately produced with both the downhole steam generator and $CO_2$/water.

It may be preferable to not attempt to operate the downhole steam generator at 3,000 psi since this has poor thermodynamics, but it does have good micro-fracturing potential in the short term. From a thermodynamic basis, operation at approximately 2,000 psi, now appears to be the most practical operating condition, because the temperature is high enough for pyrolysis and delivery of total energy to the shale is nearly as high as is allowed by the thermodynamics of steam.

Operate the downhole steam generator with just enough excess 02 to generate CO2 for expansion. About 2.5% excess 02 is likely to be enough.

Switch to CO2/water co-injection at around three years and move the downhole steam generator elsewhere. This may be a good alternative because in some cases more gas is being produced than injected after two years even when $CO_2$ is being injected, i.e., recycle the $CO_2$ that is being produced.

Consider injecting $CO_2$ and water at a lower rate initially, after the downhole steam generator has been removed, to minimize the volume of $CO_2$ that must be purchased initially or transferred from other parts of the project.

Use very clean water or nothing will work because matrix permeability is low and the matrix could plug with tiny particles.

Evaluate, first with simulations, the benefits of high purity CO2 injection and using nearly pure O2 in a downhole steam generator versus a rich air or air fired downhole steam generator.

Collect and analyze data on shale oil reservoir kerogen pyrolysis kinetics and evaluate the effect of reservoir water and pressure on kerogen pyrolysis rates, mechanisms and products. Most kerogen pyrolysis data is taken with dried, water-free cores at pressures of a few hundred psi. However, use of the downhole steam generator at 2,000 psi should cause steam to condense. High pressure slows pyrolysis reactions but aqua-thermolysis accelerates reactions. So, kerogen pyrolysis data taken at more representative reaction conditions may be needed.

Investigate the effect of water gas shift reactions between coke (pyrolyzed kerogen residue), water vapor and $O_2$. This could be a significant source of energy for increasing the pyrolysis temperature or operating the downhole steam generator.

Evaluate the lower limit of permeability (below which not enough fluid can be injected to have a beneficial impact). The limit could by a few nanodarcies.

Dilation Model

Figure 37:
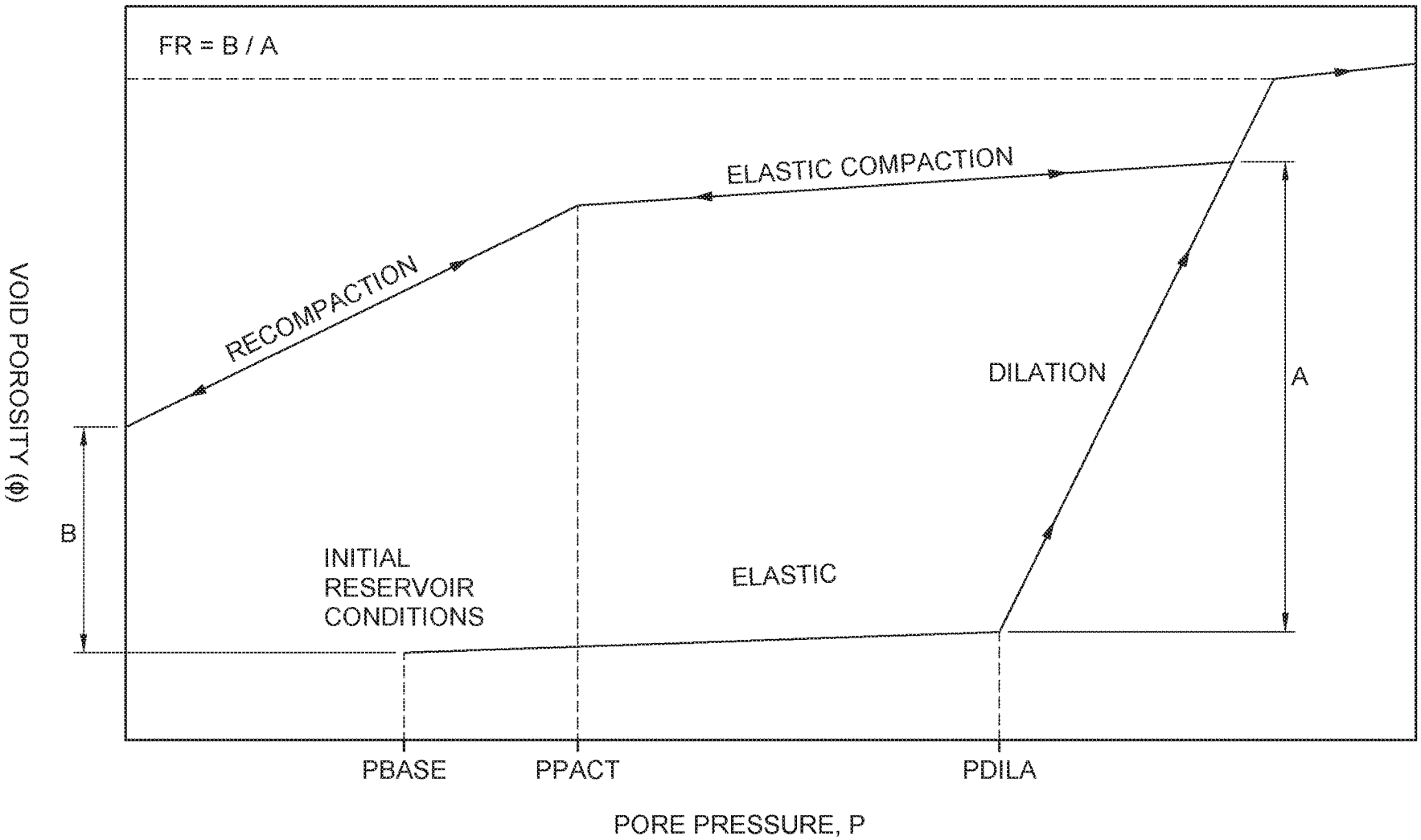
FIG. 37 is a diagram showing some dilation mechanisms.

Dilation of the existing fractures in shale and creation of micro-fractures in the shale's matrix can be thought of as expansion of a bellows, or balloon, when air is blown into them. After a balloon is expanded, it probably does not shrink back to its original size. This is shown in FIG. 37. The rock starts elastic expansion at initial reservoir conditions, i.e., at pressure PBASE. Elastic deformation occurs below the pressure PDILA. This is the equivalent of normal rock compressibility, a few microsips for hard rock (1 microsip=$1\times10^{-6}$ $psi^{-1}$=0.145 $GPa^{-1}$). Above the pressure PDIAL irreversible expansion takes place, i.e., the rock dilates.

The porosity of the rock or fracture expands substantially when the pressure is increased (A). When the pressure is reduced the rock can elastically compact above the pressure PPACT. Thus, the matrix or fracture can compact reversibly above the pressure PPACT. This is the ideal operating range if dilation occurs. Below the pressure PPACT, the fracture or matrix can irreversibly compact again. As the figure shows, while the compressibility is higher in this pressure range than in the initial elastic expansion, below PDILA, the rock or fracture does not recompress to its original condition. If the pressure increases, when it is below PPACT, the rock can elastically expand again at the compressibility shown by the dotted line in the figure.

Kerogen Pyrolysis

A simple description of pyrolysis kinetics explains why the model uses slower kinetics and compares reaction half lives for several types of shale.

When kerogen pyrolyzes, it first decomposes into bitumen as bonds break and release some gas.

Kerogen=>Heavy Oil+Gas+Coke

The heavy oil pyrolyses as the temperature approaches 400° C. (700° F.) into lighter oil, hydrocarbon gases, carbon oxides and H2S. This process is generally described with between 10 and 30 parallel chemical reactions. However, two or three reactions are all that is needed for the model as disclosed herein.

The rate of kerogen decomposition is described by the equation:

$$\text{Rate}=A\cdot e(-Ea/RT)\cdot\text{Concentration of kerogen}$$

Where A is a constant with units of moles/day, Ea is activation energy of the reaction, and R and T are the gas constant and temperature, respectively.

Figure 38:
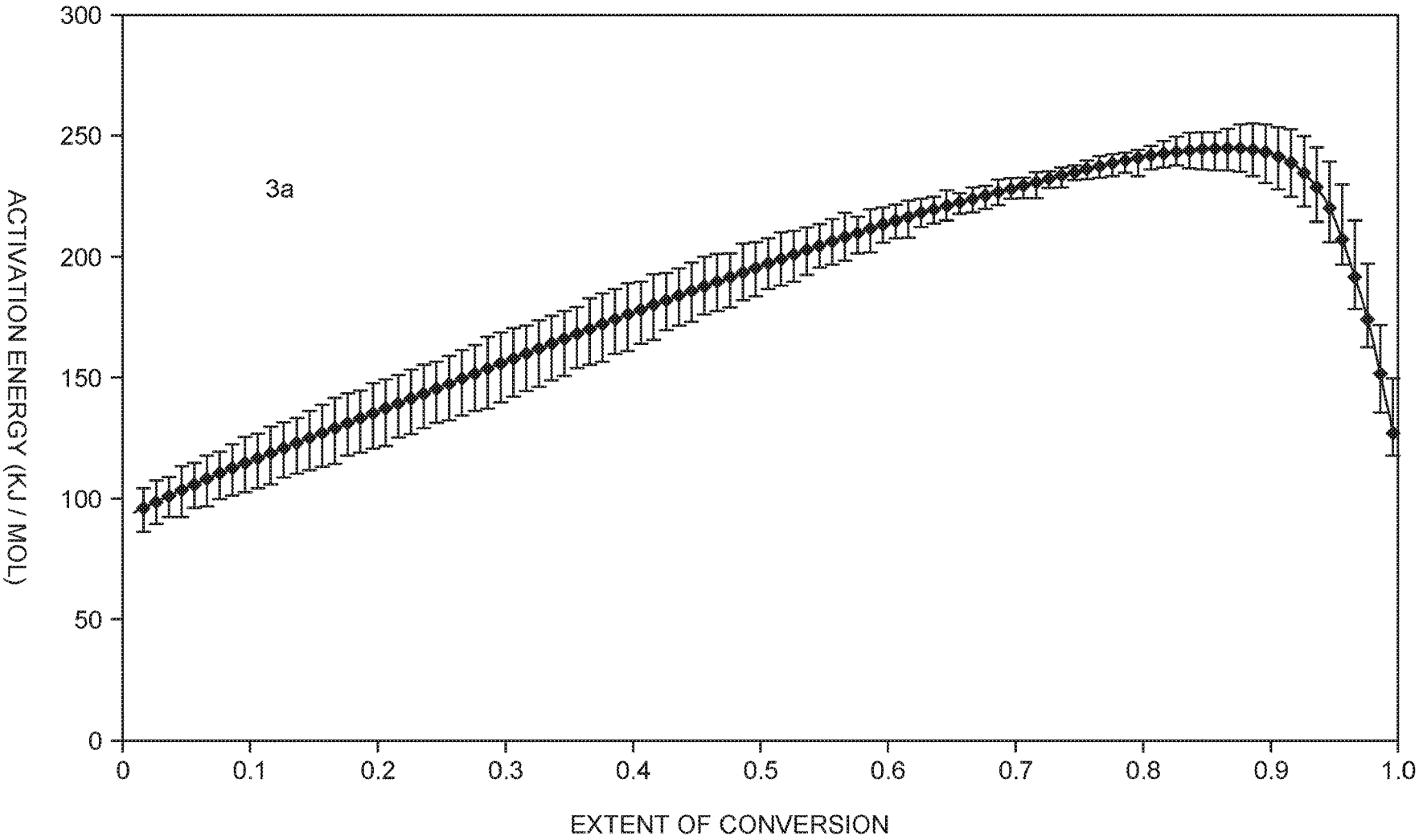
FIG. 38 is a graph showing distribution of activation energies in a formation.

While we do not have pyrolysis data for Bakken shale which has been pyrolized previously to form light oil, it is expected to be slower than for unpyrolized kerogen, since the light oil has already been cooked from the rock. This is shown in FIG. 38 below.

The figure shows how the activation changes with conversion of Green River kerogen. The activation energy increases from approximately 100 kJ/gmole to 250 kJ/gmole as conversion of kerogen to oil and gas increases. This means that the reaction slows down. So, we used an activation energy of 84,000 BTU/lbmole (195 kJ/gmole) in our model. This corresponds to approximately 60% conversion of kerogen.

Figure 39:
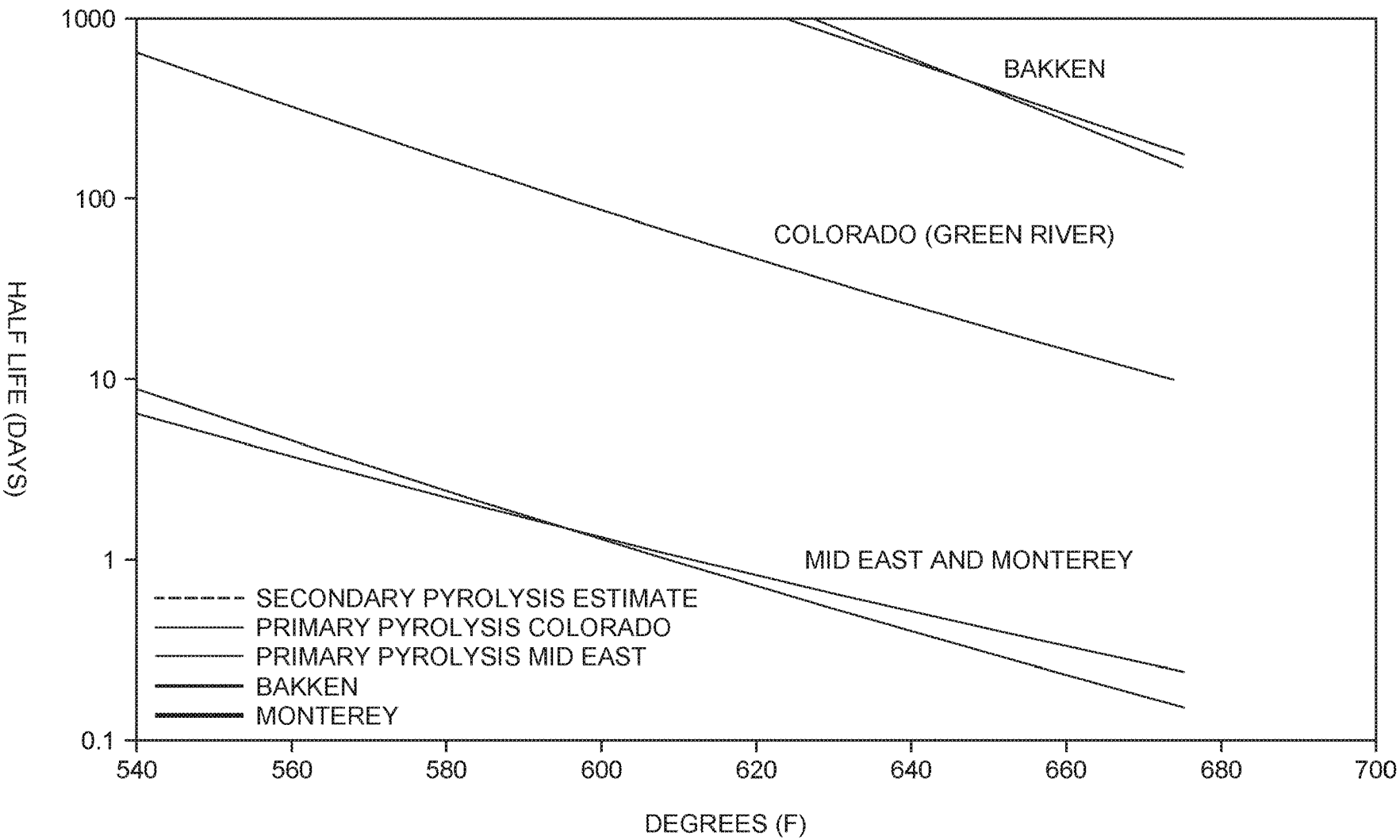
FIG. 39 is a graph showing half-lives of various kerogens versus pyrolysis temperature.

As shown in FIG. 39, pyrolysis rates may be compared by comparing the half live of kerogen for several types of kerogen. The half-life for a first order reaction is:

$$T50=0.69/(A\cdot e(-Ea/RT))$$

Where 0.69=ln(0.5).

The half-lives for our pyrolysis model are compared with two Green River pyrolysis rates and also with Bakken, Monterey and Mid Eastern results in FIG. 39. The Figure shows that all of the primary pyrolysis reactions are faster than that used for our model.

FIG. 39 has three groupings of data. The smallest half-lives are for Middle Eastern Shafela shale and Monterey shale with little previous pyrolysis and no free oil in these virgin shales. The Colorado data are from Shell's pilots where the shale had pyrolyzed enough to contain bitumen but no light oil. The Bakken half-lives are for shale where much of the kerogen has been converted to light oil. These comparisons suggest that low maturity kerogen is the best candidate for pyrolysis. However, there might not be free light oil in those shales.

Effect of Permeability on Injection Rate into Shale

This section shows the results of earlier simulations in low permeability shale that leads us to the conclusion that the Bakken shale has several orders or magnitude more permeability that is needed for profitable use of a downhole steam generator.

A model of the Barnett shale was used to evaluate the potential of a downhole steam generator to stimulate production from depleted shale. The model had 1) 1% fracture porosity with 1 and fracture permeability, 10 nd matrix permeability and 7.4% fluid porosity (filled with free oil, gas and water). The remainder of the porosity (10%) was filled with kerogen. 2) The model was 335 feet by 175 feet and 600 feet thick and 6,000 feet deep. The kerogen could decompose to make light oil or be burned. 3) Steam/20% $CO_2$ or Steam/16% $CO_2$/4% $O_2$ were injected in a 100 foot long fracture at one corner, fluids were produced at the other. 4) The model was depleted in 9 months before injection started. The model using ROX with a 10 nd matrix is promising.

Figure 40:
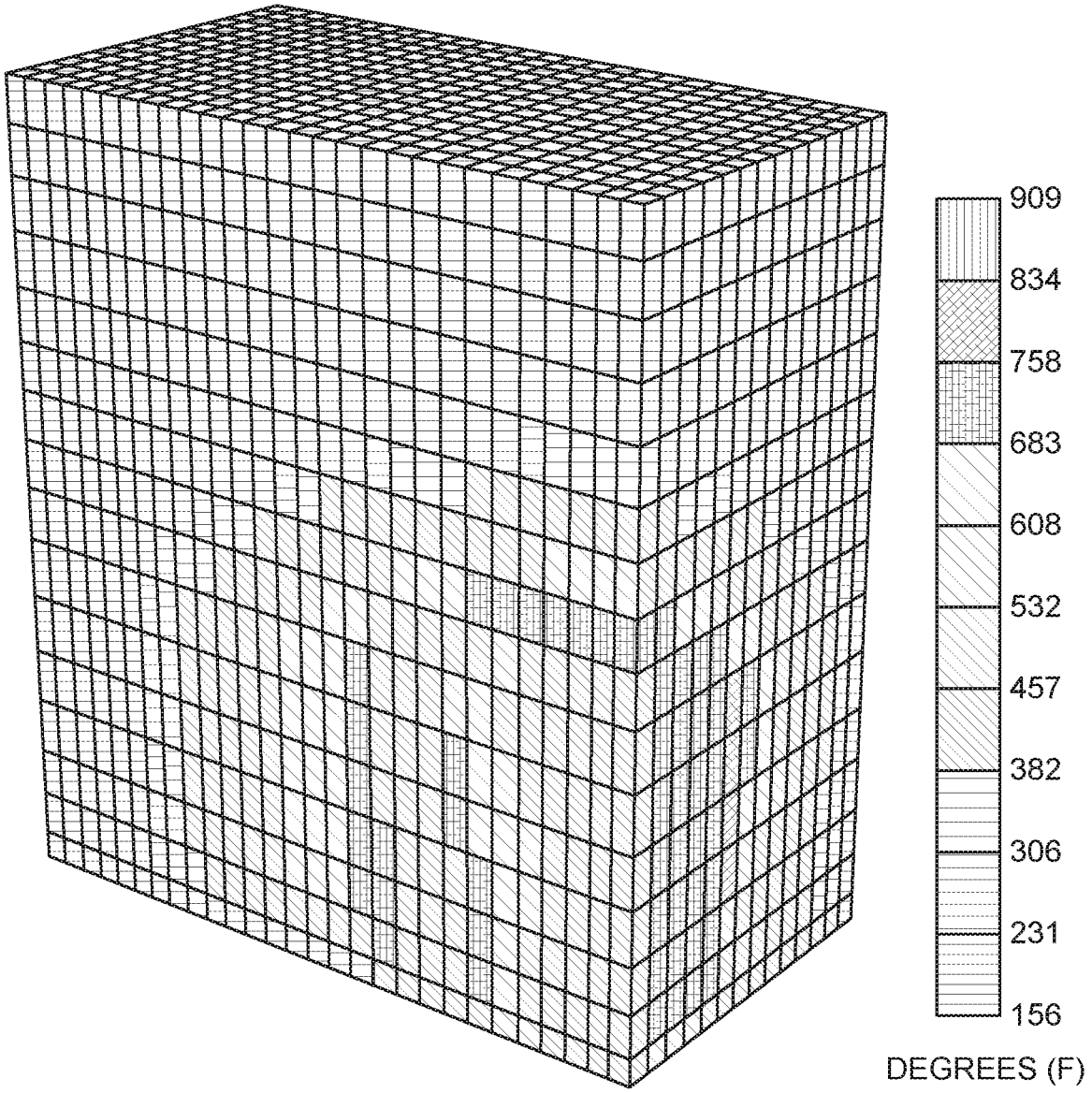
FIG. 40 is a graph showing temperatures in a shale formation after several years of steam/$CO_2$ and $O_2$ injection.

FIG. 40 illustrates the size of the model and its temperature after five years of injection from a downhole steam generator. As noted above, the model is 175 feet wide, 335 feet thick and 600 feet thick. The downhole steam generator was placed at the top of a 300 foot high by 100 foot wide fracture. Fluids were injected at a pressure of 2,000 psi into models with 0.1 nd to 10 nd permeability. The Bakken shale's is 1,000 times as high. So, we are presenting these results to illustrate that it should be much easier to inject fluids into the Bakken and Three Forks, which is thinner but has higher permeability rock dispersed in the shales.

The figure also shows that the temperature is much higher than liquid water can exist at 2,000 psi. The temperature at some points is 800° F. to 900° F. This means that enough kerogen has burned to vaporize all of the pore water.

Figure 41:
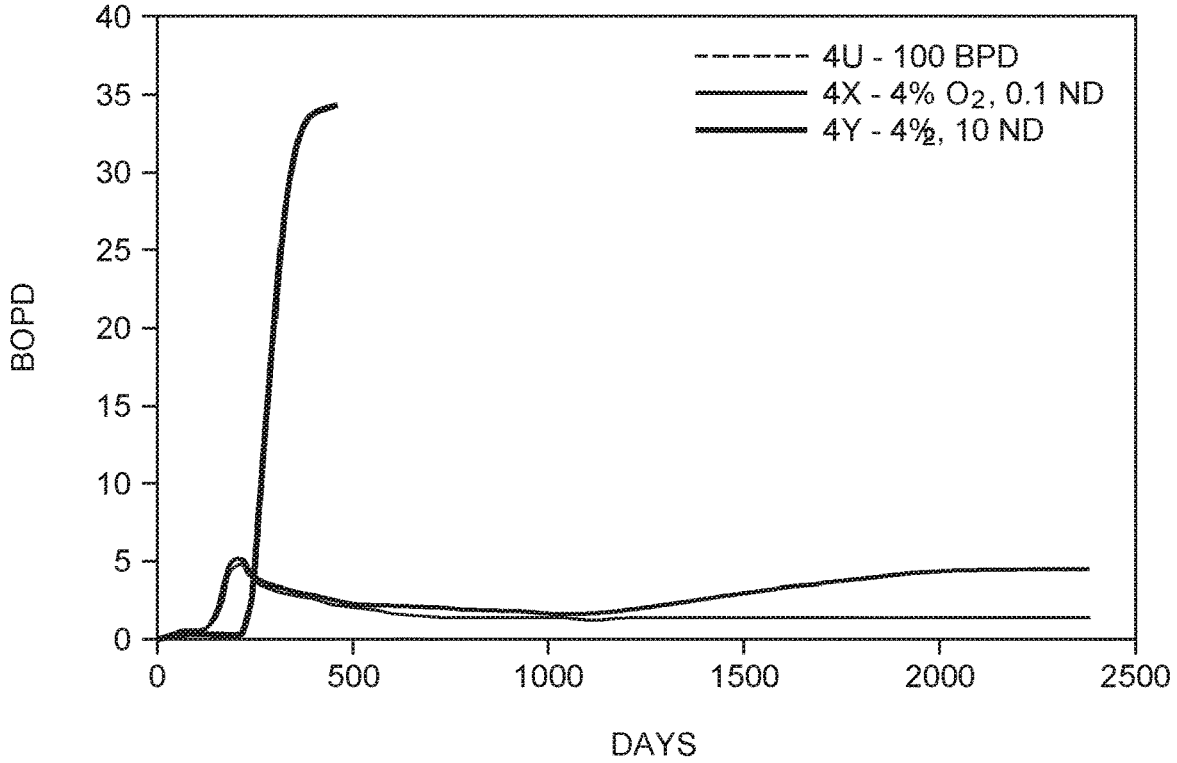
FIG. 41 is a graph showing the effect of matrix permeability and $O_2$ on oil production rates.

FIG. 41 shows that very little oil could be produced when steam and $CO_2$ are injected into a model with 0.1 nd matrix permeability. More oil is produced if 4% $O_2$ is substituted for $CO_2$ in the downhole steam generator. However, the oil production is delayed several years. Now, when the permeability of the matrix is raised 100×(to 10 nd), the production rate rose to 35 bpd in slightly over one year.

Figure 42:
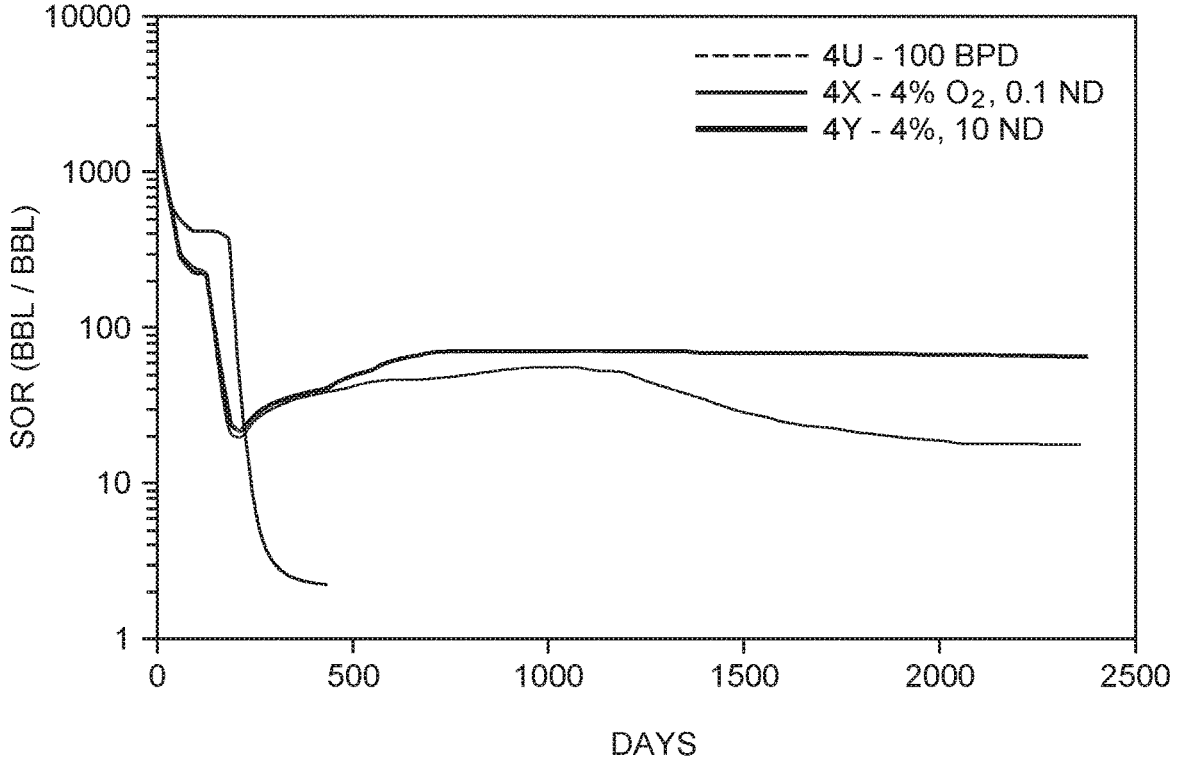
FIG. 42 is a graph showing the effect of matrix permeability and $O_2$ on steam-to-oil ratio.

FIG. 42 shows the steam-oil ratios for the three simulations. The figure shows that the lowest SOR's for the simulations in the 0.1 nd models are around 20. In contrast, the SOR for the 100 nd model drops to 2.2 in 420 days. This is clearly profitable.

In one embodiment, a method (A) for producing hydrocarbons from a shale reservoir that includes positioning a downhole burner in a first well, supplying a fuel, oxidizer, and water to the burner to form steam, injecting the steam and surplus oxygen into the shale reservoir to form a heated zone within the shale reservoir, wherein the surplus oxygen reacts with hydrocarbons in the reservoir to generate heat; wherein the heat from the reactions with the hydrocarbons and the steam increases permeability in a kerogen-rich portion of the shale reservoir, and producing hydrocarbons from the shale reservoir.

The method of A may further comprise (B) supplying carbon dioxide to the shale reservoir, wherein the carbon dioxide is supplied as a combustion by-product and/or from the surface. The method of B may include carbon dioxide provided to the downhole burner with the oxidizer, through a separate conduit, or combinations thereof. The method of B may include carbon dioxide being recovered and/or recycled from the produced hydrocarbons.

The method of A may also include (C) kerogen being converted into oil and/or gas, and the conversion increases the pressure locally to form micro-fractures in the shale reservoir. The method of C may include the conversion of kerogen increasing the permeability of the shale reservoir by one or more orders of magnitude. The method of C may also include (D) injecting the steam and surplus oxygen into the shale reservoir, which comprises a first process performed within a first time period, and the method C further comprises a second process performed within a second time period after the first period, the second process comprising injecting water and/or carbon dioxide into the shale reservoir. The method of D may include (E) the first time period being one to three years. The method of E may include the second time period being four to eight years.

The method of D may include the water and/or carbon dioxide being injected into the shale reservoir at a pressure greater than an injection pressure of the steam. The method of D may also include the water and/or carbon dioxide being injected into the shale reservoir at a pressure of about 3,000 pounds per square inch, or higher.

The method of A may include (F) the hydrocarbons being produced by one or more additional wells different than the first well. The method F may further include controlling a back pressure of the one or more additional wells to maintain a pressure in the shale reservoir greater than a pressure in the shale reservoir before injecting the steam.

The method of A may include an injection pressure of the steam being about 2,000 pounds per square inch, or higher. The method A may also include injecting the steam and surplus oxygen into the shale reservoir in a first process performed within a first time period, the method further comprising a second process performed within a second time period after the first period, the second process including injecting water and/or carbon dioxide into the shale reservoir, wherein an injection pressure of the water and/or carbon dioxide is about 3,000 pounds per square inch, or higher.

Another embodiment includes a method (G) for producing hydrocarbons from a shale reservoir which includes positioning a downhole burner in a first well, supplying a fuel, oxidizer, water to the burner to form steam, wherein the oxidizer is in a quantity that introduces surplus oxygen into the shale reservoir, injecting gases, steam and surplus oxygen into the shale reservoir to form a heated zone within the shale reservoir, micro-fracturing and/or increasing a porosity of the shale reservoir using the steam, gases and surplus oxygen by heating kerogen deposits within the shale reservoir, and producing hydrocarbons from the shale reservoir. The method of G may further include heating of kerogen that increases the porosity of the shale reservoir by one or more orders of magnitude.

The method of G may further include (H) injecting water and/or carbon dioxide into the shale reservoir. The method of H may include the water and/or carbon dioxide being injected into the shale reservoir at a pressure of about 3,000 pounds per square inch, or higher.

The method of G may further include (I) the hydrocarbons being produced by one or more second wells different than the first well. The method of I may further include controlling a back pressure of the one or more second wells to maintain a pressure in the shale reservoir that is greater than an injection pressure of the steam.

Another embodiment includes a method (J) for producing hydrocarbons from a shale reservoir which includes positioning a downhole burner in a first well, supplying a fuel, oxidizer and water to the burner at a pressure of about 2,000 pounds per square inch to form steam and a heated zone within the shale reservoir, wherein the oxidizer is in a quantity that produces surplus oxygen in the shale reservoir, micro-fracturing the shale reservoir using the steam and surplus oxygen by heating kerogen deposits within the shale reservoir, wherein the micro-fracturing accelerates when the temperature of the shale reservoir reaches or exceeds about 550° Fahrenheit, and producing hydrocarbons from the shale reservoir. The method of J may also include the hydrocarbons being produced by one or more second wells different than the first well.

The method of J may include (K) injecting the steam and surplus oxygen into the shale reservoir comprises a first process performed within a first time period, the method further comprising a second process performed within a second time period after the first period, the second process including injecting water and/or carbon dioxide into the shale reservoir. The method of K may further include the water and/or carbon dioxide being injected into the shale reservoir at a pressure greater than an injection pressure of the steam. The method of K may also include the carbon dioxide being recovered from the produced hydrocarbons with a portion of the carbon dioxide being recycled and reinjected into the shale reservoir. The method of K may also include the water and/or carbon dioxide being injected into the shale reservoir at a pressure of about 3,000 pounds per square inch or higher.

While the foregoing is directed to embodiments of the disclosure, other and further embodiments may be devised without departing from the basic scope thereof, and the scope thereof is determined by the claims that follow.

The invention claimed is:

1. A method for producing hydrocarbons from a shale reservoir, comprising:

positioning a downhole burner in a first well;

supplying a fuel, oxidizer, and water to the downhole burner to form steam;

injecting the steam and surplus oxygen into the shale reservoir to form a heated zone within the shale reservoir, wherein the surplus oxygen comprises oxygen leftover from the oxidizer after formation of the steam that is released from the downhole burner, wherein the surplus oxygen being between about 0.25% mole fraction to about 5% mole fraction reacts with hydrocarbons in the reservoir to generate heat, and wherein the heat from the reactions with the hydrocarbons and the steam increases permeability in a kerogen-rich portion of the shale reservoir;

alternately injecting water and carbon dioxide into the shale reservoir after injecting the steam and surplus oxygen, wherein the water and carbon dioxide are injected into the shale reservoir at an injection pressure that is greater than an injection pressure of the steam and surplus oxygen; and producing hydrocarbons from the shale reservoir.

2. The method of claim 1, wherein the heat from the reactions with the hydrocarbons and the steam expands fluids in pores of the kerogen rich portion and produces fractures within the shale reservoir.

3. The method of claim 2, wherein the fractures are formed by the pyrolyzation of kerogen within the shale reservoir.

4. The method of claim 3, wherein kerogen in a solid phase is converted into a liquid and/or a gas having a higher specific volume than the kerogen in the solid phase.

5. The method of claim 2, wherein the fractures are produced by heterogeneous heating of the rock matrix causing local thermal stresses.

6. The method of claim 1, wherein the heat from the reactions with the hydrocarbons and the steam further includes:

converting existing oil trapped in pores of the shale reservoir and expanding the existing oil to increase the permeability of the shale reservoir.

7. The method of claim 6, wherein the expansion of the existing oil produces fractures in the shale reservoir.

8. The method of claim 1, wherein kerogen is converted into oil and/or gas, and the conversion increases the pressure locally to form micro-fractures in the shale reservoir.

9. The method of claim 8, wherein micro-fracturing increases the permeability of the shale reservoir when the temperature of the kerogen exceeds about 550° F.

10. A method for producing hydrocarbons from a shale reservoir, comprising:

positioning a downhole burner in a first well;

supplying a fuel, oxidizer, and water to the downhole burner to form steam, wherein the oxidizer is in a quantity that introduces about 0.25% mole fraction to about 5% mole fraction surplus oxygen into the shale reservoir at a tailpipe of the downhole burner;

injecting gases, steam, and surplus oxygen into the shale reservoir to form a heated zone within the shale reservoir;

micro-fracturing and/or increasing a porosity of the shale reservoir using the steam, gases, and surplus oxygen by heating kerogen deposits within the shale reservoir;

alternately injecting water and carbon dioxide into the shale reservoir after injecting the gases, steam and surplus oxygen, wherein the water and carbon dioxide are injected into the shale reservoir at an injection pressure that is greater than an injection pressure of the gases, steam and surplus oxygen; and producing hydrocarbons from the shale reservoir.

11. The method of claim 10, wherein an injection pressure of the steam is about 2,000 pounds per square inch, or higher.

12. The method of claim 10, wherein the micro-fracturing accelerates when the temperature of the kerogen exceeds about 550° F.

13. The method of claim 10, wherein the carbon dioxide is recovered from the produced hydrocarbons with a portion of the carbon dioxide being recycled and reinjected into the shale reservoir.

14. A method for producing hydrocarbons from a shale reservoir, comprising:

a first recovery period, comprising:

positioning a downhole burner in a first well;

supplying a fuel, oxidizer, and water to the downhole burner to form steam;

injecting the steam and surplus oxygen into the shale reservoir to form a heated zone within the shale reservoir, wherein the surplus oxygen comprises oxygen leftover from the oxidizer after formation of the steam that is released from the downhole burner, wherein the surplus oxygen reacts with hydrocarbons in the reservoir to generate heat, and wherein the heat from the reactions with the hydrocarbons and the steam increases permeability in a kerogen-rich portion of the shale reservoir; and producing hydrocarbons from the shale reservoir; and a second recovery period, comprising:

alternately injecting water and carbon dioxide into the shale reservoir after the first recovery period at an injection pressure that is greater than an injection pressure of the steam and surplus oxygen in the first recovery period.

15. The method of claim 14, wherein an injection rate of the steam is maintained based on a backpressure of the shale reservoir.

16. The method of claim 15, wherein the injection rate maintains and enhances, by a dilation process, existing natural and induced fractures, as well as dilation of pores in the reservoir.

17. The method of claim 14, wherein a pressure of the shale reservoir is reduced through conventional primary production before steam injection begins.

18. The method of claim 14, further comprising:

one or more infill wells are drilled at distances less than about a quarter of a mile laterally from a horizontal of the first well to maintain heating of the shale reservoir to promote micro-fracturing.

* * * * *